US007216600B1

(12) United States Patent
Hamilton et al.

(10) Patent No.: US 7,216,600 B1
(45) Date of Patent: May 15, 2007

(54) HIGH MANEUVERABILITY TOWCRAFT

(75) Inventors: J. Douglas Hamilton, 1551 Independence Dr., Newark, OH (US) 43055; Herbert L. Hall, Jr., Newark, OH (US)

(73) Assignee: J. Douglas Hamilton, Newark, OH (US)

( * ) Notice: Subject to any disclaimer, the term of this patent is extended or adjusted under 35 U.S.C. 154(b) by 102 days.

(21) Appl. No.: 11/012,948

(22) Filed: Dec. 15, 2004

Related U.S. Application Data

(60) Provisional application No. 60/544,432, filed on Feb. 16, 2004, provisional application No. 60/529,813, filed on Dec. 16, 2003.

(51) Int. Cl.
*B63B 21/56* (2006.01)
*A63B 31/10* (2006.01)

(52) U.S. Cl. ..... 114/242; 441/65

(58) Field of Classification Search ..... 114/242, 114/246

See application file for complete search history.

(56) References Cited

U.S. PATENT DOCUMENTS

| | | | | |
|---|---|---|---|---|
| 2,815,518 | A | 12/1957 | Kuehn | |
| 2,865,032 | A | 12/1958 | Moody, Jr. | |
| 2,910,708 | A | 11/1959 | Albright | |
| 3,027,574 | A * | 4/1962 | Meehan | 441/69 |
| 3,581,328 | A | 6/1971 | Smith | |
| 4,213,413 | A | 7/1980 | Courtney | |
| 4,302,858 | A | 12/1981 | Casciano | |
| 4,331,340 | A * | 5/1982 | Bolen | 280/845 |
| 4,361,103 | A | 11/1982 | Willat | |
| 4,708,675 | A | 11/1987 | Shoeffler et al. | |
| 5,076,189 | A | 12/1991 | Jones | |
| 5,247,898 | A * | 9/1993 | Thornlimb | 114/246 |
| 5,462,001 | A | 10/1995 | Lemelson | |
| 5,702,278 | A | 12/1997 | Boucher | |
| 5,881,665 | A | 3/1999 | Ratcliff | |
| 5,888,110 | A | 3/1999 | Haller et al. | |
| 5,899,782 | A | 5/1999 | Martin | |
| 5,906,526 | A | 5/1999 | Freeman | |
| 6,006,690 | A | 12/1999 | Roy | |
| 6,149,479 | A | 11/2000 | Redmon et al. | |
| 6,182,594 | B1 | 2/2001 | Wilson | |
| 6,247,984 | B1 | 6/2001 | Hatcher | |
| 6,477,976 | B2 | 11/2002 | Van Gelder | |
| 6,638,125 | B1 | 10/2003 | Mossel | |
| 6,655,701 | B2 | 12/2003 | Oberpriller | |

* cited by examiner

*Primary Examiner*—Jesús D. Sotelo
(74) *Attorney, Agent, or Firm*—MacMillan, Sobanski & Todd, LLC

(57) ABSTRACT

A high maneuverability towcraft has a hull, a primary water-engaging device, and a towline attachment above a waterline of the hull. A towline line-of-tension extends through an effective centerline of the primary water-engaging device. The towcraft also has a castering device for providing directional stability to the towcraft which allows the towcraft to follow the lead of the primary water-engaging means. The stability of the towcraft is not negatively impacted either by any lateral force of the towline or by an instantaneous position of the towline with respect to a front of the towcraft.

22 Claims, 25 Drawing Sheets

HIGH MANEUVERABILITY TOWCRAFT

This application claims the priority of Ser. Nos. 60/529,813 filed on Dec. 16, 2003 and 60/544,432 filed on Feb. 16, 2004, which are expressly incorporated herein by reference.

TECHNICAL FIELD

The present invention relates to recreational watercraft of the type which is directly pulled or towed behind power boats, personal water craft (PWC), and the like. The present invention more particularly relates to a towcraft which is highly maneuverable by its rider.

BACKGROUND OF INVENTION

Prior art recreational towcraft are designed to carry one or more riders in a prone, seated, or kneeling position, and are intended to be towed at a safe distance behind the powered towing craft. Enjoyment of this activity is derived by virtue of the close proximity of the rider to the water which lends a sensation of high speed. Other aspects of this activity which have broad appeal to a large populace are that the rider or riders do not need to possess certain skills, strength, coordination, or balance in order to enjoy this water sport. Consequently, it is an activity in which the whole family can participate.

Prior art towcraft, steerable and non-steerable alike, have a number of drawbacks. The primary drawback of these recreational devices is the inability to satisfactorily maneuver the device from side to side; that is, to be able to easily and controllably cross and sometimes jump the power boat's wake while the boat is traveling in a straight line. To be simply towed in the prop wash directly behind the power boat or other powered towing craft is not as much fun as quickly "attacking" the wake, loitering along one side, balancing on its ridge, or, crossing over to the calm water outside of the wake. In order for prior art non-steerable towcraft to cross the boat's wake, the boat driver, in coordination with the boat's observer, must cause the boat to make large S-turns while traversing a lake or river. These large S-turns tend to occupy a large amount of space on the lake and can significantly increase the risk of serious injury to the rider or riders of non-steerable towcraft and prior art steerable towcraft.

Many tubing accidents occur because the boat driver either turns too sharply and whips the towcraft too hard or too far to one side of the boat or causes the towcraft to be slung into the path of an oncoming skier, boat, or, to strike a stationary object such as a dock or buoy.

Another deficiency associated with prior art towcraft which claim to be steerable relates to those times when a power boat driver must make a turn; for example, to follow the course of a river, to turn around at the end of a lake or other body of water, to avoid other water traffic, or to return to a launching point. In these instances the towcraft rider should be able to maintain any desired position behind the power boat (preferably, to the inside of the turn).

A further drawback of prior art claimed steerable towcraft relates to directional control of the craft. While certain designs claim to be able to maintain a certain angle relative to a boat's direction of travel, when the boat is traveling in a straight line, the manner in which they dispatch this steering action does not inspire much confidence on the part of the rider. Prior art towcraft generally suffer from poor directional stability; for example, this can take the form of poor or delayed directional responsiveness to steering inputs, induced oscillations, or inadvertent direction changes.

In order to differentiate between the several types of steering approaches adopted by the prior art, a system of classes has been devised. What sets each class apart is a distinguishing characteristic; such as, a principal feature or a claimed action (by the towcraft or its rider). The first class (Class 1) principally involves rider leaning or weight-shifting. The second class (Class 2) is where the entire body of the towcraft is rotated about its center. The third class (Class 3) involves simple manipulation of one or more rudders and a fixed forward towline attachment point. The fourth class (Class 4) involves a combination of craft rotation and one or more rudders at the rear of the towcraft.

Steerable towcraft which relies on leaning (Class 1) typically have aft-mounted, or mid-mounted, off-angle (relative to the craft's longitudinal axis), spaced-apart fins or sponsons which project downward or at an angle and are sewn or bonded to the lower sides or bottom of the fabric bag or cover assembly, or, are simply bonded to the inflated chamber itself, if there is no cover. During straight and level operations, the fins are intended to be out of the water, or partially out of the water. One example of a Class I towcraft is disclosed by U.S. Pat. No. 5,702,278 which describes that, by leaning to one side, the towcraft may be made to turn in that direction.

U.S. Pat. No. 5,702,278 depicts a sponson shaped according to a wedge. Severely tapered sponsons, whose thickness markedly decreases from the base to the distal edge, are disadvantageous due to the higher drag associated with that shape, and, when at nominal towing speed, can itself be made to plane, which, decreases the engagement of the sponson with the water.

U.S. Pat. No. 6,247,984 also discloses towcraft with a fixed forward towline attachment point and alternately engageable fins or sponsons.

Class 2 steerable towcraft are ones which turn the entire body or hull of the towcraft about a central vertical axis as in the manner of a wakeboard. There are a number of approaches the prior art has taken with regard to the construction of Class 2 steerable towcraft. Deficiencies associated with one type are a slow and imprecise steering response rate, and, an inability for the rider to stay with the craft during aggressive steering maneuvers. Another type is costly to manufacture and does not provide an exciting ride experience. The latter style is made in the shape of a boat (U.S. Pat. No. 5,881,665). Other examples of Class 2 towcraft are disclosed in U.S. Pat. No. 5,888,110, and U.S. Pat. No. 5,899,782. These patents disclose inflatable devices which are made to be rotated horizontally in the water while being towed behind a power boat or other powered craft.

A Class 3 style of towcraft is disclosed in U.S. Pat. No. 5,906,526 which has its towline attachment method is a simple fixture at the front of the craft. A variation of a Class 3 style of towcraft having rudders and a fixed forward towline attachment point is described in U.S. Pat. No. 5,247,898.

An example of a Class 4 claimed steerable towcraft is disclosed in U.S. Pat. No. 6,182,594. It utilizes a semi-rigid shell, curved track and trolley, inflated inner tube, and separate rope mounted steering grips which are connected by means of ropes to a rudder located at the rear of the towcraft.

U.S. Pat. No. 5,076,189 discloses a towable water sled which features a forward pivoting handlebar, a pair of pivoting, transversely spaced-apart rudders near the stern, and a fixed towline attachment means.

U.S. Pat. No. 6,477,976 discloses a costly towcraft constructed in the shape of a tunnel-hulled personal watercraft (PWC) with spaced-apart sponsons which comprise the forward half of the towcraft's overall length.

U.S. Pat. No. 6,638,125 describes a towboard which consists of a long narrow board-shaped form with a hinged extension rising up and back from the front of the craft.

It is important that the towcraft not be overly sensitive to the variations in water and operational conditions typically encountered during water sport towing exercises.

Therefore, one object of the present invention is to provide a low-cost towcraft which is highly maneuverable and easily controllable by an intuitive leaning action and/or has a transverse differential drag condition, or a combination of the two features.

A further object of the present invention is to provide a pivoting forward rudder style of towcraft which may be made convertible to a steer-by-leaning type.

Another object of the present invention is to provide a compact, economically manufactured, towcraft capable of being controllably steered with little effort at all reasonable towing speeds.

It is another object of the present invention to provide a towcraft that features neutral handling characteristics where the steering input is intuitive, the steering response is proportional to the input, and preferably, large steering input displacements are not required.

It is another object of the present invention that the steerable towcraft accommodates and provides a stable, predictable, responsive, towing experience for riders, regardless of their height, weight or skill level.

It is a further object that the steerable towcraft is able to be operated by at least one rider such that the rider is able to maneuver and stay to the inside of a turn regardless of the maneuvering of the power boat towing the craft.

It is another object of the present invention is to provide a steerable towcraft having a steering action that preferably aims the front of the towcraft in the direction of travel.

It is still a further object of the present invention that the rider or riders be provided with means of being able to stay with the towcraft during aggressive maneuvers and during rough water conditions.

A still further object of the present invention is to be able to adjust the towcraft's maneuverability and handling characteristics in the water according to the rider's preferences.

A still further object of the present invention is to provide a towcraft which is easily transportable in the back of a vehicle (SUV, pick-up truck, station wagon, etc.) or on top of a vehicle, without requiring the use of a trailer. The towcraft should be able to be quickly and easily disassembled with a minimum or complete absence of tools.

A still further object of the present invention is to provide a towcraft which easily lifted and carried by one or two people.

A still further object of the present invention is to provide a steerable towcraft is provided which is comfortable to sit in or to lie prone on, especially when landing back on the craft after performing a wake jump.

A still further object of the present invention is to provide a highly stable platform which is not easily upset when at rest in the water.

And finally, it is an object of the present invention to provide a towcraft that is able to be easily emptied of any accumulated water by one person while that person is in the water.

SUMMARY OF THE INVENTION

In one aspect, the present invention relates to a high maneuverability towcraft having a hull with a towline attachment means above a waterline of the hull. A primary water-engaging means is operatively connected to the hull. In certain embodiments, the primary water-engaging means has a sidewall area that defines at least about 80% of instantaneous anti-slip characteristics of the towcraft. The towcraft also includes a means for extending a towline line-of-tension through an effective centerline of the primary water-engaging means, and a castering means for providing directional stability to the towcraft. The castering means allows the towcraft to follow the lead of the primary water-engaging means while not negatively impacting the stability of the towcraft either by any lateral force of the towline or by an instantaneous position of the towline with respect to a front of the towcraft.

In certain aspects, the primary water-engaging means is operatively mounted on the hull at least forward of a center of gravity of the towcraft. Also, in certain aspects, the centerline comprises a pivot axis extending through the primary water-engaging means and at least nearly passes through a centrum of the primary water-engaging means. The lateral force produced by the towline line-of-tension does not induce, or produce, an undesirable horizontal torque about the primary water-engaging means.

In a further aspect, the high maneuverability towcraft includes a means for steering the towcraft operatively connected to the hull. Also, the towline is connected in a pivoting manner to an intermediate point along a shaft of the primary water-engaging means at a point above the waterline of the towcraft and between the primary water-engaging means and the steering means. The steering means and the primary water-engaging pivot shaft are pivotably connected to the towline attachment means.

The primary water-engaging means has at least a partially balanced front/rear areal bias such that a product of a first area in front of the pivot axis and its effective moment arm from the pivot axis is either equal to or somewhat less than a product of a second area to the rear of the pivot axis and its effective moment arm from the pivot axis whereby the ratio of these two products equals: ($\text{area}_{front} \times \text{moment arm}_{front}$) divided by ($\text{area}_{rear} \times \text{moment arm}_{rear}$). In certain embodiments, the front/rear areal moment ratio is not less than about 30/70, and optionally, the front/rear total moment ratio not be less than about 40/60 and not greater than about 50/50.

In further embodiments, the high maneuverability towcraft further including a means for stabilizing a front of the towcraft from penetrating a wave or becoming swamped and for improving a ride of the towcraft in rough water. The stabilizing means comprises a forward inclined plane operatively connected to and in a companion pivoting relationship with the upper extent of the rudder, the stabilizing means being positioned above a main body of the rudder and below the towline attachment location.

In certain embodiments, the high maneuverability towcraft further includes spaced-apart fins operatively attached to the hull. The fins have at least one of: flexible trailing portions such that the fins are capable of flexing both sideways and in the camber direction, or flexible trailing upper edges such that the fins are capable of flexing the trailing upper edges away from oncoming water, thereby increasing the engagement of the fins with the water.

In still further embodiments, the hull comprises a smooth, predominantly planar, or slightly concave, bottom surface and has a sharp break along an aft edge of the hull for canceling a Coanda Effect and its associated drag on the towcraft.

Various objects and advantages of this invention will become apparent to those skilled in the art from the following detailed description of the preferred embodiment, when read in light of the accompanying drawings.

DESCRIPTION OF THE PREFERRED EMBODIMENT(S)

Figure 1:
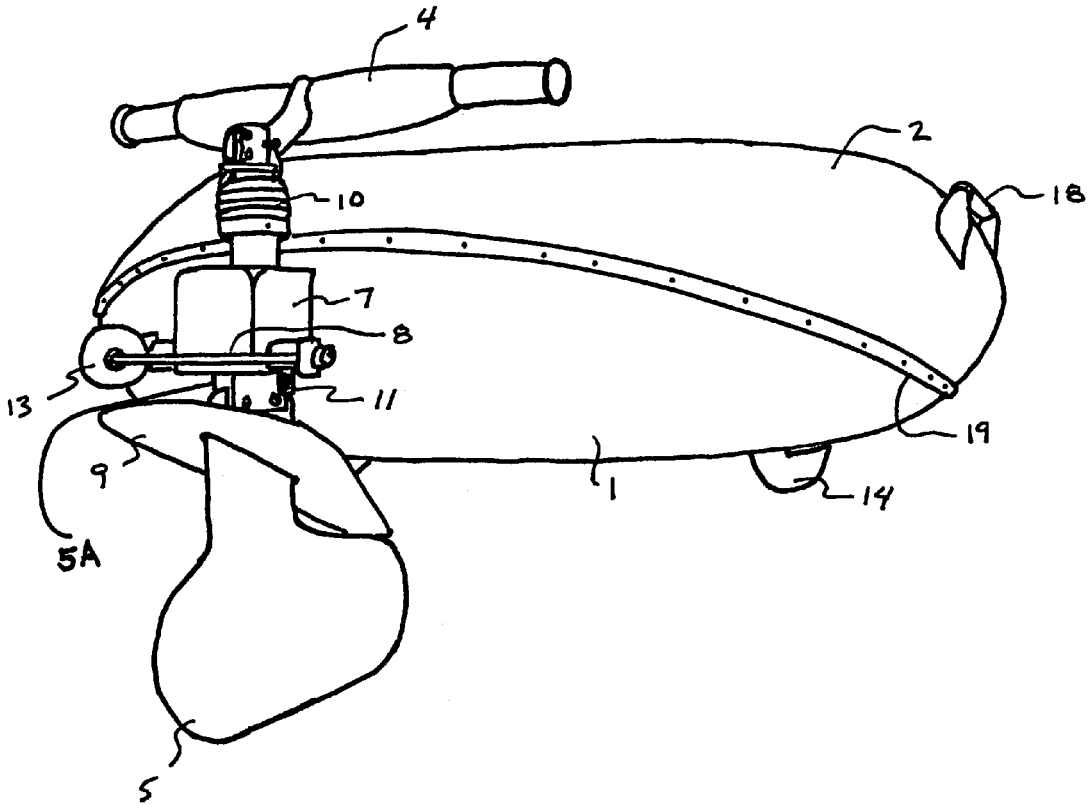
FIG. 1 is a schematic perspective illustration of one embodiment of a high maneuverability towcraft according to the present invention.

In one aspect, the present invention provides a towcraft having a rigid or semi-rigid, partial hull; at least one flotation means; at least one dual-purpose, balanced, forward rudder with stops and self-centering means; at least one rudder-mounted inclined plane; at least one slidable, at least one towline attachment means; spaced-apart fins; and steering assembly such as, for example, a handle bar. The present invention provides a towed watercraft that is easily steerable and highly maneuverable. Further, in one preferred embodiment the front of the towcraft is maintained in a forward-facing attitude with a minimal amount of sideways slewing. Still further, one preferred embodiment permits a small total steering input (angular displacement) at all offset angles. Since the present invention is novel in that it is a high maneuverability towcraft, it will hereafter be referred to as an HMT.

In one preferred embodiment, a pivoting rudder, rudder-mounted inclined plane, and handlebar or steering assembly are mounted to the front of a rigid, or semi-rigid, partial hull incorporating flotation means. At least a partial hull, or structural frame, is minimally required to withstand the considerable racking loads placed on it by the rudder during aggressive maneuvering operations, and, as mounting locations for spaced-apart fins. The rudder is a balanced design such that vertical sidewall area exists both fore and aft of its vertical pivot axis. The towline is attached to a grommet which passively slides on a short, forward-mounted, horizontally disposed, curved bail. The origin of the bail's radius of curvature coincides with the rudder's vertical pivot axis.

A single rider on the above described HMT would typically lie prone or kneel on the cushioned upper surface of the hull in a forward-facing direction. The rider would normally grasp the handlebar with both hands. Almost as soon as the boat and towcraft is underway, the rider has enough steering authority to easily maneuver (steer) the HMT to either side. This is desirable in that one may immediately maneuver the HMT outside of the developing wake and thereby avoid the churning prop wash during the acceleration phase. Steering authority at slow towing speeds is also desirable in that an HMT may be towed by lower powered watercraft and still provide a controllable and exhilarating ride experience. Additionally, steering authority at slow speeds builds confidence in young and inexperienced riders. The present invention also discloses other practical embodiments in which the present invention may be alternatively practiced. The alternative embodiments conform, at least, to the two critical design principles associated with one preferred embodiment; namely, that the towline line-of-force is always made to pass through the effective centerline of a balanced, or nearly balanced, primary water-engaging device, and, that the rotation of the steering member is not negatively impacted in any way by the lateral pull of the towline or its instantaneous position with respect to the front of the towcraft.

While differing in certain aspects from the preferred embodiment, the alternative embodiments also offer a novel and rewarding towcraft ride experience while having a somewhat different maneuverability capability relating to the directional rate-of-change. In some instances, certain alternative embodiments are lower in cost to produce than the preferred embodiments. In other instances, certain alternative embodiments allow multiple riders to cooperatively steer the towcraft. In still other instances, certain alternative embodiments of the present invention offer improved wake jumping characteristics.

A key aspect of the alternative embodiments, shared with the preferred embodiment, is that the rider, or riders, have positive control over the steerability of the towcraft. Additionally, in each case, the rider, or riders, are able to stay in control and remain on the craft despite its movement in reaction to water conditions and steering inputs. Another important aspect which is retained by the alternative embodiments is that the steering action, or input, by the rider (or riders) is still intuitive. Counter-intuitive steering is inherently dangerous in critical decision-making situations, and, it protracts the learning process.

The alternative embodiments of the present invention differ in important aspects from the prior art by providing the rider with a vastly improved steerable ride experience over that of the prior art crafts.

Thus, the alternative embodiments of the present invention may be categorized according to general configurations. A first alternative embodiment of the present invention entails a circularly-shaped towcraft adapted to be steerable by one or more riders. Towline attachment may incorporate either a simple, single-point, means, or, involve the use of covered multiple straps. The use of multiple straps prevents any excessive yaw motions which sometimes accompany rapid direction changes. Preferably, the toroidal tube structure consists of a lower rigid, or semi-rigid, continuous-bottom hull with cushioning and flotation means comprising the upper portion thereof. A vertical rudder and pivot shaft, topped with a steering wheel, is centrally located within the circular hull. The rudder pivot shaft passes through the floor of the towcraft and connects the rudder to the steering hand wheel. This embodiment of towcraft utilizes a balanced, or partially balanced, rudder design. Preferably, rudder area forward of the rudder's pivot axis should be equal to or slightly less than the area aft of the pivot axis (symmetrical rudders). No fins are required, nor are recommended.

In this embodiment, the towcraft's occupants are seated in a circle around and facing the one steering wheel. The towcraft is operatively steered by the occupants' individual or collective effort to rotate the steering wheel, and hence the rudder, in one direction or the other. A single rider may easily shift his or her position to enhance handling characteristics of the towcraft when it is underway in the water, and, to maintain optimum forward visibility of water conditions ahead.

A second alternative embodiment configuration (similar in some aspects to a Class 2 style) entails a laterally moveable forward towline attachment device which is actively controlled by one or more riders through a close-coupled means. Movement of this forward device causes the hull of the towcraft to rotate about a vertical axis. Within this configuration, there is no separate pivoting rudder. Instead, one or more primary fin-like water-engaging devices are firmly affixed to the bottom surface of a rigid, or semi-rigid hull, or frame, by which water is diverted in the manner of a rudder when the hull, or body, of the towcraft is rotated horizontally in the water. The difference between the variants of this configuration is in the details of the construction and operation of the forward, laterally moveable, towline attachment device.

A third alternative embodiment configuration entails a forward, laterally movable, towline attachment point which is passively controlled. The rigid, or semi-rigid, body with flotation means and fixed, spaced-apart, fins (primary water-engaging devices) is rotated in a horizontal plane by means of rider leaning or weight-shifting (combination Class 1 and Class 2). This embodiment differs from the prior art in that at least two downward projecting, spaced-apart, narrow fins, arcuate forward towline track, and passive slider are used in conjunction with rider leaning to effect a steering action of the towcraft.

A fourth alternative embodiment of the present invention pertains to a steerable tow-board which permits a standing rider to maneuver the tow-board through the use of a remotely positioned handle and dual control lines, or alternatively, a collapsible/extendible steering shaft, and towline attachment means to operatively control a single forward rudder. A kneeling rider grasping a handlebar directly connected to the forward rudder represents another iteration of this fourth alternative embodiment. A distinction is made between a tow-board and the previously described towcraft. A tow-board, like skis or a wake-board, does not support the weight of the rider when at rest. The requisite support, or lift, is only developed through a water planing action.

A fifth alternative embodiment of the present invention pertains to a steerable tow-board which has no separately rotatable rudder. Instead, rider leaning causes the tow-board to swing, or rotate, in a horizontal plane. Preferably, one forward ventral fin (primary water-engaging device) and two mid-mounted, spaced-apart, slightly toed-out, fins are used whereby a differential drag (due to a leaning action) between the two spaced-apart fins causes the tow board to be steered at will. Preferably, in the instant alternative embodiment, the towline is attached to a point directly above the forward ventral fin's effective vertical centerline. In the case of dual, spaced-apart, primary water-engaging fins, the towline attachment point should consist of a slider and short horizontal bail whose center of radius coincides with the effective middle position of the two spaced-apart fins, which, is functionally equivalent to a single fin at that location.

A handgrip is provided for standing riders to prevent them from falling over backwards. The handgrip may simply consist of a cylindrical shape which is connected by means of a rope to a point on the upper surface of the tow-board which is located a short distance behind the towline's attachment point.

The rider would be able to stand on a tow board of the instant embodiment in the manner of a surfer. No foot bindings are needed since the towing force is transferred directly to the board. To assist the tow-boarder in standing on the tow board, and not slipping or falling on its wet surface, the upper surface aft of the handgrip-rope attachment point may either be a roughened, rigid surface; made compliant such that the weight of a person standing on the cushioned surface slightly indents it; or, comprised of one surface of a hook-and-loop fastener means (bottoms of rider's boots fitted with second surface material). Indenting a cushioned pad creates a form-fitting depression which resists any sliding movement of the foot against the cushioned surface when weight is applied. A suitable material for the cushion is known by its trade name as Tempur™. Another suitable material is Sorbothane™. While these two materials are preferred, a wide range of open-celled or closed-cell foams may be employed. When using open-celled foams it is important that the upper membrane covering the foam is itself waterproof and properly sealed around its periphery against water intrusion. The membrane may consist of a coated fabric, or other flexible, sheet material with a compliant layer backing. The membrane also serves to protect the underlying cushion material from abrasion, wear, and degradation.

Any of the slip-resisting methods adequately prevents riders' feet from shifting inadvertently, which could also misdirect a steer-by-leaning type of steerable tow board.

Freeing the rider from foot bindings is safer. Many knee and ankle injuries occur because ski or wake board bindings often severely twists the ankle and leg before releasing the rider's foot during a mishap.

Additionally, a manual towline release mechanism is recommended. The release mechanism may be activated by the rider in the event of an impending mishap; thereby lessening the chance of injury. One release design incorporates a spring tensioned handgrip bail which cooperates with a control cable and casing. The control cable, when the rider's handgrip is released, causes an angled pin to be pulled from the towline connector (disengages the two halves of the connector), thus effectively separating the tow board from the power boat. The towline connector is preferably located a short distance in front of the towcraft. As an added safety feature, when the pin is pulled, the rear half of the separable connector either pulls, or permits a spring to eject a bundle of plastic ribbons from within the bore of the front half of the separable connector (boat-end). The bundle of ribbons are permanently fastened to the boat-end connector by being folded over and clamped at their mid-point. The ends are allowed to splay in the air when the connector is disengaged. This creates sufficient aerodynamic drag which prevents the towline from whipping forward and striking the boat or its occupants. When the connectors are once again to be re-assembled, the bundle of ribbons are returned to the bore of the front connector just prior to joining the two connector halves together. The release device just described may also be adapted for use with other towcraft styles, including conventional non-steerable types.

The tow-board should, minimally, have enough flotation for it to float and be recovered once separated from the rider and the boat.

Therefore, it is apparent that a number of steerable towcraft possibilities have been contemplated and anticipated; the principles of which may be successfully applied to a wide range towcraft styles.

It was recognized from the outset that simply mounting a conventional rudder at the rear or toward the front of a towed watercraft would be ineffective in those instances where the towline is fixedly attached to a point some distance forward of the rudder's effective center. It was also recognized, the several deficiencies and limitations of the prior art's use of long arcuate tracks and passive slider means; and, the use of lateral fins or the re-arrangement of the bottom of the towcraft itself with grooves, fins, or sponsons, and a leaning of the rider, as the sole means of effecting steering inputs to the body of the towcraft, again in those instances where the towline is fixedly attached to its front, particularly, when no other diligence was taken in regard to important ancillary considerations such as: lateral control/counteraction of side-slip, directional/yaw stability, steering response rate, and steering effort.

The prior art did not properly account for all of the variables which can affect the operation of a steerable towcraft, especially, when it is offset laterally with respect to the boat. Additionally, intuitive steering inputs and means whereby the rider(s) may remain on the craft are further important considerations. As a result, prior art towcraft are restricted to a narrow offset angle behind the power boat unless the boat driver performs at least a nominal turning maneuver in order to swing the towcraft outside of its wake, if only for a moment. In most instances, prior art claimed steerable towcraft also entail difficult steering actions on the part of its rider.

Prior art towcraft designers did not have a full understanding of the unique forces acting on a towcraft and what was required, as a result, to properly steer one. While some aspects of their designs were workable, the complete execution was flawed. Therefore, it was determined through theory and validated through practice, that certain basic principles must be recognized and properly incorporated into the towcraft's design in order to provide a means of controllably maneuvering a variety of towcraft styles.

First, from a safety standpoint, the front of the towcraft should preferably point in the direction of travel in order to minimize the risk of a sideways overturning moment from oncoming water striking the side of the craft when it is offset to one side of the boat. Second, a downward projecting water-engaging device of a sufficient size, draft, and flexural strength having minimal drag characteristics must be provided and properly positioned in order to resist and satisfactorily overcome the sideways slip that results from the lateral pull of the towline on the towcraft when the towcraft is offset to one side of the boat. The slip-resisting device, hereafter referred to as a primary water-engaging device, is responsible for maintaining a desired track through the water. Third, an extension of the towline's force vector should be made to pass through, or very nearly pass through, the effective vertical centerline of the primary water-engaging device under all operational conditions. Fourth, the slip-resisting device and the steering device, preferably, should have combined functions. Secondary water-engaging devices or features, such as fins, for example, might also have multiple functions: to assist in the steering response, to prevent excessive yawing of the steered towcraft during a maneuver, and to assist in self-righting the towcraft when it is in an unbalanced load state; for example, when the rider is slid far to one side of the craft. Fifth, the primary water engaging device, whether firmly affixed to the bottom of the towcraft, or separately rotatable, must closely couple the steering input to the output in terms of the towcraft's physical response. Sixth, the steering input by the rider(s) should induce, at most, only a minimal torque, in the horizontal plane, on the body of the towcraft. And seventh, the towline attachment to the towcraft should be set as low as practical on the towcraft, and yet, not so close to the waterline as to be continually dragging therein. By observing these few principles, a variety of towcraft styles and types may successfully be made steerable.

In order to satisfy the aforementioned principles, a forward rudder preferably functions not only as the steering device, but also as the primary water-engaging device. Prior art rudders are only used to exert a torque, or moment, on the body or hull of a watercraft in order to turn it in the water. The hull and keel in prior art watercraft act as a fulcrum and are responsible for preventing a sideways slip in the water; which, allows the towcraft to maintain a parallel track with the boat while it is offset to one side of the boat. In sailboats, and most other watercraft (except for high speed power boats), the rudder is small in size relative to the water-engaging surface area of the hull and keel.

However, the operation of a towcraft is markedly different from that of a typical power boat or sail boat. The present invention provides a combination of both functions into the forward rudder. The dual-purpose rudder enables a very desirable operation in which the body or hull of the towcraft naturally follows the lead of the rudder in much the same manner the rear wheel of a bicycle, casters, or follows the lead of the front wheel. In essence, the rudder is simply towing the hull portion of the towcraft. However, in order for the forward-mounted rudder to function satisfactorily, and the body of the towcraft to follow the rudder's lead, the pull of the towline, or the towline's line-of-tension, must pass through, or nearly pass through, the centerline of the rudder's pivot axis and its centrum over the range of all normal towline offset angles. By passing through the forward rudder's pivot centerline and its centrum, the towline tension force does not induce, or produce, an undesirable horizontal torque about rudder. This is important because an offset line of force relative to the rudder's centerline (even for forward mounted rudders), imposes a torque moment, acting in the horizontal plane, on the towcraft when it is physically offset to one side of the boat. This torque moment is manifested by a rotation of the towcraft about the rudder's pivot axis which swings the rear end of the towcraft to the outside of the turn. An outward swinging, besides being disconcerting to the rider, restricts the towcraft to a narrow swath of area behind the boat, and, can result in tipping of the craft. By having the line of tension pass through, or very nearly pass through, the center of the rudder pivot axis and the rudder's centrum, there are no torque reactions, or at least negligible torque reactions, exerted on the towcraft.

There are several means whereby the towline force vector may be made to effectively pass through the center of the balanced, or nearly balanced, forward rudder's pivot axis. One means is to attach the towline to a loose ring which encircles the rudder shaft. Another means is to attach the towline, in a pivoting manner, to an intermediate point along the rudder pivot shaft, between the rudder and the handlebar. One preferred method is to place a short, horizontally disposed, curved bail and towline slider (towline attachment thereto) in front of the rudder's pivot shaft, a few inches above the towcraft's waterline, such that the bail's radius of curvature is conterminous with the rudder's pivot axis. No matter what operative angle the towline slider makes with the longitudinal axis of the towcraft, the towline's line-of-force always passes through, or nearly through, the center of the rudder pivot axis. The bail, by virtue of its forward-most mounting arrangement, can be easily placed at the most convenient height above the waterline without interfering with the operation of the rudder or the handlebar. A low towline attachment point minimizes the tipping moment of the rudder, as a result of towline tension, from its preferably perpendicular orientation relative to the water's surface. A short bail length permits the towline slider to easily and quickly self-adjust to changing towline alignment angles during rapid directional changes, which, is not possible for long arcuate tracks utilizing passive sliders or trolleys. An advantage the short bail has over other rudder-shaft-centered towline attachment methods is of being able to be mounted in a robust manner to a structural forward box through which the rudder pivot shaft also passes. Due to the considerable forces imposed by the towline on its attachment point, and the rudder's pivot shaft on its sleeve bearing, it is beneficial to have these two attachment locations separated by a small distance in order to reduce a concentration of stress by distributing the forces over a larger area.

In order to eliminate the adverse effects of a second potential source of torque reaction about the rudder's vertical pivot axis, the forward rudder must have at least a partially balanced front/rear areal bias. In other words, the area in front of the rudder pivot axis should be equal to or somewhat less than the area to the rear of its pivot axis, provided the two sections are symmetrical. A balanced rudder design prevents a left-right slewing of the towcraft body about the rudder pivot axis in response to steering torque inputs applied to the handlebar by the rider. Rudders with excess area to the rear of its pivot shaft causes a torque reaction which slews, or rotates, the body of the towcraft in the direction of the turn. For example, when attempting to make a turn to the right, a towcraft with excessive rudder area to the rear of its pivot shaft will swing its hull to the right, even if the towline's line-of-force is exactly aligned with the rudder pivot shaft.

Also, a balanced rudder permits a minimal amount of steering effort which needs to be applied by the rider to a handlebar. By having approximately equal areas on both the front and rear portions of the rudder pivot shaft (symmetrically-shaped rudders), the torque effect of water striking both surfaces is also balanced. This enables small steering forces to easily control the much greater force the water exerts on the rudder. However, since fins are additionally recommended and preferred, the balanced rudder requirement may be relaxed somewhat when used with these devices. This is desirable from the standpoint that it reduces rudder sensitivity. Though, the rudder's front/rear area ratio (assuming symmetrical construction) should not be less than about 30/70 when one or more slew-stabilizing fins are installed. Otherwise, steering effort increases dramatically and acts on the body of the towcraft in such a way that it introduces a reaction force which "fights" the fins and negatively affects towcraft handling and limits its obtainable SOA, in much the same way a simple towline attachment point forward of the rudder's pivot axis behaves. Conversely, the rudder's front/rear areal bias should not be appreciably greater than 50/50. Otherwise, steering becomes overly sensitive.

A distinction is made concerning the terminology of rudders and fins. A rudder, in the context of this invention disclosure, as it applies to the present invention, refers to a discrete, pivot-able (vertical pivot axis), primary water-engaging device for the purpose of controlling the steering and the tracking of towcraft. Whereas, fins are primarily used to control or improve towcraft handle-ability (prevent yawing, for example). However, in some alternative embodiment designs, fins are used in the absence of pivot-able rudders. These over-sized fins typically share a rudder's larger draft and greater sidewall area, and, essentially function similarly to rudders as primary water-engaging devices except that they are non-pivoting. In still other alternative embodiments, non-primary (secondary) water-engaging, spaced-apart, minimally pivoting fins (fin—fin toe-out controlled) are used to assist in towcraft rotation (steering) by developing a differential drag between the left and right side; while, primary water-engaging duty is reserved for an oversized ventral fin.

Further towcraft rudder requirements are that it have sufficient total area and draft. As any skier will attest, skis must be tilted sideways at a steep angle when maneuvering far to one side of a boat. As skis are increasingly inclined to one side in the water, greater water-engaging area is presented to the water to prevent the wakeboard or ski from slipping sideways. In like manner, in order to negotiate a towcraft far to one side of a boat, the water-engaging area, in this case a forward rudder, must be of a sufficient areal size to divert (laterally accelerate) a requisite amount of water necessary to compensate for the considerable lateral pull of the towline on the towcraft, when at high OAs relative to the boat. During a turn, the towcraft of the present invention may be leaned in the same natural and intuitive manner as riding a bicycle. Because of the towcraft's width, the rudder, during a turn, or when crossing a wake, may be partially raised out of the water. Therefore, in order to maintain a relatively constant degree of engaged sidewall area with the water, during non-jump maneuvers, it has been found that the rudder must have a sufficient amount of draft. Because of the several demands placed upon the rudder: balanced design, total sidewall area, constant force despite a varying draft, it has been found that the best design is one which incorporates a larger primary (submerged) rudder surface which transitions to a narrower "neck" spanning the rudder's average waterline. The neck, in turn, is connected to the rudder pivot shaft.

Proper application of towcraft leaning by the rider has been found to be beneficial in terms of maintaining engagement of the rudder with the water. When turning and leaning to the right, for example, the rudder, also is tilted to the right, and is made to dig or "plow" its way through the water. This is advantageous in that the rudder does not tend to pull or "hop" out of the water, thereby easily maintaining its offset position relative to the boat in all types of water conditions. In one embodiment of the present invention, the smooth lower surface of a closed-in rigid, or semi-rigid (semi-flexible), bottom shell is made slightly concave. When in calm water (outside of the wake), this shape creates a suction between the bottom of the craft and the water, which is manifested only when the towcraft attempts to lift from the water. It is similar to the down-force acting on a race car, but without its drawbacks. The drag from down-force acting on a race car is always present at speed, whereas the towcraft does not experience a significant amount of drag at any time due to the suctioning down-force effect. The advantage of the concave surface is that by keeping the towcraft absolutely level and in intimate contact with the water, it permits maximum water-engagement presentation of the rudder and fins to the water, thereby enabling a means of achieving even greater SOAs relative to the boat's direction of travel by preventing "rudder hop". Advantageously, when performing a "wake jump", the suction between the bottom of the towcraft and the water does not impede its ability to leave the water. In fact, a "wake jump" is very similar to one way a suction cup is removed from a smooth surface; that is, by simply sliding it off of an edge.

The forward rudder, in developing the requisite lateral thrust (reaction force of accelerating diverted water laterally) to maneuver the HMT in a moving arc as defined by the sweep of the towline behind and to the sides of the boat, must also overcome the parasitic drag of the water acting against the body of the towcraft as it is towed through the water. The force vector for parasitic drag is opposite to the towcraft's direction of travel. When a towcraft is being towed at a constant speed directly behind a boat, the towline tension acting on the front of the towcraft is equal and opposite to parasitic drag. Hence, the towcraft neither speeds up nor slows down, but maintains a constant distance from the boat. It is obvious that for towcraft which experiences more drag, the towline tension will likewise be greater. It should also be obvious that a greater lateral force will be required to move a towcraft to one side of the boat if that towcraft has a higher drag value than an otherwise identical one which has a lower drag value.

In order to clarify the capabilities of differing types of towcraft it is helpful to define the descriptive terms used herein. Towcraft angle, or angle of attack, is the angle the towcraft's principal longitudinal axis, or centerline, makes with its direction of travel. Towcraft offset angle (OA) is the term used to describe the angle the towline makes with the boat's direction of travel, which is typically taken in this context to be a straight line.

Additionally, for the purpose of this invention disclosure, three measures of a towcraft's maneuverability have been devised. The first measure is for a towcraft, which by means of building lateral speed, is able to achieve a certain maximum, or absolute, offset angle (MOA) of the towcraft with respect to the power boat while the boat is traveling in a straight line. Under this condition, the MOA cannot be maintained except for an instant. The second measure is a sustained offset angle (SOA) of the towcraft, again while the power boat is traveling in a straight line. The third measure of a towcraft's maneuverability is its ability to be able to maintain its position despite the maneuvering of the power boat or other powered towing craft. Inspection of the relationship between OA, lateral force, drag, and towline tension, as listed in the following statements, will reveal that by increasing the OA from 5 DEG to 45 DEG yields a>11.5-fold increase in lateral force; while, increasing the OA from 0 DEG to 60 DEG yields a>2-fold increase in towline tension. The actual multiplying factors are, in reality, greater than this due to the hydrodynamic drag associated with the rudder when the towcraft is at OA5 approaching 45 DEG and higher.

The rudder's developed lateral force for all attainable OAs, assuming the towcraft speed is unchanged, varies as the product of the tangent of the offset angle and the algebraic sum of hull parasitic drag and rudder hydrodynamic drag. Restated another way, the vector sum of total drag and the rudder's lateral force at any given towcraft offset angle equals the force vector of towline tension. Restated in yet a third way: Towline Tension=Total Drag÷COS (OA)

Consequently, the rudder's lateral force requirement and developed towline tension increases dramatically at high offset angles. Just increasing the towcraft OA 10 DEG from 60 DEG to 70 DEG increases towline tension by 50%. Therefore, the rudder is properly sized for each towcraft application and that the towcraft hull's "wetted" surface area is designed for the lowest practical drag. An undersized rudder mated to a towcraft body or hull having a comparatively high drag coefficient severely lessens an HMT's maneuverability. In order for an HMT to operate satisfactorily, the rudder's maximum lateral thrust capability (function of total "wetted" sidewall area) should be at least equal to the drag of the "wetted" surface area of the towcraft body (including fin contribution) when operated at nominal planing speeds (18–25 MPH). Depending on the rudder's hydrodynamic efficiency, this translates to a maximum SOA of between 30 DEG and 45 DEG when towed at planing speeds closer to the high end of the towing speed range. In order for a towcraft to be able to maintain its position farther to one side of the boat than this requires an even larger rudder.

Nominally larger rudders are also required for towcraft which are meant to be towed at lower speeds (10–18 MPH). Therefore, the present invention features interchangeable rudders, or optionally, rudders which compensate by flexing as the side load increases. However, it has been found that a simple, non-flexing, style of rudder can be built which enables the towcraft to maneuver outside of the developing wake at low speeds, while allowing excellent control of planing towcraft at OAs exceeding 50 DEG.

In terms of optimizing the synergy between the rudder and towcraft's hull, the "wetted" surface area of the body should exhibit the lowest possible drag when at or above the towcraft's design planing speed; thereby, enabling the use of the smallest effective rudder for a given design target SOA.

In addition to low drag forces, the body of the towcraft must also have the greatest percentage of its total drag acting on its wetted surface area aft of the rudder pivot station. High drag forces forward of this line can have a destabilizing effect on the maneuverability of the craft since drag attempts to force that portion in a trailing relationship. Too much hull area forward of the rudder, therefore, could cause the towcraft to want to "swap ends".

Tipping moments exerted on the rudder must also be addressed. These arise due to the tension load of the towline acting at a point above the waterline while the rudder's below-waterline centrum experiences the lateral and longitudinal thrust loads of the water acting against the side of the rudder. As a result, the rudder is continually being forced to tip one way or the other from its predominantly vertical at-rest orientation. In order to resist the imposed lateral tipping moment, the rider compensates by leaning to one side of the craft such that the rudder is held upright in the water, or at times, at a desirable inclined angle. Consequently, a racking, or twisting, force is exerted on the towcraft's body and the rudder mount. Since tipping moments can become appreciable when a towcraft constructed according to the present invention is at some distance to one side of the power boat, the body of the towcraft is substantially built in order to accommodate the anticipated loads. Therefore, the rudder mount is integral with, or firmly attached to, the front of the towcraft.

Additionally, a structural partial hull, shell, or partial frame (sub-frame), should be provided which minimizes flexing, or racking, of the rudder shaft mounting from its perpendicular position relative to the principal plane of the towcraft. Further, the frame or hull may be made rigid, or semi-rigid (semi-flexible). In terms of its overall size, a partial hull or frame, should extend preferably, at least half the length of the towcraft, and occupy preferably the full width of the towcraft; thereby allowing the rudder tipping forces and rider reaction forces to be distributed over a larger area of the craft. So, while the rudder, in a first embodiment of the present invention, is primarily responsible for steering and tracking functions, the hull on the other hand, makes important contributions by providing flotation means and for maintaining the rudder in a predominantly upright position.

While a towcraft of the present invention may be constructed according to numerous different styles, such as simulating the appearance of a personal water craft or a boat, or the basic inner tube, wedge, and horseshoe shapes, certain construction tenets, beyond the aforementioned design principles, should be followed. In addition to the disclosed rudder design and placement, towline attachment details, and low drag characteristics, the body of the towcraft should be kept light and stiff. A partial hull or sub-frame satisfies this requirement. Buoyancy may be provided within the towcraft's hull or framework itself, or, may be provided by separate air chambers or foam flotation means.

Heavy towcraft weights can contribute to driving up manufacturing costs. Also, a heavier towcraft weight makes it more difficult to be carried by one or two people. Another drawback is that a heavy towcraft will have a lower useful load than a comparable but lighter craft having the same displacement. Additionally, the horsepower requirements of the power boat or jet ski will be higher for heavier towcraft. Finally, a heavier towcraft increases the likelihood the towcraft will need to be trailered as opposed to being transported in or on the top a vehicle.

A stiff construction is generally favored over a relatively flexible one. Excessively flexible constructions can impart or allow undesirable twisting or flexing of the towcraft in response to the aforementioned tipping moments. While a minor amount of bending and torsional flexing is tolerable, excessive flexing, or maximum angular displacements of the rudder beyond about 10 DEG from static or at-rest conditions, with respect to rest of the craft, can result in imprecise handling, poor directional stability, and a delayed input-output steering response. Towcraft designed for use by children below a certain weight limit, and, placarded with a never-to-exceed maximum speed limit, may be constructed lighter and more flexible than ones designed for adult use at higher speeds.

Suitable materials of construction for the structural load bearing members of the towcraft include: thermoplastics, thermoset plastics, aluminum, wood, fiber reinforced plastic composites (thermoplastic or thermoset resins), or combinations thereof. A common construction technique which yields lightweight and yet strong structures is to encapsulate a foam core with a compatible fabric reinforced thermoset resin. If the plastic is not internally reinforced with fibers, the plastic may be made suitably strong by molding in ribs. Tertiary buoyancy, or integral flotation, in the absence of primary or secondary buoyancy, may be provided in the form of a foam core or by means of sealed air chambers between reinforcing ribs.

Several different constructions of practicing the various embodiments of the present invention are disclosed. This is not to infer that one style of an HMT is necessarily superior to another, but that there are number of possible constructions whereby the present invention may be built. For example, certain constructions are very low in cost to produce, while other higher cost constructions will result in a more highly maneuverable towcraft. Some constructions allow multiple riders, while others allow only one. As mentioned previously, another style of HMT even permits one or more riders to stand or kneel.

One minimalist approach of the first embodiment of the present invention is to construct a thin, relatively stiff, abbreviated/half-frame which conforms to and approximates the front and a portion of the lower toroidal surface area of an inflated tube. The frame may constitute a continuous surface or one with a number of lightening openings therein. The frame should include at least a front curved section and two spaced-apart, horizontally disposed legs, one on each side, which represents rearward extensions of the front section's lower edge. Attached either permanently, or temporarily by screws, a steering/rudder mount is affixed in the middle of the forward curved section. Each rearward-extending leg member terminates in a slightly dished shape with rounded ends. Spaced-apart fins are permanently, or temporarily, attached to the underside of each leg. Because of the abbreviated frame construction used for this embodiment, the two spaced-apart fins extend back further than what would normally be used in other embodiments, in order to minimize yaw motions.

In this embodiment, primary buoyancy, or flotation, is provided by means of a replaceable inflatable toroid-shaped tube, often referred to as an inner tube. Secondary, or emergency, flotation may be provided by means of another air chamber located within the primary chamber or tube, or, the attachment of a low density closed cell foam thus rendering the craft effectively unsinkable, even when swamped. It should be noted that the term "flotation" can have one of two meanings when applied to water-sport equipment which is meant to be towed in the water. When applied to skis, flotation relates to the ability for the device to keep itself afloat when at rest in the water. Whereas, when applied to conventional towcraft, and this embodiment of the present invention, flotation relates to the ability for the towcraft, to not only keep itself afloat at rest, but also, the rider(s). However, secondary, or emergency, flotation may only be sufficient to prevent the craft from sinking.

A water repellent fabric cover is provided which may be either affixed to the frame at its edges, or, entirely enclose it. In the latter embodiment, openings are provided in the cover to accommodate the fin and steering/rudder mount fasteners, and, for the insertion of a deflated tube. The cover may either fully or partially enclose the exposed upper half of the inflated inner tube. If the fabric cover does not completely enclose the tube, then buckle or Velcro® closure straps, the lower ends of which are connected to the frame, shell, or hull of the craft and the upper ends of which are connected to the fabric cover, may additionally be used to retain the tube in place. Covers which feature re-closeable openings for the insertion of an inner tube may include zippered, laced, screwed, or snapped closure means. In all cases the floor of the towcraft is preferably covered. In this embodiment, the floor is covered by and composed of the same fabric as the balance of the cover. The inner tube, once inserted into the cover, may be subsequently inflated-in-place. If a cover is used which only attaches to the edges of the partial hull, or frame, then the frame should not include any holes therethrough, otherwise, the action of the water directed against the holes tends to push the inflated tube away from the frame. Also, depending on the size and location of the holes, they can significantly increase parasitic drag of the water against the half-frame.

The rudder/steering shaft and the attached rudder is installed into its mount. It is retained in place by means of the handlebar which is pinned to the end opposite of the rudder. Washers, stops, and a spring return-to-center (self-centering) means are also provided as part of the rudder/mount assembly. The washers take-up the vertical clearance. The stops prevent excessive rudder/steering angle displacements. And, a self-centering spring is provided which biases the handlebar and rudder to straight-ahead operations. Self-centering steering allows riderless towing of HMT at low towing speeds. Additionally, self-centering steering by means of a spring provides proportional feedback of steering resistance to the rider which is advantageous. Due to the balanced rudder design and the fact that only small steering inputs (angular displacements) are required, steering forces without spring centering can be interpreted as being almost too low and too sensitive. Therefore, an increase in steering effort which is proportional to the handlebar angular displacement communicates to the rider the handlebar position relative to the straight-ahead orientation. This is helpful when riding in rough water and when making aggressive turning maneuvers.

The spaced-apart leg members in certain embodiments serve two purposes. Besides the distribution of force between the rider's leaning and the rudder and steering forces on the front, the spaced-apart legs also provide a firm attachment point for mounting fins.

Instead of a fabric covered frame and inflated tube, another approach to the first embodiment of the present invention consists of a smooth-surfaced, rigid or semi-rigid, continuous lower half-shell which slopes down on the sides from the front of the towcraft to its rear, and, an attached fabric cover which encloses the upper and rear portions of the inflated tube. Similar to the half-frame, the rigid front and lower half-shell and fabric upper may also be constructed such that it conforms to and approximates the general shape of a toroidal tube except it has a solid bottom. A smooth-surfaced lower shell is advantageous in that it can be made with minimal drag characteristics relative to a fabric covered tube and frame style of towcraft. To ensure minimal drag characteristics at the rear extant of a lower continuous shell, a sharp break from horizontal to vertical is provided in order to not be adversely impacted by a Coanda Effect which can prevent a smooth transition to a planing configuration as the HMT is brought up to its design towing speed.

The fabric upper is fitted to the peripheral edge of the shell and is configured such that it conforms to the upper and rear portions of an inflatable toroidal tube while the shell conforms to the front and lower portions of an inflatable toroidal tube. The reason this and other embodiments are configured in this manner is due to the need for a prone rider to be provided with an adequately cushioned surface at the rear of the craft. Also, it minimizes the weight of the heavier shell in comparison to the lightweight fabric upper. A deflated, or partially deflated, toroidal tube is inserted through an opening in the fabric upper and fully inflated. By having the opening in the fabric upper smaller than the outside diameter of the tube, the tube is easily held in place. Though, straps may also be used to additionally retain the inflated tube in place. Further, a cover (separate or integral with fabric upper) may be used to close-off the central area of the tube from access above. Whenever the central area of a tube is closed-off, top and bottom, the upper central cover should be sufficiently porous, have an easily opened flap, or is equipped with drain holes, whereby the towcraft may be inverted and any collected water quickly drained, even while the towcraft is floating in the water. Care must be taken in the construction of the towcraft such that no pinch points are accessible to its occupants. For example, the use of straps to span the central opening of a tube should be avoided. The use of straps should be restricted to ones which are tightened against the inflated tube, or, be covered such that an arm or leg could not get caught.

Like the half-frame approach, the rigid, or semi-rigid, shell construction provides a desirable surface for rigidly mounting one or more narrow, low-drag, fins. Because the bottom area is closed-in, a single ventral fin may be used. Preferably, two pairs of spaced-apart fins are used. Where two pairs of laterally spaced-apart fins are used, the forward pair is preferably mid-mounted along the towcraft's designated longitudinal axis while the second pair is mounted at the rear extent of the towcraft's bottom surface. By having one pair of fins in front of the other pair, a rapid yawing motion is damped. However, in instances where extreme maneuverability is desired, only one set of mid-mounted spaced-apart fins may be used. Though, larger riders may elect to only use rear mounted fins since their additional weight causes the HMT's center of gravity to be shifted to the rear; at which point a greater towcraft slewing tendency must be controlled when performing rapid turning maneuvers.

While the previous two examples described an inflated tube approach, the present invention works equally well with permanently fixed-in-place or removable closed-cell foam flotation and cushioning means. While the inflated tube approach does have in its favor a lighter weight and a smaller collapsed volume relative to a comparably sized closed-cell foam flotation and cushioning means, foam cushioning at most only experiences a gradual loss of buoyancy over time. Also, foam cushioning can be made with greater shock absorber properties in a smaller volume, thereby leading to a lower required thickness profile for a given rider weight.

There are several additional construction details which improve the maneuverability or increases the utility of the first embodiment of the present invention. Namely, these include the use of: a rear planing surface feature on rigid-hulled towcraft, a forward inclined plane, fins, rudder limit stops, a spring-centered rudder, and optionally, spaced-apart, mid-plane hydrofoils.

A rear plane device or equivalent characteristic hull shape is generally required for any rigid hulled watercraft in which the rigid hull terminates at the rear-most part of the craft. Such a planing shape consists of a relatively sharp break from horizontal at the rear-most location of the craft's bottom surface. The purpose is to prevent the development of the Coanda Effect. Coanda Effect is characterized by a laminar flow which adheres to a smooth, curved, surface. This flow causes the rear of the watercraft to be "stuck" to the water which dramatically increases its drag, impairs its maneuverability, and can prevent the watercraft from planing. Normally, the Coanda Effect is not a factor in turbulent (non-laminar) flow conditions common to fabric covered tubes. However, for watercraft having smooth, full length, low drag, bottom surfaces, it is imperative that some form of sharp break be provided along its bottom, trailing edge so that the water separates cleanly from that surface. The present invention provides for a sharp break by extending the flat planar bottom surface beyond the inflection or tangent point, where the flat bottom intersects the upwardly curved back, by a small distance. Elimination of the Coanda Effect provides for very low drag values which permits lower towcraft planing speeds and lower powered watercraft horsepower requirements.

In order to prevent the front of the towcraft from penetrating a wave and becoming swamped, such as encountering a wake, and, to improve the ride of the towcraft in rough water, it is recommended a fixed, or adjustable, and/or flexing forward inclined plane be mounted just above the rudder, and just below the towline attachment point. In certain embodiments, the lower, rear, portion of the forward plane is made narrower than the front, upper, portion. This handily provides a progressive lifting force which tends to damp any oscillations of the front of the towcraft and smoothes the ride in choppy waters. Also, it reduces drag to a minimum when the craft is at planing speed. In effect, it functions similarly to the deep-V hull design commonly employed in boat construction. The forward inclined plane is also beneficial in that it keeps the front of the towcraft up during low speed operations, especially during those times the craft is towed when no one is on board. Further, a forward inclined plane helps to deflect spray laterally that might otherwise be a distraction to the rider(s).

The use of one or more narrow fins permanently, adjustably, or removably attached to the underside of the present invention greatly enhances the maneuverability of rigid-hulled towcraft at speed in the water. Preferably, the use of two downward-projecting, flexing fins, one on each side of the craft, at the opposing points where the bottom is the widest, provides a number of benefits. For the purpose of this invention disclosure, it is to be assumed that all fins mounted on the underside of the preferred embodiment of the present invention are to be aligned parallel with each other and the designated centerline of the towcraft, unless an alternative orientation is specifically described.

A first benefit of the fins, by engaging the water, is the inhibition of any large scale side—side slewing, yawing, or swinging of the towcraft in the water. A steerable towcraft of the present invention with a featureless lower shell, at the conclusion of a rapid turning maneuver, can be made to swing around nearly sideways to the direction of travel. Second, the fins also assist the rudder in helping it to track in the desired direction of travel. When a rapid steering maneuver is initiated, the towcraft momentarily pivots about the rudder pivot axis. Until the towcraft's lateral velocity is zero, the towcraft body is aligned at some angle to the oncoming water. As long as the body of the towcraft and its fins are not exactly in-line with the oncoming water, the water striking the sides of the fins create a "push" which is in the same direction of travel as the rudder. This "push" assists the rudder by providing more available water engagement side area by which the towcraft is laterally moved side-to-side. In this configuration, the rudder and towcraft body are tracking along parallel paths. When the lateral thrust produced by the rudder and fins are exactly balanced by the towline's opposed force, lateral motion stops, and the towcraft proceeds in a straight-ahead manner (provided the boat is traveling in a straight line). Once the lateral motion is stopped, oncoming water still pushing against the sides of the fins causes the towcraft body's to rotate back to a more proximate trailing relationship, relative to the rudder pivot axis. In this regard, the "castering" action of the towcraft is slightly different from that of a wheeled vehicle in which the front wheel is steerable and the rear wheel(s) merely follow. In steering a car, for example, the front wheels travel in a larger arc than the rear wheels when negotiating a turn. In a true non-skid castering action the front initiates and concludes the steering motion. Whereas, in the present invention, the front of the towcraft initiates the steering motion, but the rear of the towcraft concludes it.

"Fin push" can also be controlled to a certain extent by rider leaning or a lateral shifting of his or her weight on the towcraft. When a rider's weight is shifted to one side of the towcraft, that side of the towcraft is pushed deeper in the water and experiences a greater parasitic drag than the opposite side by virtue of a greater water contact surface area of the hull. The towcraft, in response to this unbalanced drag on the one side, pivots about the rudder pivot axis such that the side with the higher drag is in a more trailing relationship relative to the rudder's direction of travel. This, in turn, causes the fins to be angled with respect to the flow of the water, which, provides "fin push". "Fin push" can be used to either accelerate a turning maneuver or to increase the towcraft's SOA. At maximum SOAs, when applying the leaning and "fin push" technique, the body of the towcraft never fully attains a perfectly balanced trailing relationship relative to the rudder pivot axis because all available rudder and fin area is used to counteract the considerable lateral pull of the towline at high offset angles. Rear-mounted fins are less effective than mid-mounted fins when it comes to "fin push". This is most likely due to the fact that the former is already in a trailing relationship. On the other hand, riders who desire a more subdued and yet highly controllable ride, may elect to only mount rear fins which do not provide as much "fin push". Rear-mounted fins (exclusively) are also less sensitive to weight shifting by the rider.

It should be noted that, in the context of this invention disclosure, leaning by the rider of a towcraft is exercised for one of two reasons. In the first instance, intentional leaning by the rider is for the purpose of maintaining the towcraft in an upright attitude when the towcraft is offset to one side of the boat. In a second instance, rider leaning is performed for the purpose of assisting in the primary steering of the towcraft by functioning as a steering input.

Another advantage to having laterally spaced-apart mid-mounted fins is during times of aggressive maneuvering, particularly when the rider's weight is inadvertently shifted to the extreme edge of the craft. Without mid-mounted, spaced-apart, fins, under such an extremely unbalanced condition, there exists a phenomenon in which the towcraft rolls up on the edge of its overloaded side just prior to capsizing. Though, with mid-mounted, spaced-apart, fins this phenomenon does not occur nearly as readily. Not to be bound by any particular theory, it is speculated that when the bottom of the towcraft is inclined beyond a certain angle, the fin buried in the water begins to function as an inclined plane with the result that it begins to provide additional lift on that side of the towcraft; thereby preventing the craft from continuing to overturn. This "inclined" plane augments the reduced buoyancy of the tilted craft thereby adding lift to the low side, or at least preventing further inclination of the body of the towcraft and providing the rider with the opportunity to make the necessary weight shift back toward the center. It is observed that mid-mounted fins block the angular flow of water across the bottom of the towcraft during rapid turning maneuvers. If a towcraft does not have spaced-apart, mid-mounted, fins and is made to slew partially sideways in the water, the Coanda Effect of the water passing under and up the smoothly curved side of a rigid hulled towcraft can have the same effect as a towcraft without a rear planing surface in that the downstream side of the towcraft is buried progressively deeper in the water. It has also been discovered that simply having laterally spaced-apart mid-fins is insufficient. For example, if there is too large of a gap between the top trailing edge of the fin and the underneath side of the hull, lateral water passing through that gap (during an aggressive turning maneuver) can render fins of this design ineffectual in regard to this phenomenon. Therefore, it is preferable to maintain as narrow of a gap as possible between the body of the fin and the underside of the hull where the two are approximately adjacent to one another.

Smooth-hulled HMT designs with a forward pivoting rudder which only use a mid-mounted ventral fin, or laterally spaced-apart mid-fins with large gaps, should have low profile strakes or other repetitive turbulence-generating or water re-directing surface feature which disrupts the formation of any angular laminar flow at the aforementioned locations. Smooth-hulled forward-pivoting-rudder HMT designs which include one or more rear-most mounted fins are not as susceptible to this phenomenon since appreciable lateral flow cannot be established; and thus, do not require the turbulence generators.

Another benefit offered by mid-mounted, laterally spaced-apart fins, within the context of the present invention, are that they perform similar to the rudder in terms of "digging" into the water when the towcraft is leaned to the apparent inside of a turn. Though, this is primarily only a benefit for towcraft intended to be operated by a single rider unless multiple riders on larger steerable towcraft can be made to cooperatively shift their weight.

As can be seen, spaced-apart fins provide neutral directional stability, yaw rate control, positive yaw stability, and advantageous weight shifting by rider when desired.

This not to suggest that a steerable towcraft of the present invention only works with spaced apart fins. Rather, the foregoing discussion is meant to describe a preferred embodiment. One or more fins which lie along the craft's centerline also can be made to work, though, without some of the benefits derived by the spaced-apart design.

Another feature and one preferred embodiment of the fins, and optionally the rudder, is that the fins flex sideways in response to increasing hydrodynamic side loads. One object of the present invention is to provide a steerable towcraft with the minimal number of adjustments or parts that will handle a wide range of rider weights and towing speeds. Children riding on towcraft being pulled at slow speeds will necessitate different maneuvering or towcraft handling requirements than would adults who are pulled at higher speeds. Similarly, adults who might wish to engage in a competition-level type of towcraft sport activity would require yet a different level of maneuverability than the occasional, recreational, adult rider.

High side-loading of the fins occur during rapid direction changes. These side loads increase with the towcraft's speed in the water. Therefore, at higher towcraft speeds, the side load on the fins will be considerably greater than at lower speeds, at a given offset angle. Larger fins designed to function satisfactorily at low speeds, are over-designed for higher speed operations. Excessive fin area at higher towing speeds results in an overly sensitive response.

One way around this issue is to have replaceable fins of different sizes for differing water operations. Another solution is to have rigid fins which can be raised or lowered by pivoting the fin about a forward pivot point. The trailing end could be raised up into or down out of a recess or pocket in the bottom of the craft. This can be easily performed either by direct adjustment of the fin itself, or remotely, by manipulating a lever on the handlebar or a twist of the hand grip. Remote actuation whereby the fin is pivoted up or down may be accomplished by means of one or more actuator cable-casing assemblies which run from the handlebar or tiller to the fins.

However, one preferred embodiment is to incorporate a flexible portion in the aft part of the fin which is not attached to the underside of the hull. In other words, the fin is not rigidly attached to the hull along its full length. The forward rigid half, or third, of the rigid-flexible fin is firmly attached to the underside of the hull by permanent, or preferably, by temporary screw-fastener means. The trailing portion of the fin, by virtue its transition from the rigid forward mount, is able to flex sideways. At low towing speeds, when more fin area is needed, the fin remains straight and all of the fin area is utilized. When being towed at higher speeds, a smaller fin area is needed. At high angles of attack, the fin flexes sideways in response to the higher side loads thereby diminishing its total side area presented to the oncoming water. This method automatically compensates for variable towing speeds. Some adjustment in the flexural strength of the fin may be afforded by means of thin plates, one or more on each side of the fin, which may be adjusted fore or aft in order to alter the flex characteristics of the fin's trailing edge.

A change in the fins' flexural strength can help fine-tune the towcraft's maneuverability characteristics according to rider preference.

Besides flexing sideways, it is preferable for the aft portion of the two mid-mounted fins to flex such that its camber, or inclination, is varied as well. By allowing the upper portion of each mid-mounted fin to flex, bend, or become inclined away from the approaching water, the lower, more rigid, portion of the fin is made to dig, plow, or otherwise increase its engagement with the water; thereby reducing a side-slip of the towcraft body in the water. One embodiment which provides the desired dual flexing motions is a lamination of three thin fiberglass reinforced plastic (FRP) plates epoxy-bonded together at their forward sections. The middle plate does not extend the full length of the two outer plates. The outer two plates determines the overall shape and profile of the fin when viewed from the side. The middle plate is terminated in a 45DEG angle approximately halfway back from the plates' common leading edge. The bottom, rear-most, edge of the middle plate slopes upward and forward at approximately a 45DEG angle to where the aft portion of the middle fin attaches to the hull. Each outer plate is then bonded, or otherwise joined, to the sides of the middle plate.

A further optional feature of the present invention is the addition of slightly inclined (in direction of travel), short, horizontal planes which are mounted to and project from the sides of the mid-mounted, spaced-apart, fins. In like manner to adjustable or flexible fin and front plane surfaces, the horizontal mid-planes may be manually adjustable (pivot vertically about a forward horizontal axis), flexible, removable, or rigidly fixed to the sides of the fins. Mid-mounted horizontal planes which are slightly inclined in the direction of water flow provides additional lift which enables the bottom surface of the present invention, to be fully clear of the surface of the water when the craft is operated at or above a minimum planing speed. During towing operations at or above a minimum planing speed, towline tension applied to the front of the towcraft, in a generally horizontal attitude, causes the towcraft to ride on three points: the lower rear portion of the front inclined plane, and the two spaced-apart mid-planes. This feature enables the bottom of the towcraft to become completely "unstuck" from the water, resulting in even lower drag values. The short horizontal mid-planes primarily has the effect of providing a smoother towcraft ride by eliminating pounding of the water against the bottom of the craft since the mid-planes can be made to ride a short distance beneath the surface of the water in the manner of a hydrofoil. For optimum towcraft pitch control, the spaced-apart fins and horizontal plane arrangement should be mounted along the line that represents craft's front-rear center of gravity with the rider on board. A forward horizontal plane configuration causes the craft to be permanently rocked backward. Whereas, a rearward mounting makes it difficult to rock the towcraft backward at all. Therefore, it is desirable for mid-fins fitted with horizontal planes to also be made adjustable in terms of their front-to-rear mounting location.

A skilled rider, by quickly rocking back on the towcraft, can make a towcraft equipped with mid-planes to momentarily leap from the water without relying on a wake. This entails that the towcraft have a full length shell construction with a rigid closed-in bottom in order to prevent the rider's weight on the rear of the craft from flexing it downward. Otherwise, a rider lying prone against the aft portion of a towcraft will cause the rear portion of the towcraft to deflect downward until it contacts the water, thereby negating the benefits of the mid-planes.

The horizontal planes may also be mounted to the rear fins. Though, when mounted in this location, the rider still experiences the benefits of a smooth ride, but without the ability to rock backward since lift (fulcrum point) has been shifted to the rear extant of the craft.

As long as towcraft designs satisfy the aforementioned principles, the present invention may assume a wide variety of forms. References to preferred embodiments are not meant to diminish the contributions or beneficial features of alternative embodiments, except, to the extent that the preferred embodiments offers, in the authors' minds, the most enhanced ride experience of the collection of towcraft designs presented herein. The following detailed descriptions of the present invention are not meant to be limiting in their scope, but rather, are examples of how the invention may be practiced.

Reference is made to the following figures in describing the various embodiments of how the towcraft of the present invention may be constructed and practiced.

FIG. 1 depicts a first embodiment of high maneuverability towcraft (HMT-1) of the present invention configured for maximum maneuverability having a rigid/semi-rigid lower shell or hull 1 with integral flotation means (foam core laminate or hollow/sealed compartment construction); coated fabric upper member 2 joined to shell 1 along common border 19; a steering assembly such as a trailing, removable, handlebar 4 (for shorter riders); a primary water-engaging device such as a rudder 5; a rudder mount 7; a tow ring 8; an inclined, tapered, flexing, steerable plane 9; a handlebar-rudder centering helical (torsional) spring 10; rudder stops 11 (one visible); a towline 12; a tow ring/line grommet 13; spaced-apart, fins 14 (one visible); and fixed grips 18 (one visible). It should be noted that the fixed grips may be placed closer to the handlebars in order to make it easier for the rider to grasp during extreme towcraft maneuvering. A rider with one hand on a handlebar grip and the other hand on a fixed grip also assists the rider in making weight shifts as required to keep towcraft level when at high offset angles relative to the boat.

Figure 1A:
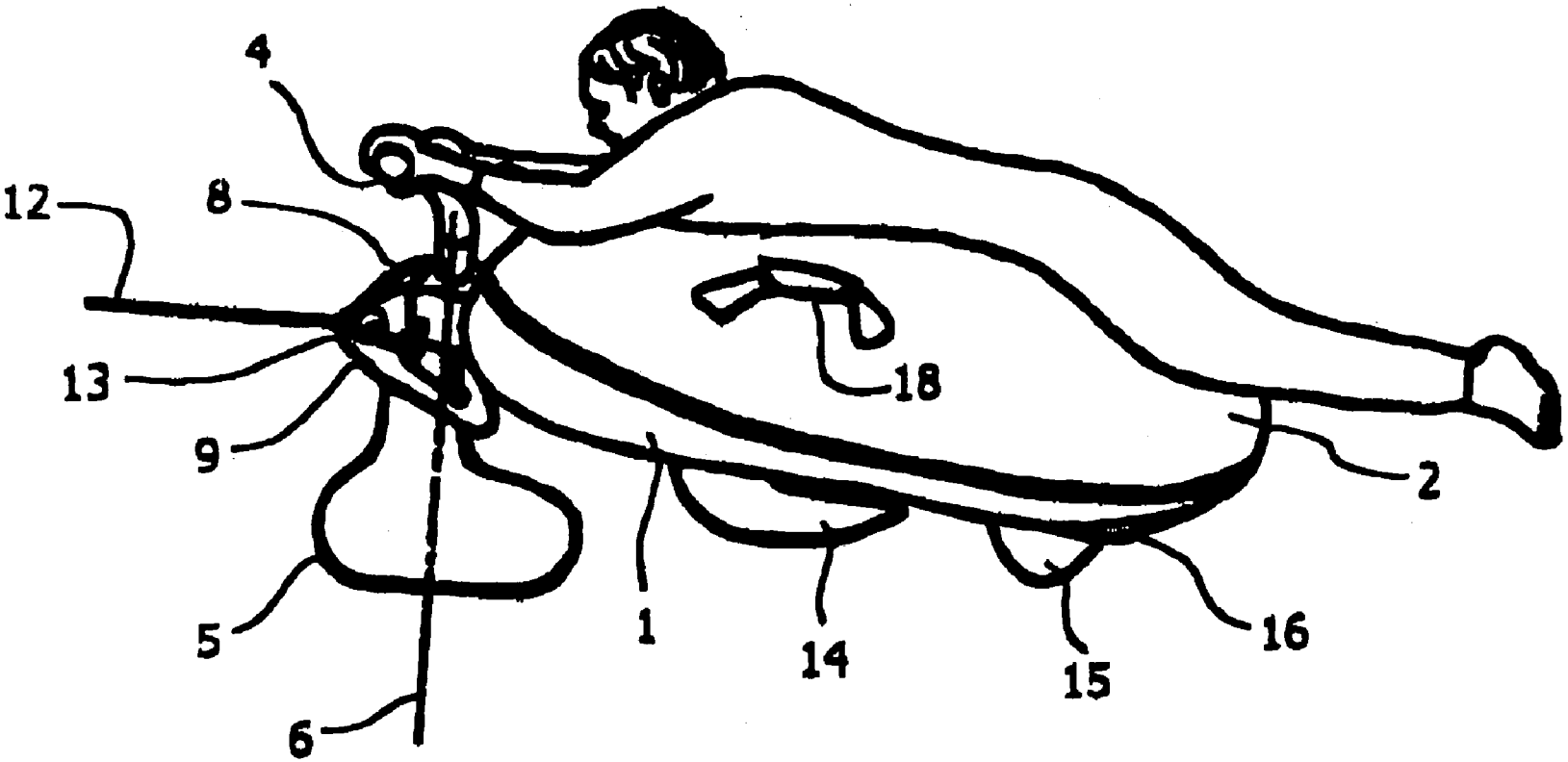
FIG. 1A is a schematic perspective illustration of one embodiment of a high maneuverability towcraft according to the present invention.

It is to be understood, that in certain embodiments, the a primary water-engaging device 5 can include a locking and unlocking means, generally shown as 5A, which allows the primary water-engaging device to be fixed in one position or to be allowed to pivot about the pivot axis 6, which is shown in FIG. 1A. Various types of locking/unlocking means as useful with the present invention.

The smooth bottom surface of shell, or hull, 1 may be flat or slightly concave. A concave bottom surface allows the towcraft to be suctioned to the surface of smooth water typically found outside of the wake, which, helps to keep the towcraft in a level attitude. This advantageously confers on the towcraft the ability to achieve high offset angles without the rider needing to make large weight shifts in order to keep the towcraft predominantly level, or leaned into the turn. Additionally, a level HMT orientation while maneuvering minimizes/eliminates a rolling motion which allows rapid direction changes. This is possible because there is no need, or little need, for the rider to compensate for a minimal rolling motion. The effect of an HMT suctioned to the water is very similar to the dynamics of a race car equipped with down force augmenters.

A forward, steerable, flexing, tapered, inclined plane 9 can be configured such that the inclined plane 9 handily provides lift at nearly all towing speeds and attitudes without imposing a serious weight or volume penalty. Pontoon boats utilize fixed, forward, bow planes to help prevent penetration of the pontoon into waves since the pontoon's shape does not lend itself to lift in the manner of a V-hull, or other conventional boat hull shape. However, forward planes fixedly attached to the hull are unsuitable in close-coupled applications such as the present invention. Inclined planes mounted to the sides of the bow portion of a towcraft can impart an undesirable rolling motion when encountering a wave or boat wake at an oblique angle. The preferred embodiment of the present invention uses a tapered (narrows at the rear), optionally flexible, steerable, forward inclined plane 9 mounted to the rudder 5 in order to provide a smooth ride in a compact arrangement, without the considerable bow displacement typically utilized in boats and PWCs.

The angle of inclination of the steerable, flexing, tapered, inclined plane 9 may be made variable, depending on water conditions and rider weight and height. In certain embodiments, the angle of inclination (from horizontal) is between 20° and 45°. Preferably, inclined plane 9 is inclined 30° from horizontal when the towcraft is at rest in the water without a rider on board. The function of the tapered, flexing, aft portion of the inclined plane 9 is to provide a smooth ride at planing speed in choppy water. When at planing speed, only the rear-most, narrow, flexing portion of the plane is in contact with the water. The progressively smaller area toward the rear of the plane in combination with its flexing feature reduces ride harshness at high towing speeds by (1) decreasing areal contact with the water and (2) by absorbing the instantaneous wave loads, or other momentary loads, from being transferred to the front of the towcraft and affecting its pitch.

The larger forward section of the inclined plane 9 serves as an anti-dive plane when encountering larger waves, wakes, and, during low speed (including riderless towing) operations. As towing speed increases from idle to planing speed, contact of the inclined plane with the water decreases from nearly 100% to typically less than 30%.

A major advantage of the inclined plane 9 of the present invention is that it is directly steerable with rudder 5. This ensures that the inclined plane 9 is advantageously aligned with the rudder's directional orientation, and therefore, does not experience a loss of lift with a change of direction as what would occur if the inclined plane were fixedly attached to the forward section of the hull. Also, by being mounted to the rudder 5, the lift of the inclined plane acts at the middle of the craft's bow; which is preferable over other mounting arrangements.

Figure 2:
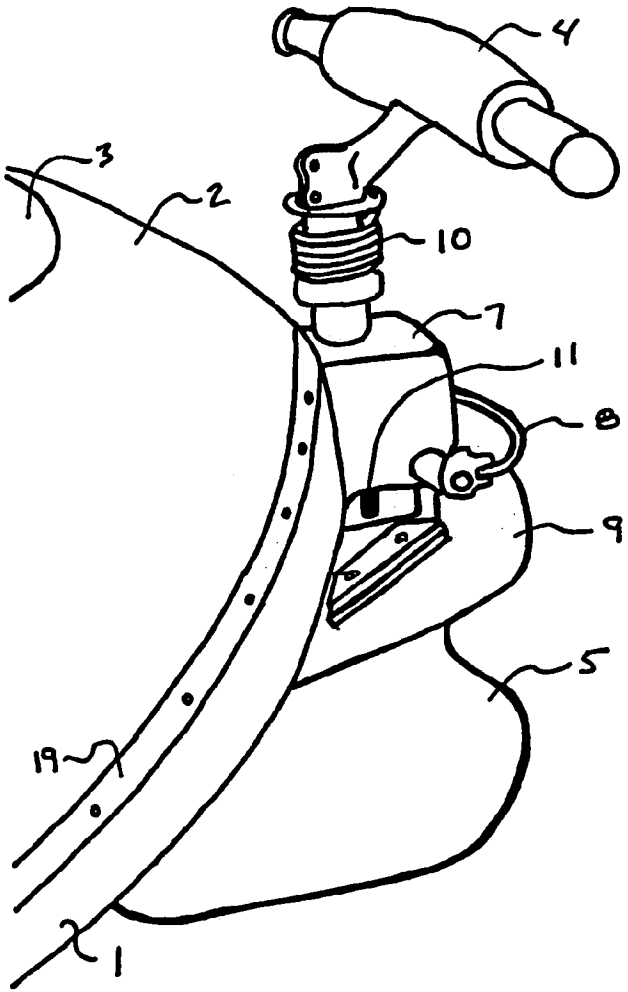
FIG. 2 is a schematic perspective illustration of a part of an embodiment of a high maneuverability towcraft according to the present invention.

FIG. 2 shows a portion of the towcraft where the handlebar 4 is oriented in a leading configuration for taller riders lying on small high maneuverability towcraft.

Figure 3:
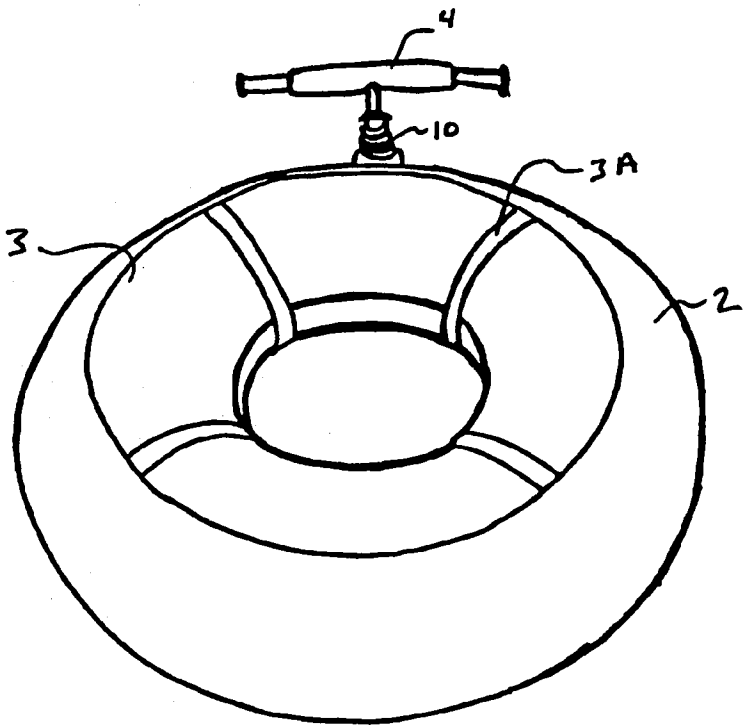
FIG. 3 is a schematic perspective illustration of an embodiment of a high maneuverability towcraft according to the present invention.

FIG. 3 depicts one embodiment where the towcraft is position on a retaining tube 3 and is held in place by means of tube retention straps 3A when the central area of the tube is left uncovered. Deflated tube 3 is placed into cavity formed by lower shell and fabric upper 2. The tube 3 is then inflated in place until tight against the interior walls and floor of the hull 1. The straps 3A may then be threaded through their respective buckles and tightened against the tube. It is to be understood that other tube retention means (not shown in this FIG. 3) are within the contemplated scope of the present invention and may include a smaller top opening in the fabric upper member 2, a completely close-able top, or a zippered cover which is made in the shape of an inflated tube. In regard to the latter example, tube insertion and inflation is accomplished by first separating (as by unzipping) the cover's upper half from its lower half at the circular line which represents the tube's ID. The tube's inflation valve (not shown) is then aligned with the respective opening in the cover. Next, the tube is partially inflated and adjusted as necessary. The upper and lower halves of the cover's ID are then zippered (or laced, Velcro-fastened, or snapped) together. And finally, the tube is then fully inflated.

Figure 4:
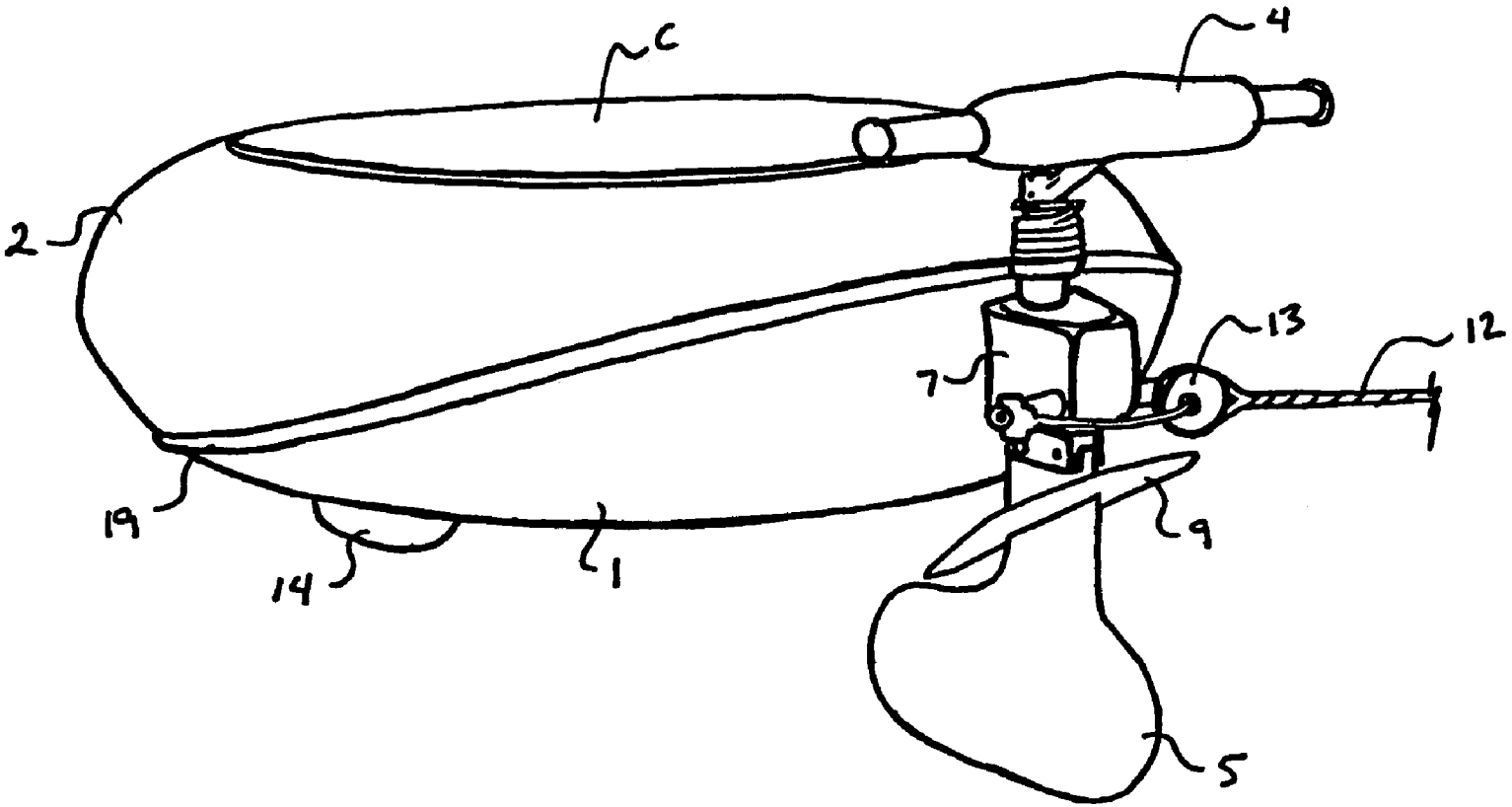
FIG. 4 is a schematic perspective illustration of an embodiment of a high maneuverability towcraft according to the present invention.

FIG. 4 depicts the HMT from an elevated right front quarter position. The towline 12 is shown attached to the tow ring/line grommet 13. The inflated tube 3 is completely closed-in by a fabric cover C. Closure of the cover may be performed by any suitable means such as zipper means, hook-and-loop (Velcro®) snap closure, or by lacing. In certain embodiments, preferably, provision is made for draining any water entering the interior if it is not made completely watertight. This may be done locating a screened opening within the top cover such that water may be easily drained by inverting the towcraft in the water. Alternatively, the cover itself may have a sufficiently "open" weave as to be self-draining when momentarily inverted. It has been amply demonstrated that anyone, except for a small child, can easily invert and subsequently right a towcraft of the present invention while they are in the water, next to the craft.

Figure 5:
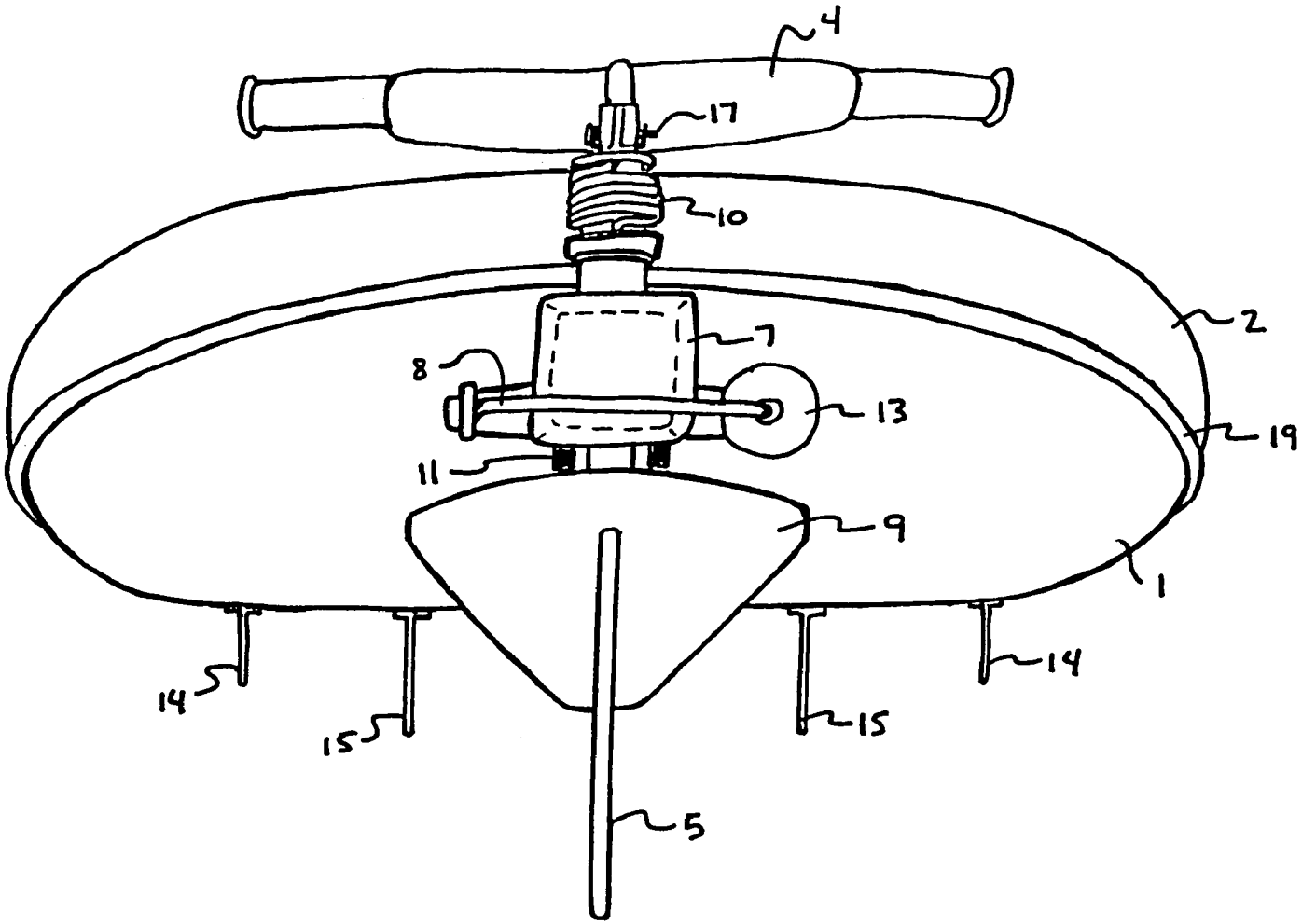
FIG. 5 is a schematic perspective illustration of an embodiment of a high maneuverability towcraft according to the present invention.

FIG. 5 depicts the four spaced-apart fins. The mid-fins 14 are shown spaced farther apart than the rear fins 15. Also, the mid-fins 14 typically have a shallower draft than the rear fins 15. The fins may be adjustable or interchangeable with fins of other sizes or styles, according to rider preference. Typically, the rear fins 15 are essentially non-flexible, while it is desirable for the mid-fins 14 to be more forgiving or flexible. The mid-fins 14 may have drilled holes and/or made flexible in order to lessen their influence somewhat at high planing speeds. A single ventral fin (not shown) may be used in place of the spaced-apart rear fins 15. Though, spaced-apart fins have the advantage of having at least one fin in the water for greater control; except, of course, in those instances when the towcraft is made to leap completely out of the water.

Evident in this view is the tapered shape of the inclined plane 9. Also in view are both rudder stops 11 which preferably are rubber cushioned projections which extend downward from the rudder mount 7, one on each side of the rudder. The rudder stops prevent the rudder from assuming a severe angle with respect to the towcraft's principal axis. In practice, only very small steering inputs, or deviations from the centered position, are required at all attainable offset angles.

Figure 6:
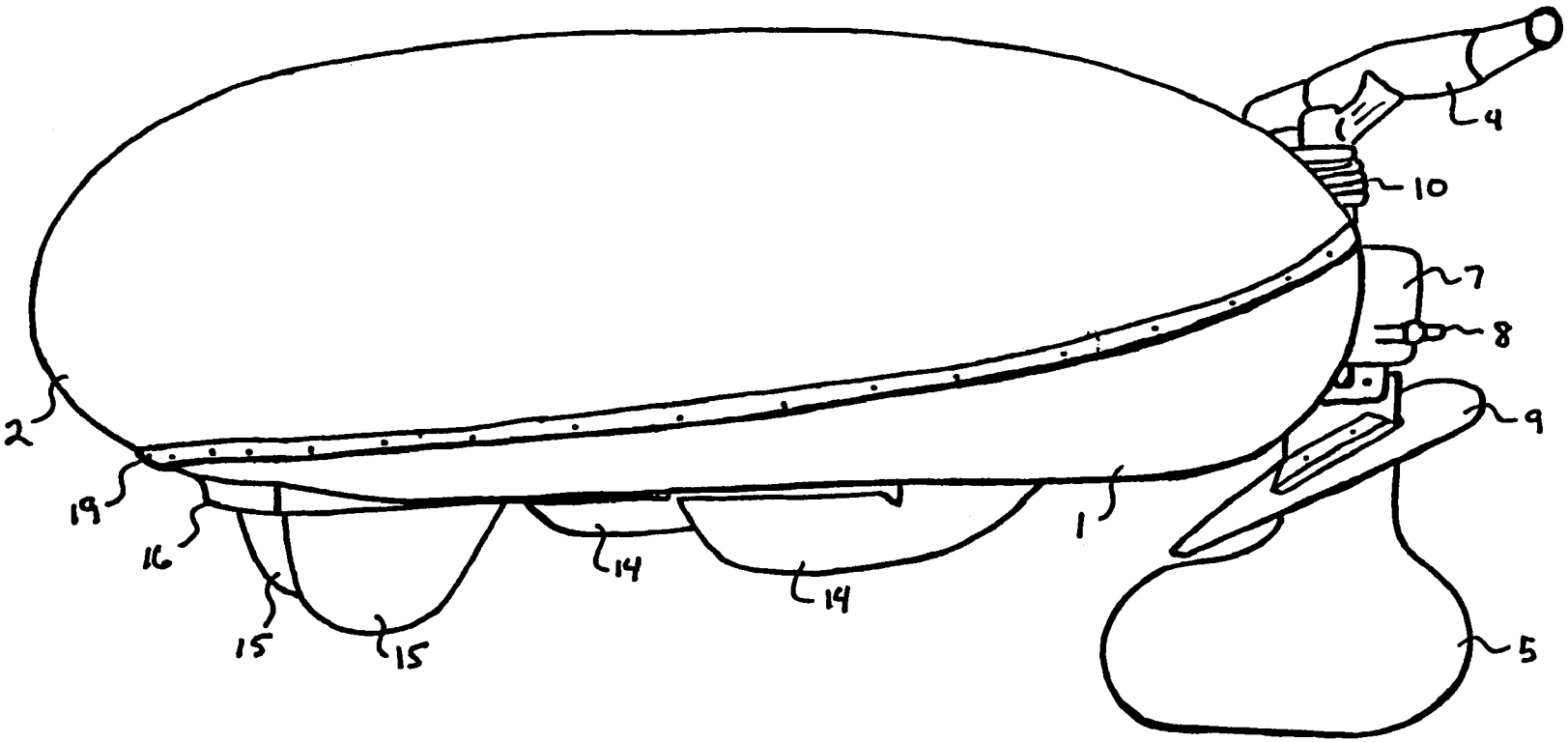
FIG. 6 is a schematic perspective illustration of an embodiment of a high maneuverability towcraft according to the present invention.

FIG. 6 depicts the right side where mid-fins 14 are shown to be of the preferably flexible type in which the trailing portion flexes at least sideways in response to an increase in load from water striking it at increasingly higher angles-of-attack at increasingly higher speeds.

In certain embodiments, in order to prevent the formation of laminar Coanda Flow along a smooth curved surface, an integral sharp break 16 has been provided at the rear of the full (length) bottom hull 1.

Figure 7:
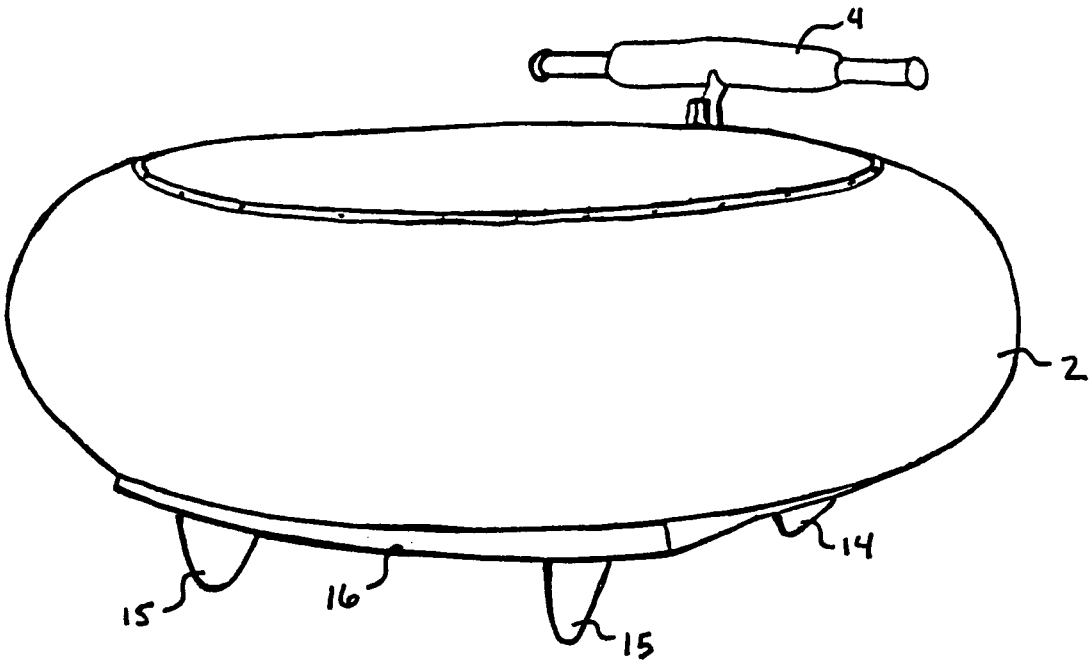
FIG. 7 is a schematic perspective illustration of an embodiment of a high maneuverability towcraft according to the present invention.

FIG. 7 depicts another view of the sharp break 16 at the rear of a full length hull. The use of a sharp break 16 at the rear extant of a curved hull may be avoided by means of a turbulence generator (not shown), although turbulence generators impose a generally undesirable drag penalty. In those instances where boat horsepower is adequate and extreme maneuverability is not demanded, one means of configuring a steerable and nominally maneuverable towcraft is to introduce turbulence along the bottom surface by fully enclosing the hull in a fabric bag. The bag material should be sufficiently textured and not so taut that it is unable to undulate so as to disrupt the formation of laminar flow along its bottom and rear surfaces.

The bag may be held in place (resist a lateral shifting) against the hull by means of clamping it in at least three places. Screw-on rudder and fin mounts which sandwich the fabric bag between it and the hull handily serves this purpose. Zippered, laced, or other closure means may be used as an aid in being able to place the bag inside of the hull.

Figure 8:
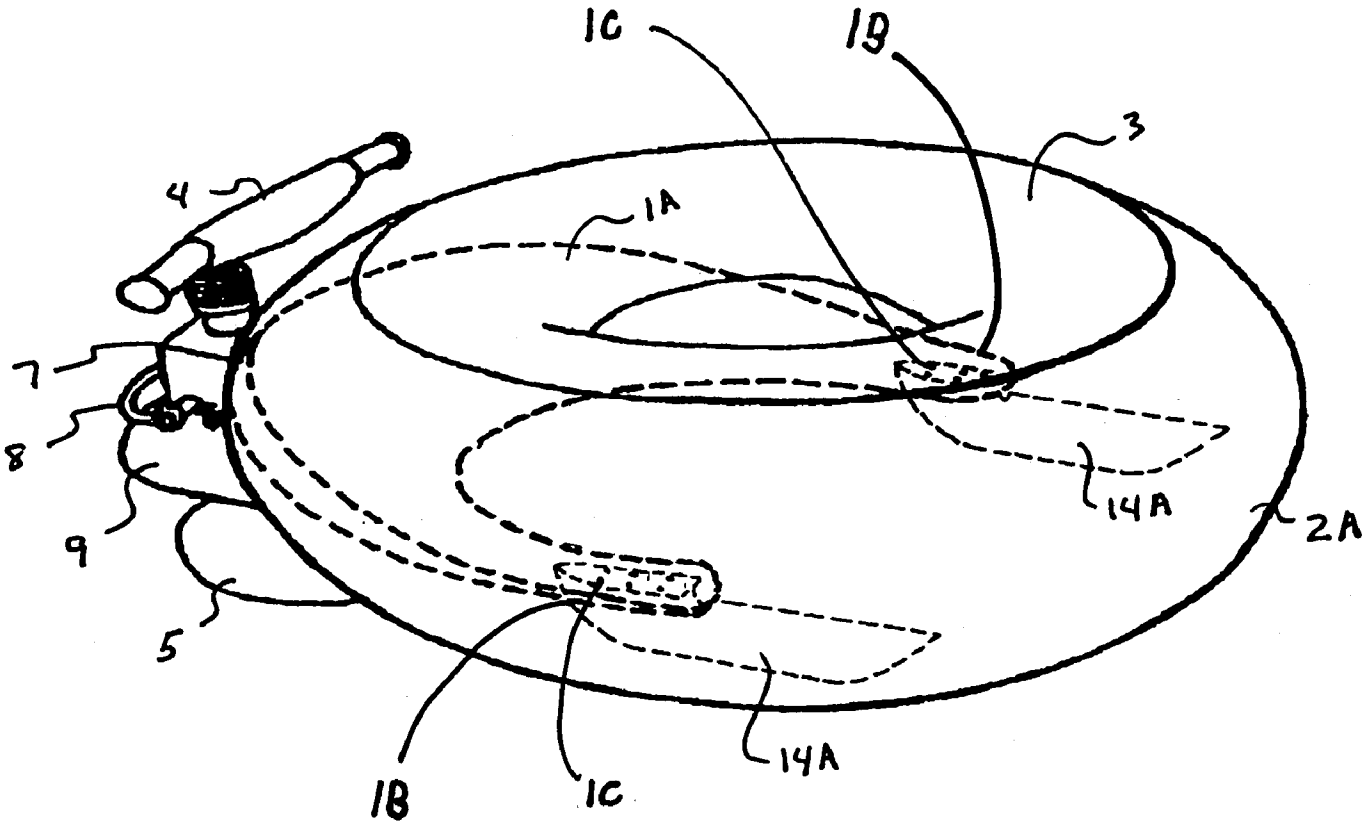
FIG. 8 is a schematic perspective illustration, partially in phantom, of an embodiment of a high maneuverability towcraft according to the present invention.

FIG. 8 depicts another, light-weight, embodiment which features a steerable forward rudder 5. A sub-frame 1A relies wholly on separate primary and secondary flotation means 3 (inflated air chamber, foam, etc.) The sub-frame 1A has two rearward sub-frame opposing extensions or fin mounts 1B which serve a number of purposes. First, since fins 14A need to be securely mounted, the extensions 1B permit a suitable mounting location while keeping towcraft weight at a minimum. Second, the extensions and fins provide a suitable means whereby a bottom-enclosing fabric cover 2A may be securely retained in place and prevented from shifting. Third, the two extensions 1B act in distributing wracking stresses imposed by the rudder and counteracted by the rider.

For this embodiment, at least, the rudder mount 7 is preferably removable. The rudder mount assists the two fin mounts in sandwiching the fabric cover between the mounts and the sub-frame. This also effectively seals the cover against water intrusion. This embodiment would typically be assembled by first placing the sub-frame inside the cover. Next, threaded holes 1C in the sub-frame would be lined-up with the respective holes in cover 2A. And finally, the rudder mount and fin mounts would be screw-fastened to the sub-frame. In this way, the sub-frame and cover are removably joined together, and, thereby able to avoid excessively high load concentrations within any one part.

Since there is only a partial hull structure 1A in this embodiment, fabric 2A must necessarily cover the bottom of the towcraft. The need for a sharp break along the aft portion is eliminated since compliant, textured, fabric tends to sufficiently disrupt flow (generate turbulence) to the extent that laminar flow cannot be established; which is a prerequisite for Coanda How. However, one disadvantage inherent with a fabric bottom surface is that drag associated with fabric is higher than that of a smooth bottom hull surface terminated by a sharp break. As previously disclosed, towcraft hulls which have a higher drag value must have a comparably larger rudder in order to maintain desirable handling characteristics. Taller and heavier towcraft riders can also make increased demands on the rudder 5. Therefore, it is desirable that the rudder 5 be made interchangeable, or its sidewall area variable, in order to match the rider with a desired towcraft handling performance level. Beginners and adolescents may start with rudders which have reduced sidewall area that limits lateral acceleration rates and MOA's. As rider experience and confidence is gained, the rudder may be interchanged with ones in which the sidewall area is increased to the point that extreme maneuverability is obtained. Steerable towcraft configured according to the present invention with primary water-engaging forward rudders and 100% trailing hulls (low moment of inertia), which represents the most maneuverable configuration, can be constructed for such extreme maneuverability that additional assistance is needed for the rider to be able to remain on a rapidly accelerating HMT during hard turns. One method for prone riders is to use a hook-and-loop fastener means (not shown) whereby the rider's wet suit is releasably joined to the upper-rear surface of the towcraft.

FIG. 8 depicts mid-fins 14A which are longer than mid-fins 14 shown in FIG. 1. Since there is no provision for mounting rear fins, in those instances where riders desire a "tamer", or more subdued ride which one or more rear fins provide, the mid-fins 14A, as shown in this embodiment, have been extended farther to the rear. Greater fin area front-to-back serves to slow the towcraft's yaw rate, or its directional rate-of-change. Extended mid-fins 14A functions similarly to mid and rear fins mounted concurrently. Though, the dynamic handling characteristics cannot be as finely tuned to rider preference as is the case with separate mid-fins and rear fins. Heavier/taller riders lying prone on the towcraft typically require greater fin area (draft×length) at the rear extant in order to gain a desirable degree of handleability. In the case of a sub-frame equipped towcraft, the entire mid-fin could be easily replaced with one having the requisite draft proximate to its aft-most portion.

Figure 9:
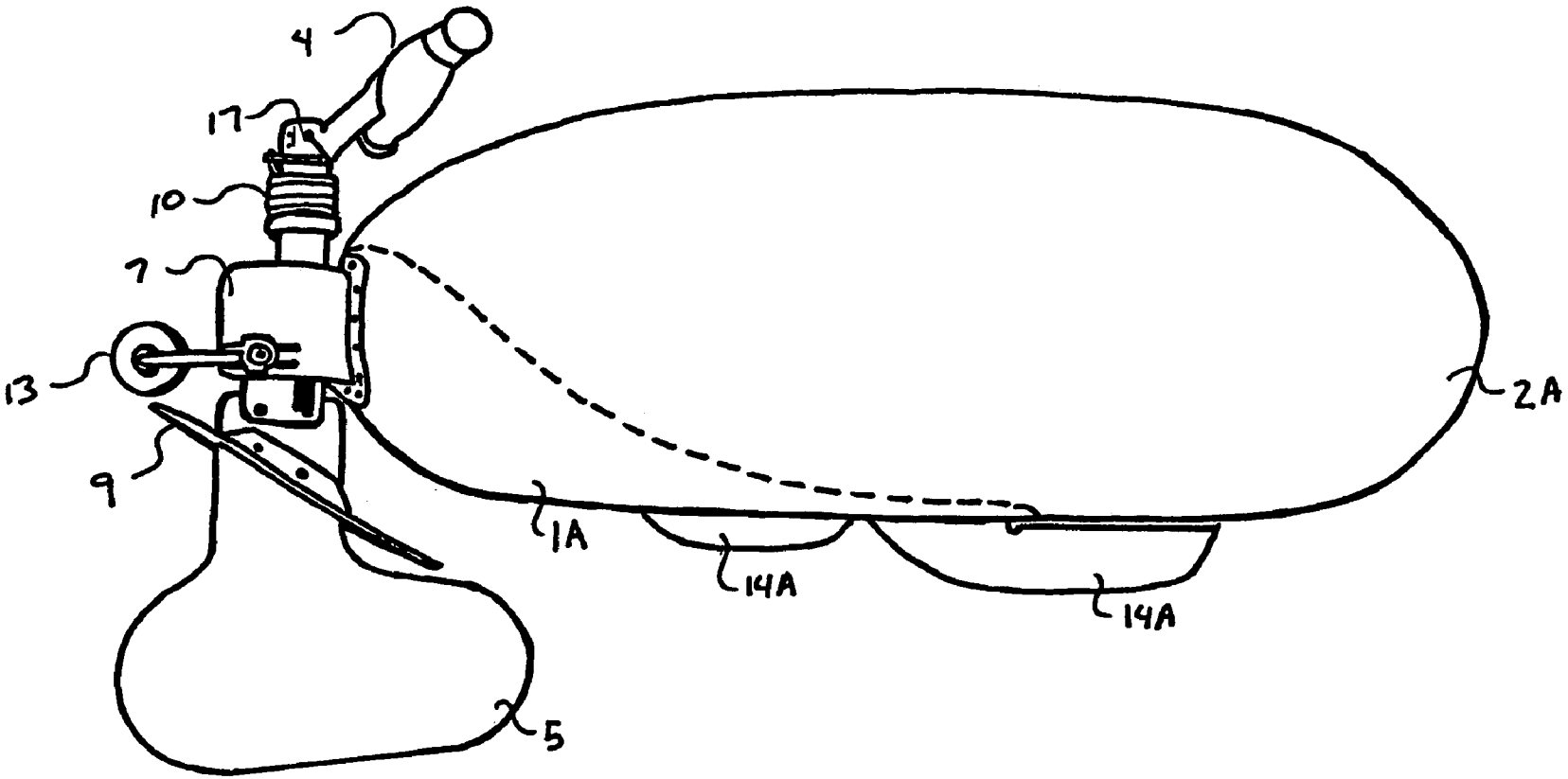
FIG. 9 is a schematic perspective illustration, partially in phantom, of an embodiment of a high maneuverability towcraft according to the present invention.

FIG. 9 depicts a left-side view of a sub-frame equipped HMT showing the narrow gap between the trailing upper edge of rigid-flexing mid-fin 14A and the underside of hull IA.

Figure 10:
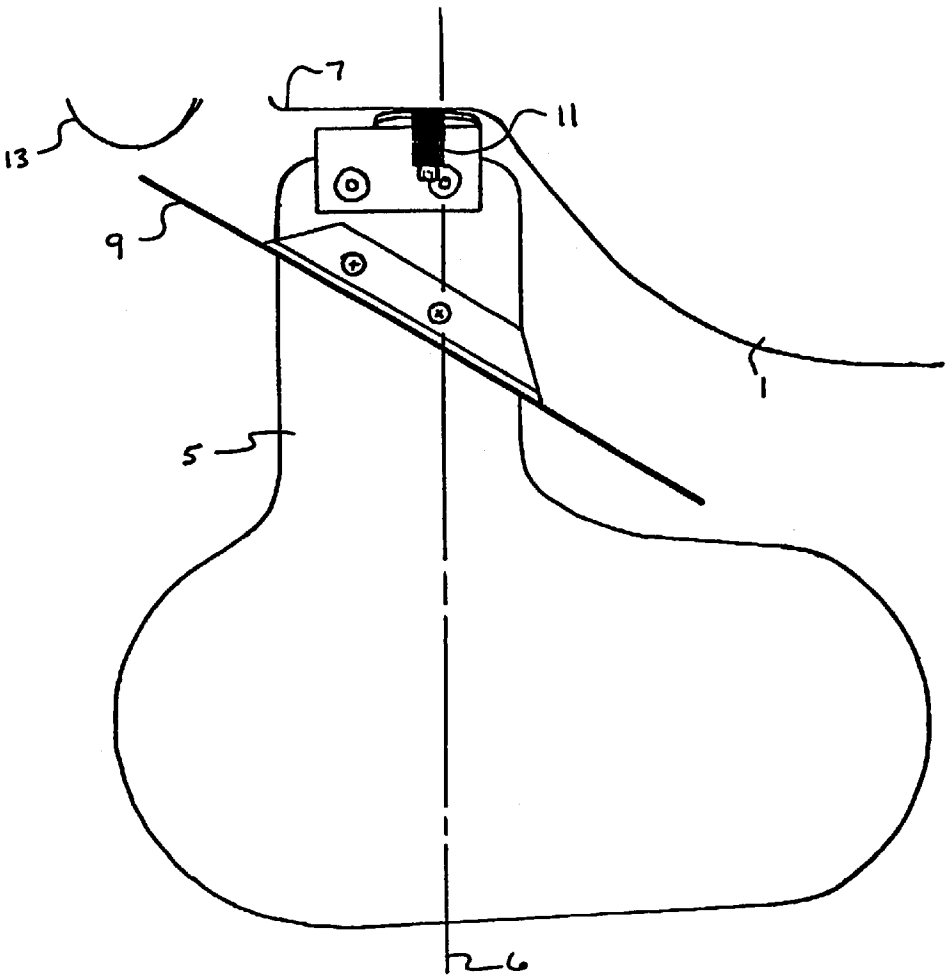
FIG. 10 is an illustration of a rudder according to the present invention.

FIG. 10 depicts one suitable forward rudder arrangement showing the position of a rudder pivot axis 6. The leading-trailing rudder moment (centrum of area forward and aft of pivot axis multiplied by its respective moment arm from pivot axis) ratio for pivoting rudders of the present invention should not be greater about 50/50, and should not be less than about 30/70. For optimum handling and negligible torque-effect the moment ratio should, preferably, be between about 35/65 and 40/60.

Figure 11:
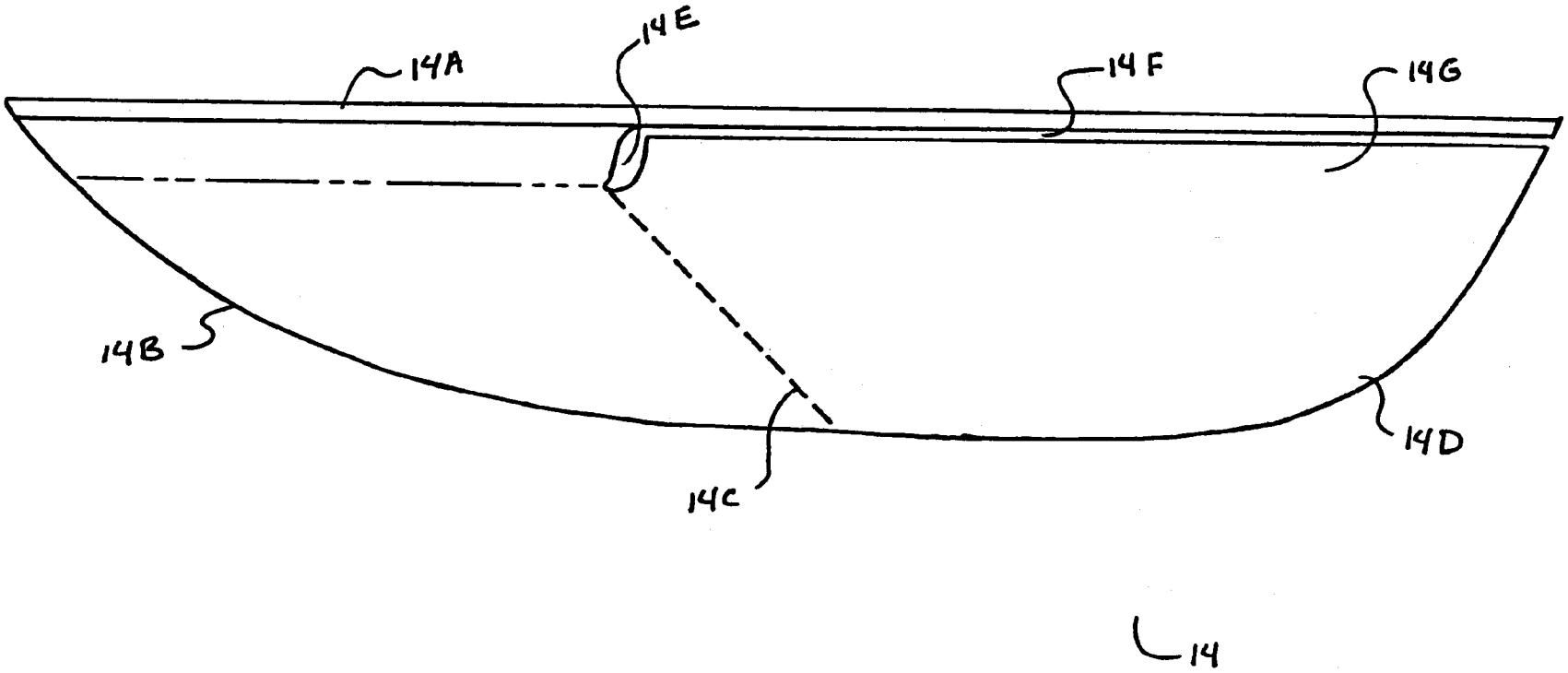
FIG. 11 is an illustration of a fin according to the present invention.

FIG. 11 depicts a variable sidewall area (flexing) mid-fin 14. Base 14A may be permanently or removably mounted to the underside of a rigid/semi-rigid hull or sub-frame. Preferably, the trailing portion 14D should flex sideways in response to an applied load. Additionally, it is further preferable that the upper portion of the trailing fin 14G also tilts away from an applied load or force. This creates a camber such that the fin "digs" into the water which prevents "fin hop" during aggressive maneuvering. Gap 14F preferably is narrow to avoid excessive amounts of water "spilling" up along the curved underside of the hull at times of high lateral angle-of-attack. A narrow gap makes the available fin sidewall work more effectively than a fin with equivalent side wall area having a larger gap. Relief 14E allows the fin to flex without breaking. 14C is a bend line which enables both a sideways flexing and a vertical tilting (variable camber).

In certain embodiments, preferably, the mid-fins 14 utilize a glass, graphite, aramid, or other flexible, high-strength, fiber-resin matrix composite construction where three compression-molded sheets are made to a certain shape and laminated together. This is not to infer that such flexing of fins could not be achieved by other constructions, but rather, that the following construction works satisfactorily. Moving from front to rear, the middle laminate sheet is defined by the leading edge curvature 14B, and at the rear, the declining dotted line 14C. The two outer laminate sheets are defined by the overall shape of 14B, 14D, and 14G.

The near-side (closest to the load) laminate flexes first and experiences the greatest load. Its bond line is desirably placed in compression as opposed to an undesirable tensile peel configuration. The far-side laminate helps to limit the total flexing travel of the near-side laminate when the near-side laminate comes into contact with it. Therefore, some movement is permitted, and yet protection is also afforded against over-flexing in a peel configuration which can lead to bond-line failure or fin breakage. Generally, larger fins and rudders are required at slow towing speeds while smaller ones are suitable at planing speeds. Flexing fins allow one set of fins to function optimally at both ends of the towcraft towing speed spectrum. The dual action flexing principle may also be applied to rudders in order to ameliorate excessively high instantaneous rudder side loads. The described dual-flexing action of rudders and fins permits an efficient constant draft of these devices in the water while at the same time preventing peak instantaneous loads from being transferred to the hull. In order to forestall any high speed yaw, or directional oscillation, a foam rubber insert (not shown) may be inserted in the narrow space between the two trailing fin or rudder sections and bonded to the side of one of the sections. In this manner, damping may be easily introduced.

While not shown, other fin and rudder construction details are also useful. Namely, holes drilled through the fins' sidewall area have a minimal effect at low angles-of-attack with the on-coming water. At high angles-of-attack, thru-holes can desirably de-tune the fin by relieving, or "spilling", water pressure on the upstream side of the fin. This tends to reduce instantaneous side forces acting on the fins (and the rest of the craft) which is advantageous for beginner riders when the towcraft is traveling at higher speeds. Fin and rudder sidewall area may also incorporate an additional degree of variability by temporarily plugging the thru-holes or by covering the holes with a thin sheet material that is made to flex with the fin or rudder.

Another alternative fin construction entails a variable part thickness aft of the flex line. By gradually thinning a mono-thickness fin aft of the flex line (relief 14E), the fin may be made to assume a uniformly curved profile as it is flexed sideways. This lessens the concentration of stress along a discrete flex line while at the same time permitting the fin to "spill" water at high angle-of-attack.

Another fin construction detail not shown is to incorporate a flexing flap in the middle of an otherwise rigid fin. This is useful where extended-length mid-fins are required. The flexing flap, in like manner to the previously described flexing fin and drilled holes, relieves pressure at high fin angles-of-attack with the water and makes aggressive maneuvering possible by maintaining controllability.

Figure 12:
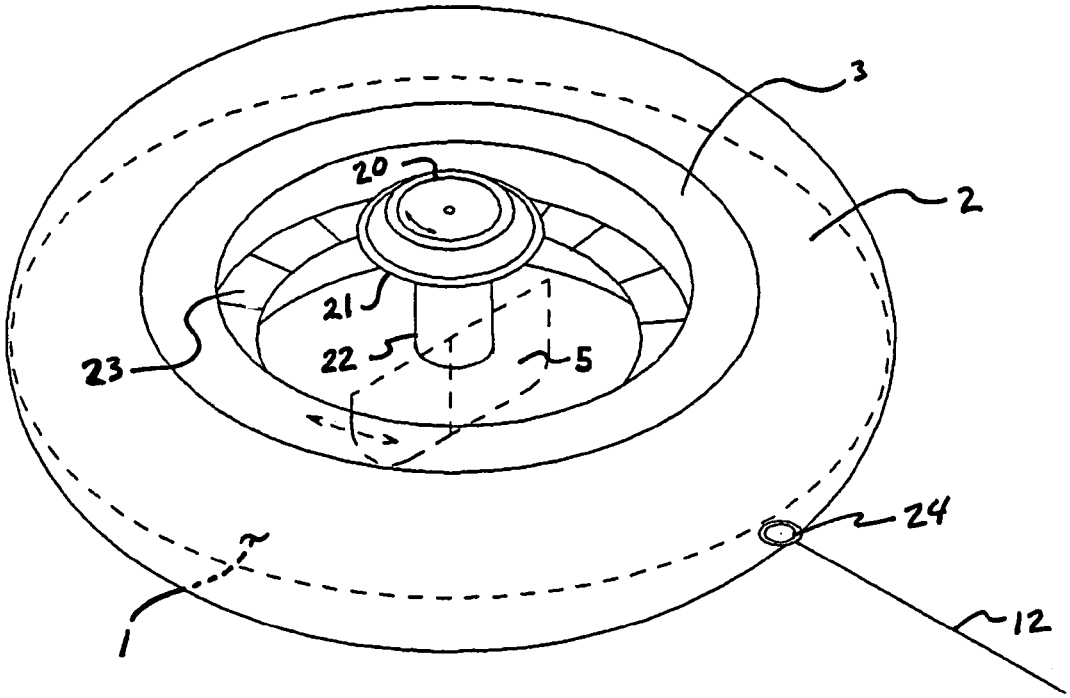
FIG. 12 is a schematic perspective illustration, partially in phantom, of an embodiment of a high maneuverability towcraft according to the present invention.

Referring to FIG. 12, another embodiment of the present invention comprises a toroidal (shown) or elliptically-shaped (not shown) towcraft which includes a lower shell 1; fabric enclosure 2; inflated tube or foam cushion 3; one or more fixed towline attachment points 24 (one towline attachment point shown); steering wheel 20; fixed disk with hand grip ring 21; central pedestal 22; and, optionally, a seat 23 (which is an extension of a floor). One or more riders sitting on the optionally provided seat 23, the floor of the craft, or on the tube or cushion 3 operatively steer by means of rotating the steering wheel which connected to rotatable rudder 5 in one direction or the other. The stationary lower disk with hand grip ring 21 provides a convenient alternative handhold if only one hand is used to grip the steering wheel. The steering wheel 20 may be directly connected to the rudder 5 or it may be geared (not shown) such that a larger steering wheel angular displacement is required for a desired rudder angular displacement. This is advantageous in that the steering input rate may be properly matched to the dynamic handling characteristics of the towcraft. Whether direct-connected, or appropriately geared, the steering of this towcraft, like all others of the present invention are intuitive. In other words, by turning the steering wheel to the right (clockwise direction), the craft moves to the right.

The towline line-of-force passes through the pivot axis of a balanced (fore-aft moments are equal), or nearly balanced, rudder 5 which, itself, is located at the center of either a circularly or an elliptically-shaped (in plan view) towcraft. An elliptically-configured towcraft, according to this invention, is wider in its beam than in its overall length.

When a craft of this embodiment of the present invention is steered in one direction, or the other, the craft first begins to move laterally in the steered direction. A second action, which immediately follows the first action, or movement, is an incidental rotation of the towcraft's hull about its central vertical axis (which coincides with the pivot axis). Craft rotation is due to towline tension acting on one side of the towcraft which maintains the towline attachment point(s) in a boat-facing attitude at all times. As a steering action moves the towcraft further to one side of the boat, towcraft yaw, away from the direction of travel, becomes more pronounced. The above described craft rotation, or yaw, is not a detraction with this embodiment since it does not impose on or limit the towcraft's steerability. Unlike prior art embodiments, this embodiment of the present invention has no fixed fins, or sponsons, which can negatively affect steerability or controllability if the centerline of the craft is not always aligned with the direction of travel. Except for the rudder 5, the otherwise featureless hull bottom of the subject invention does not interact with the rudder 5, or react with the water in determining or helping to maintain, the towcraft's direction of travel.

A slight yaw oscillation tendency of the towcraft may be damped by the use of dual intermediate towline straps, or cords, instead of one towline attachment point at the front of the towcraft. Dual intermediate tow lines are separately connected, at their aft ends, to spaced-apart attachment points at the front of the craft, and, are joinedly connected to each other and the primary towline at their fore ends. Alternatively, instead of two intermediate tow lines, a single intermediate rope, strap, cord, or line may be looped such that its two ends are fastened to spaced-apart attachment points at the front of the towcraft, while, the aft end of the primary towline is non-slidingly attached to the mid-point of the intermediate loop.

If the rudder 5 area is adequately sized for the towcraft, the angular displacement of the rudder from a straight-ahead orientation approximately equals the hull's resultant rotational angular displacement in the opposite direction. This is due to a natural characteristic of the rudder which causes lateral movement of the towcraft to cease whenever the rudder approaches a parallel alignment with the towcraft's direction of travel. Therefore, the OA of the towcraft is approximately equal to the rudder's steering angle displacement from straight-ahead (alternate interior angles). Consequently, for this towcraft embodiment, a steering input results in two output actions; incidental hull rotation and lateral movement (OA), both of which are, conveniently, approximately equal to the steered keel board's displacement angle.

When steering left or right, it is normal for the hull rotation to lag the steering input by a few degrees. Inertia of the towcraft and its occupants is responsible for the lag. This lag response (relative to steering input) does not affect the towcraft's output (lateral movement) since lateral movement of the subject towcraft depends entirely on the instantaneous orientation of the rudder 5, and not the hull's alignment with the water as in prior art embodiments.

Since a multi-rider version of this instant embodiment is considerably larger in diameter than a single-person towcraft of the preferred embodiment, it is much less apt to overturn sideways due to a lower height-to-toroid-diameter aspect ratio. An elliptically-shaped towcraft also has an advantage of lower drag at high offset angles due to a progressively smaller effective beam dimension when compared to comparably equipped, constant-beam, circularly-shaped towcraft at high offset angles. When towcraft of this design is offset at some distance to one side of the boat, the single, or dual, towline attachment points causes the towcraft to rotate horizontally in the water such that an elliptically-shaped plan form presents a narrower hull cross-section to the on-coming water, thereby lessening its drag while simultaneously increasing its effective longitudinal axis length from its zero offset condition (which reduces its sideways over-turning moment relative to the towline axis). It is especially important for a towcraft of this design and operation to be symmetrical front-to-back and side-to-side, and that ideally, it should present a lower drag component and over-turning component, or tendency, when at high offset angles relative to the boat. It should be noted that elliptical plan-forms handily satisfy this dual requirement.

Consequently, since this embodiment is designed to be successfully operated in a sideways manner in the water without over-turning, the rigid/semi-rigid hull may be either fully enclosed in a bag (cover) or be provided with Coanda-inhibiting turbulence generator ridges/grooves/textured surface in order to obviate the need for an extensive sharp break around the craft's lower periphery (which would incur high drag values at high offset angles). Where a cover is used to fully enclose the bottom, the hull should preferably can be dimpled to allow for flush snap fastening of the cover to the hull. A thin seal ring can be installed over the rudder pivot shaft prior to attachment of the rudder to its pivot shaft in order to prevent ingress of water into the interior of the towcraft's enclosure. The seal ring's flange, which extends outward from the flexible seal (in contact with the rudder shaft), is preferably screw-fastened to the underside of the hull such that the fabric cover material adjacent to and surrounding the rudder shaft hole is clamped between the seal ring and the hull in a sealing fashion.

Towline attachment mounting pads 24 (only one shown) are, likewise, screw-fastened to the hull, clamping a portion of the fabric cover there-between. If two intermediate lines are used, the triangular-shaped opening formed by the taut straps, preferably, should be covered with a cloth or fine netting to prevent an occupant's arm or leg from being caught in the pinch points where the straps or cords meet the hull.

In terms of its principle of operation, the towline line-of-force is always maintained in a straight line with the pivot axis of rudder 5. The rudder front-rear areal bias (if the front half of the rudder is the mirror image of the rear half) should be between 50/50 and 30/70. A rearward rudder areal bias allows the towcraft to fall into a position behind the boat when the steering wheel is released. This is advantageous when towing without anyone on board. Stops (not shown) may be used to limit angular displacement of the keel board. No fins are required or recommended with this embodiment. Straps may be used retain an inflated tube in place in the event the craft is capsized while being towed at typical planing speeds.

Advantages of this embodiment over the prior art include: low effort steering; good steering responsiveness; riders may cooperatively steer towcraft; simple, lightweight, low cost construction; design ideally suited for multiple riders; wide range of SOAs; and good wake-jumping characteristics. Reentry into water at any position or attitude does not induce rolling moment on hull (provided keel board is aligned with direction of travel).

Figure 13:
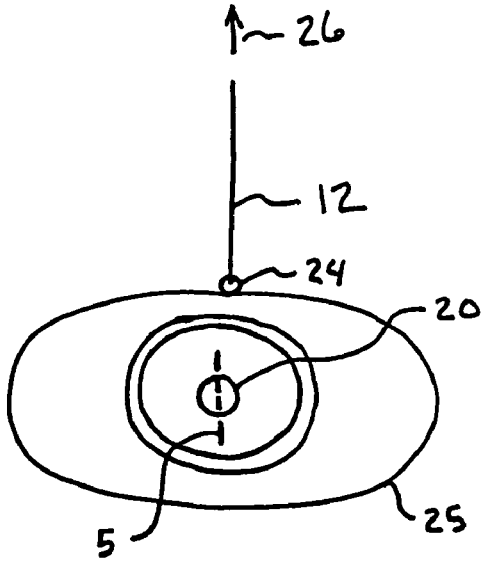
FIG. 13 is a plan, schematic illustration of an embodiment of a high maneuverability towcraft according to the present invention.
Figure 14:
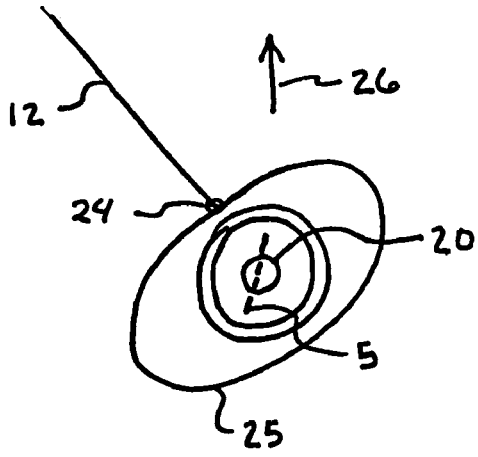
FIG. 14 is a plan, schematic illustration of the embodiment of a high maneuverability towcraft according to the present invention shown in FIG. 13.

FIGS. 13 and 14 depict examples of elliptically-shaped steerable towcraft with a centrally located rudder and steering wheel arrangement where they are at zero and 45 degree offset angles, respectively. The elliptical shape 25, when offset to one of the power boat, resists a sideways overturning moment.

Figure 15:
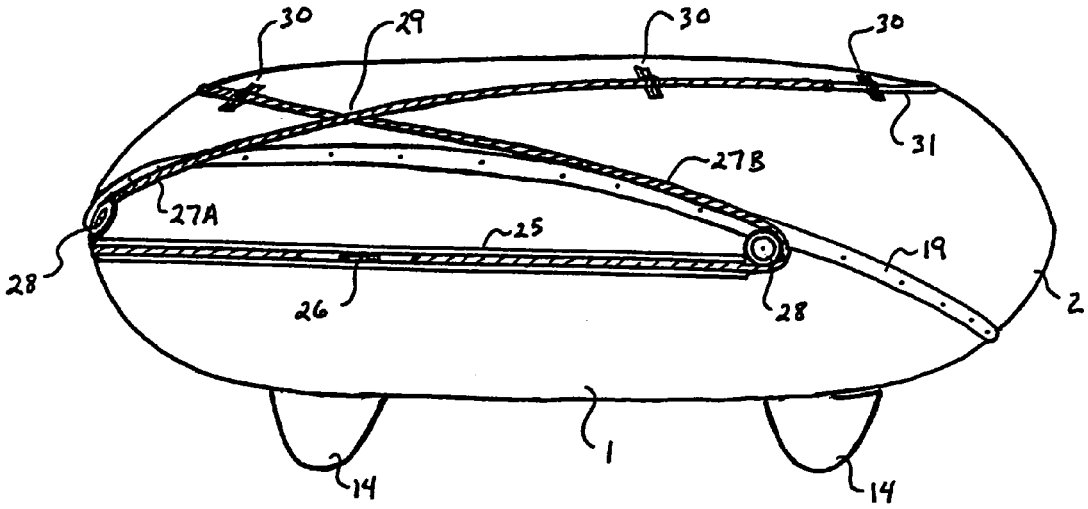
FIG. 15 is a schematic perspective illustration of an embodiment of a high maneuverability towcraft according to the present invention.

FIG. 15 depicts another embodiment of the present invention having an inflated toroidal tube insertable into a rigid, or semi-rigid, lower hull 1 covering much of its lower half and a fabric upper member 2 covering the balance of the lower half and at least a portion of its upper half; spaced-apart, rigid or semi-flexible, over-sized, mid-fins 14, or optionally, an oversized, centrally-located, fin (not shown); curved tubular track 25 with lengthwise slit or bore 25A; slider 26; pulleys 28A and 28B; ropes 27A and 27B; and, a hoop actuation means 31 for positively shifting the slider 26 along the curved slit track 25. It should be noted that within the context of this invention disclosure that the use of the term, semi-flexible, as it pertains to fins, over-sized fins, or rudders, infers that at least a trailing portion of the water-engaging device can flex sideways, or, can flex both sideways and vertically, in response to water pressure acting thereon. Water pressure against the lateral surfaces of a device arises from a flow regime in which there exists an angle-of-attack between the direction of water flow and the longitudinal axis of the water engaging device.

This embodiment of the present invention comprises a steerable towcraft which features a structurally robust, horizontally disposed, curved, slit, tubular track 25 of constant radius attached to the front of the towcraft's rigid, or semi-rigid, hull 1. The track 25 features a single, narrow, lengthwise slit 25A along its outer curved periphery. A short slider 26, which conforms to the interior dimensions and curvature of the slit arcuate track 25, is made to be positively slid from one end of the track to the other (within in certain limits, as set by stops). The slider 26 additionally features a horizontally disposed extension (not shown) thereon which passes through the slit in the track and projects forward, a short distance. This extension, or tab, is the towline's attachment point to the steerable towcraft. A single length of rope, or preferably, a rope and hoop combination, is made to be looped around the body of the towcraft, cross itself once at point 29, and be attached by its ends to the laterally disposed ends of the slider 26. The rope 27A, 27B, like the slider 26, passes through the slit or bore 25A of the curved track 25. Beyond the extant of the curved track, the rope is made to pass through a number of loops 30, grommets, or curved tubes. The loops or grommets are fixed to the fabric upper or other cover, and, serve to guide the rope as it passes around the upper surface of the towcraft. Between the loops or grommets, the rope 27 or hoop 31 is left exposed and suitable for being gripped by one or more riders in or on the towcraft. Because of the nature in which the steering rope, or line, is made to pass around the craft, the overall shape of the towcraft should, preferably, be circular when observed in its plan view.

Alternatively, in place of a unitary circumferential length of rope, a single, open-ended, ring-shaped, semi-flexible, tube or rod hereafter referred to as a partial hoop, or simply hoop, may comprise the side and rear portions of the circumferential loop while the front portion comprises rope or other flexible line. The advantage of a rope-hoop combination is that it experiences lower frictional drag than that associated with a unitary length of rope as it passes, in chordal fashion, from one grommet, or guide loop, to the next. Also, the hoop portion provides a better steering-handgrip for riders than the rope portion.

In certain embodiments, the hoop extends a full 360 DEG around the toroidal upper surface of the towcraft in order to further decrease steering frictional drag and to further improve a steerable handhold. The hoop's outer periphery preferably is inverted, or grooved, in the manner of a pulley. This allows a tangential rope, or other flexible line, to lay wholly within the confines of the hoop-pulley's groove. Steering lines running from opposed ends of the slider are guided over pulleys 28A and 28B at the ends of track 25 and then directed, in a crossing fashion, to the grooves in the steering hoop-pulley. The steering lines are made to run a requisite distance in the groove before they are joinedly connected to the hoop-pulley itself. The reason for this is that sufficient steering line length must be provided in order for the slider to be able to fully move from one end of the track to the other. A hoop and attached line thus configured acts as a windlass.

Single rider versions of the instant embodiment may be configured with a guide loop, strap, or other functional grommet, at, or near, the 2 O'clock and 10 O'clock positions. This allows the rider to slide a two-handed grip on the hoop to locations immediately aft, or immediately forward, of the of the grommets which prevents inadvertent steering inputs during times of aggressive towcraft maneuvering. Consequently, a 360 DEG steering hoop, in a single device, features: low cost, low profile, low friction, and lightweight, steering input device; ability to be steered by one person, or cooperatively, by all riders on board the towcraft; reliable handhold for one or more riders; no need for auxiliary handholds; and, steering brake to prevent inadvertent steering inputs.

In certain embodiments, in order to keep weight to a minimum, a light weight hollow-core hoop is preferable over a solid core construction, although the hollow core may be foam-filled to eliminate the possibility of water intrusion. Either two lengths of rope, cord, or other steering line, or, a single length of steering line may be looped around the 360 DEG hoop. If only a single length of the steering line is used, only a single attachment point of the line to the hoop needs to be made. However, in either case, the two forward ends of the steering line depart from the front of the hoop, in a tangential and crossing fashion. In other words, the one length of rope connected to the right end of the open hoop is passed over the left pulley and joined to the left end of the slider, while the left end of the open hoop is connected to the second rope which is passed over the right pulley and joined to the right end of the slider. This crossing feature enables a direct steering action which is logical and intuitive. A clockwise rotation of the rope-hoop assembly causes the slider to be pulled to the left which, in turn, directs the hull to be rotated in a clockwise direction; which, results in a right turn. Other advantages afforded by the use of pulleys and the crossed steering line feature is a desirable steering line path (from an ergonomic standpoint) which has an inherently low drag value. The crossed steering lines at the front of the towcraft handily represents a great-circle path of the steering line rope over the preferable toroidal-shaped contour thereby allowing for a natural lay of the lines against the curved surface of the towcraft which minimizes the need for extra guide grommets and a concomitant increase in frictional drag of the steering line when making direction changes.

The arcuate slit track 25 is preferably manufactured by filament-winding or braiding a curved composite tube reinforced with either glass, aramid, carbon, or other high strength fiber, or a combination of fibers. The resin system used as the matrix component may either be a thermoset of polyester, vinyl ester, or epoxy. Though, certain high performance grades of similarly reinforced thermoplastic resins may also be suitable. Once the curved composite tube has been properly cured and removed from its mandrel, a narrow lengthwise slit is machined into its outer periphery. This manufacturing method is preferred over a resin transfer molded (RTM) part (slit is molded-in). RTM parts are unable to match the fiber content and flexural strength of filament-wound, or braided, parts. Though, RTM parts may be manufactured more economically in large production volumes. Unreinforced arcuate tubes, as described in prior art literature, are entirely unsuitable for this type of application due to the stress in the slit tube's sidewall. The sidewall of the slit tube must resist a force which is attempting to widen the slit. A widened slit can result in an increase in frictional drag of the slider through the track due to a narrowed tubular cross section in a direction perpendicular to the slit. A severely widened slit can result in the eventual loss and separation of the slider from the confines of the track. By having the inside radius of the arcuate track continuously bonded over its length to the front of the towcraft shell, some additional stiffness may be provided to the arcuate track by the shell. The several objects of the arcuate track, as satisfied by the aforementioned method, is to provide a smooth and accurate bore (low sliding friction), stiff walls (resist deflection, which also contributes to low friction), light-weight structure, and a reasonable manufactured cost.

The nominal diameter of the slider and attached rope corresponds to the nominal bore diameter (minus an allowance for clearance) of the arcuate slit track and series of loops, or grommets, which circumscribe and are attached to the towcraft, and, which lie in a plane that is above and predominantly parallel to the plane of the track. It is more convenient for one or more riders to grasp the exposed lengths of rope, or hoop, when it is positioned along the upper curved surface of the inflated toroidal tube, rather than at a lower elevation. The track, on the other hand, lies in a horizontal plane just a short distance above the waterline. For toroidally-shaped towcraft, this track mount height can vary from a minimum height of approximately 2 inches above waterline (when the towcraft is at rated load) to about the mid-point of the toroid, which, coincides with its maximum girth dimension.

A number of means may be used to attach the steering line ends to the opposed ends of the slider. The respective ends may be joined by simple adhesive bonding, or, be made separable by snap fastening, threaded turnbuckle, or other convenient means. It is desired that, the connection's cross sectional diameter and general curvature match that of the slider; thereby enabling the connector and a length of the rope to enter and pass, unrestricted, through the arcuate track. Since the rope and hoop do not have towing tensile loads applied to them, they may be made for lighter duty service than that which is required for towcraft towline. The maximum forces experienced by the steering line and hoop would be that of a rider hanging on while the towcraft is maneuvered.

Since it is difficult to make sliders, or more complicated rollers (not shown), move passively along a long curved track in a satisfactory manner, this embodiment solves the problem by having the slider move in a positive fashion by attaching a continuous rope-hoop combination to the opposing ends of the slider. A rider, or riders, would steer the towcraft by causing the rope and attached hoop to be slid along its guided path in the manner of a large encircling steering wheel. Beside the ability to steer, a secondary requirement for a steerable towcraft is for the rider, or riders, to maintain and remain in control of the craft during maneuvers in a variety of water conditions.

The instant embodiment of the present invention allows the rider(s) an improved grip onto the towcraft when grasping the hoop portion of the rope-hoop combination. The hoop resists a radial deflection, or movement, relative to the axis of the hoop at the hand grip location (in the manner of an automobile's steering wheel). The continuous rope-hoop serves both as a grip and as a steering device. A rider may either grasp and steer with both hands, or one hand, on the steering hoop. If only one hand is used to grip the hoop, the other hand may be used to grip a separate fixed strap (not shown) or other conveniently placed stationary hand-hold feature. The advantage of a combination steering hoop-grip/fixed grip technique for single riders is that a further degree of control is attainable during aggressive steering maneuvers or rough water conditions. Alternatively, a single rider lying prone on the towcraft may utilize a hook-and-loop temporary fastener means between the rider's wet suit, or a belt worn about the waist, and the upper rear portion of the towcraft as a means of remaining on the towcraft during aggressive steering maneuvers involving rapid direction changes. By having the rider's mid-section temporarily constrained in this manner, fewer unintentional steering inputs are made which improves directional control of the towcraft. The hook-and-loop fastener means is designed, by means of the total amount of mutual engagement area, to release the rider when the towcraft capsizes and when the rider releases his or her grip. The rider may also intentionally separate himself or herself from the towcraft by simply rolling off to either side, thereby releasing the hook-and-loop in peel.

Towcraft of this embodiment designed for single riders lying prone thereon should preferably have the rear portion of the steering hoop pass through the bore of a slightly larger and similarly curved length of tube (tubular guide). By passing the steering hoop through a tubular guide, the rider's weight is prevented from interfering with (binding) the steering hoop's movement through its guide. Towcraft intended for single riders, just described, is steered by the rider grasping the side or forward exposed lengths of hoop, or rope, and pulling in the direction which corresponds to the desired direction of travel.

Towcraft of this embodiment of the present invention intended for one or more seated occupants is operatively steered by one or more of the riders cooperatively grasping (if more than one) and pulling the exposed length of rope, or combination rope and hoop, in one direction or the other. By having the ends of a continuous rope/hoop attached to the opposed ends of the slider, a pulling action on the rope, or hoop, has the effect of causing the slider to be positively slid along the curved slit track. A torque reaction between the body of the towcraft and the towline slider causes the body of the towcraft to be controllably rotated horizontally in the water. When the body, or hull, rotates, one or more over-sized fins, firmly attached to its bottom, as a consequence, also rotate through the same angle. Lateral movement of the towcraft, due to a steering maneuver, is the reaction of water being deflected laterally by the over-sized fins being angled with respect to the towcraft's direction of travel. This lateral movement continues until the over-sized fins, reach an equilibrium point in which the over-sized fin alignment (with the direction of travel) and its lateral reaction force of the water is balanced by an equal but opposite lateral pull of the towline. Full dislocation of the slider yields a maximum SOA which corresponds to slightly less than half of the curved track's wrap angle around the front of the towcraft.

If two over-sized fins are used, as in this depicted embodiment, the mid-point of a line drawn from the centrum of one fin to the other, preferably, also passes through the slit track's center of curvature. If a single, symmetrical, over-sized, ventral fin is used, a vertical line at its centrum (center of area) should likewise coincide with the track's center of curvature. In certain embodiments, a dual-fin arrangement is advantageous in that towcraft leaning can additionally be used with good effect. This embodiment of the present invention may be fitted with either a full, rigid, or semi-rigid, bottom hull or half-frame by which a single over-sized fin, or, spaced-apart, over-sized, fins may be securely attached and prevented from racking out of position as is the case with flexible attachment means. If a hull construction with a rigid, or semi-rigid, closed-in, bottom is selected, a centrally located over-sized fin may be used, whereas, spaced-apart, over-sized fins must be used with half-frame, or sub-frame, constructions. It should be noted that within the context of this invention disclosure, references to over-sized fins should be equated to one or more fins designed for the requirements of primary water-engaging duty [tracking (lateral slip resistance)] as opposed to smaller fins which are primarily intended to prevent towcraft slewing, or yawing; or, as in one alternative embodiment, also serves as a steering input. Within the context of this invention disclosure, the term, over-sized ventral fin (one which lies at some point along the longitudinal centerline of the towcraft), will hereafter be referred to as simply, ventral fin, while inferring the same dimensional characteristic of the former term.

As in the embodiment shown in FIG. 1, the instant embodiment of the present invention does not suffer any proclivity for the front of the towcraft to be pulled back toward the boat when it is steered away from the boat.

Self-centering steering means may be applied to this embodiment as in other embodiments so that the rider(s) may be provided with a progressive steering feed-back (resistance). Also, by releasing the steering grip, self-centering steering causes the towcraft to automatically maneuver to a position directly behind the power boat. This is particularly advantageous when towing a steerable towcraft without a rider on board. Additionally, slider stops should preferably be provided in order to prevent the slider from exiting the track at its ends. One means whereby self-centering may be accomplished is to use one or more bungee cords (elastic shock cords) attached at any one of a number of convenient locations along the steering line's path. If one bungee cord is used, its two ends should be attached to fixed points on the craft, closely parallel to the run of the steering line, or slider, at those points. The mid point of the bungee cord should then be attached to the steering line or slider when the slider is centered, laterally, in its track.

Advantages of this embodiment of the present invention include: lighter craft weight (no pivoting rudder-inclined plane-handlebar assembly); nominal construction cost due to the absence of a pivot-able rudder and inclined plane, which, is offset by the arcuate track and slider; excellent wake-jumping characteristics due to a neutral tendency for the hull to rotate in a horizontal plane when momentarily airborne (assuming uniform weight distribution of riders); inherently slower steering dynamics (rate of steering input), which, is more suitable for larger towcraft carrying multiple riders; multiple riders may cooperatively steer craft; especially easy for riders to remain on craft when maneuvering; positive/direct/intuitive steering response (output); good SOA capability; front of craft always faces in direction of travel; inherent anti-dive characteristics (no below-water-line-line-drag at front of craft) which negates need for forward inclined plane; and, no tendency for steering input oscillations due to excellent damping characteristics associated with the rope-and-hoop steering method.

Detractions include: single rider versions cannot be maneuvered as quickly or as aggressively as the preferred embodiment; involves large steering displacements; and, a relatively large steering effort is required, as compared to the minimal steering effort and input required for the preferred embodiment. An exception of the latter detraction pertains to the spaced-apart, oversized, fin approach in which the narrow, over-sized, fins are set with a slight toed-out attitude, as opposed to a parallel co-alignment. Spaced-apart fins which are slightly toed-out with respect to each-other, preferably by not more than a 20 DEG included angle, imparts a "steering" effect. Minimal steering effort, for the latter fin configuration, is required in order to achieve an angular displacement of the hull since the action of the water is now the primary mechanism by which the towcraft hull is made to rotate. When a slight rotation of the hull is initiated by pulling/pushing the steering hoop in one direction, or the other, or, through a steering action and a simultaneous leaning action, one of the spaced-apart, over-sized, fins is aligned in a parallel fashion with the oncoming water while the opposed, over-sized, fin is now set at an angle to the water flowing past it. Since the fins are set apart from one another, the fin at an angle with the water will result in a torque reaction being exerted on the hull while the fin aligned parallel to the flow of water will exert no such force on the hull. Therefore, water pressure acting preferentially, more against one fin than the other, is used to direct the hull to rotate horizontally in the water when the subject towcraft is underway. Such is the described "power steering" effect.

In regard to the limiting condition of no more than a 20 DEG included angle between spaced-apart fins, greater included angles result in a couple of adverse consequences. First, fins toed-out by more than a 20 DEG included angle create an undesirable amount of drag as water is accelerated through the narrowing gap between the two fins. Second, widely toed-out fins impart a serious directional instability. Every small nuance from minor weight shifts to minor water turbulence can cause the craft to dart in new and unexpected directions.

The instant embodiment of the present invention may be alternatively practiced by a number of different means. Instead of manually pulling on a continuous circumferential rope/hoop to positively shift the slider's position in its track, a handlebar or tiller geared to a capstan or friction-type pinch roll may be also used. Gearing between the handlebar or tiller shaft and the steering line, cord, or rope is required because a limited angular displacement of the handlebar or tiller must result in a larger physical output displacement in order to effect the necessary amount of steering line take-up and pay-out due to the rather long track length. Care, as usual, must be taken in terms of gearing to ensure that the steering output (direction of travel) is correct for a given steering input. The gearing and capstan or pinch rolls may be housed in a box which is preferably located a short distance above and behind the track. Though, a tiller-steering gear box may be located at the rear of the craft with steering lines guided to the pulleys, slit track, and ultimately, the opposed ends of the slider at the front of the craft.

One capstan approach would entail simultaneous take-up and pay-out of a single length of rope wrapped one turn around a gear-driven capstan and frictionally engaging same, the ends of which are attached to the slider's ends after being made to pass over pulleys at the ends of the track. In order to ensure frictional engagement (to prevent slip) between the rope and the capstan, either, one or more compression wheels, or, some tensioning means of the rope should be provided. The compression wheel method involves compressing the rope between one or more planetary idler wheels and the capstan drive. The rope tensioning method may involve the introduction of a resistance, or drag, to the rope as it enters the capstan, or, a tensioning means incorporated into the steering line (short length of elastic cord spliced into steering line). A second, and more preferable, approach entails two separate lengths of rope, or line, which are attached to one or two gear-driven drums, or windlass, housed in the gear box on their one end, and the opposed ends of the slider on their other end. The windlass involves the simultaneous, winding and unwinding of the two respective lengths of steering line in a reliable, non-slip, manner. The pinch roll approach would entail a pair of spring-loaded pinch rolls in between which a continuous loop of rope is passed. The ends of the pinch roll driven loop of rope are attached to the opposed ends of the slider after being made to pass around pulleys. At least one roll must be geared to the handlebar or tiller shaft while the other roll may be an idler. In either case, rotation of the handlebar or tiller in one direction or the other would involve a relative shortening of the length of rope between one end of the slider and the gear box, and a relative and proportional lengthening of the rope between the gear box and the opposite end of the slider. This action, like the manually operated continuous rope/hoop causes the slider to be positively slid in its track. The handlebar or tiller approach permits more rapid direction changes than manually gripping and pulling on the rope/hoop. Though, unlike the embodiment shown in FIG. 1, when the subject embodiment is operated at high towcraft offset angles, it must necessarily be accompanied by high steering angle displacements.

Figure 16A:
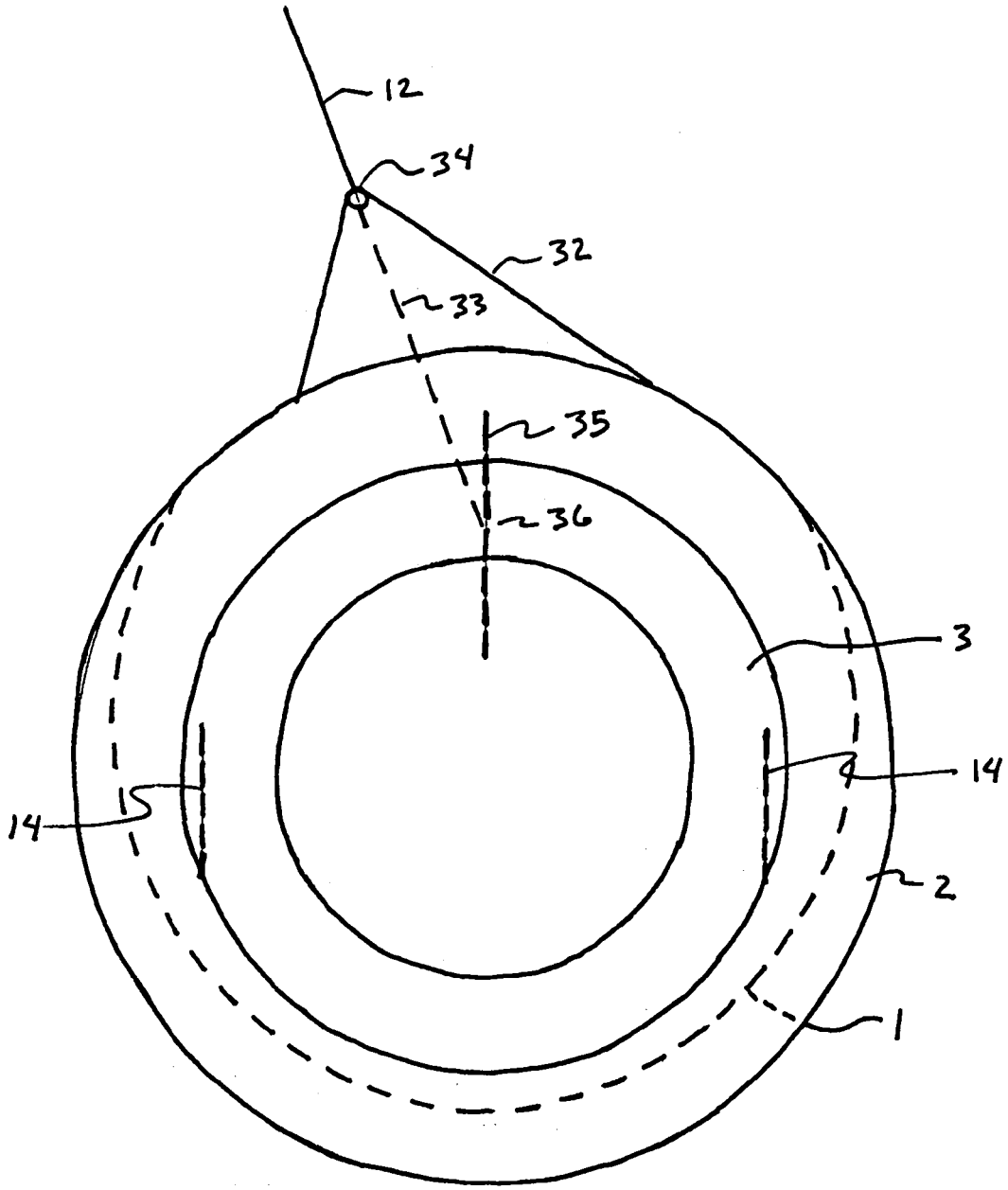
FIG. 16A is a schematic plan illustration of an embodiment of a high maneuverability towcraft according to the present invention.

A further embodiment, shown in FIG. 16A, comprises a steerable towcraft where the curved slit track is replaced with an intermediate towline loop of rope 32 or strapping. In this embodiment, the primary towline's aft termination point 34 is still made to be shifted laterally in a positive manner (not shown), as in the FIG. 1 embodiment. However, instead of causing a horizontal rotation of the towcraft's hull about its geometric center, a rotation is now made about a vertical axis 36 which lies a short distance forward of its center. As a result, a single ventral fin 35, or a pair of spaced-apart, over-sized, fins should have as their effective equal-moment-line a vertical axis that coincides with the center of the intermediate towline loop-generated-arc as depicted by the dashed line-of-force 33. Over an angular displacement of 90 DEG (45 DEG to each side of straight ahead), the path assumed by the primary towline aft termination point as it passes along a tensioned loop of intermediate towline is closely approximated by an arc. Beyond an included angle of 90 DEG, the path begins to assume the shape of an ellipse.

There are two basic approaches for shifting the primary towline's 12 relative attachment point 34 along the intermediate line's loop 32. The first approach consists of fixedly attaching the aft end of the primary towline to the midpoint of the intermediate loop and causing the entire loop itself to be taken-up on its one end, while it is simultaneously payed-out by an identical amount at its opposed end. The intermediate towline loop must be substantially strong since it must now also support towing loads in addition to the much lower steering forces. A second approach can comprise a static intermediate towline loop to which a laterally movable (sliding or rolling action), lighter-duty, steering line is attached (not shown). In order to positively move the primary towline aft attachment point along the length of the intermediate towline loop, smaller diameter steering lines may be attached to laterally disposed sides of the movable primary towline attachment device and be made to run along-side the intermediate towline.

Because the hull's rotational axis is now shifted forward of the towcraft's center, an off-center towline alignment, due to a steering action, will exert a lower moment force by which the towcraft hull is rotated horizontally in the water (the sole use of spaced-apart, over-sized, fins requires that they not only be located farther forward, but also, that they must be positioned closer together as dictated by the limits imposed by a circular-shaped hull). This results in higher steering forces and a slower output response unless it is remedied by the preferable combination of a single forward ventral fin 35 and two laterally spaced-apart fins 14, slightly toed-out with respect to each other, which are mounted aft of the new center of rotation. Since the two spaced-apart fins 14, in the instant embodiment, are not required to function as primary water-engaging devices (forward, ventral fin performs these functions) they may be sized and constructed according to the fins described in the FIG. 1 embodiment of the present invention.

A combination forward ventral fin 35 and two laterally spaced-apart, toed-out, fins 14 function accordingly: a turning maneuver is initiated by the rider positively shifting the lateral position of the primary towline's aft termination point 34 in one direction or the other along the intermediate towline loop 32, and an accompanying shift of the rider's weight on the towcraft. For the towcraft to be steered to the right, for example, the rider's leaning-steering action causes the primary towline aft termination point to be shifted to the left. The rider intuitively shifts, or leans, his or her weight to the right side of the towcraft. The weight shift causes the slightly toed-out fin on the right side to have a greater angle-of-attack with the oncoming water than the left fin. The angled fin does two things. It induces a marked increase in the fin's drag component, and it diverts water laterally. As mentioned previously, any increase in drag tends to place that part of the towcraft in a trailing-most relationship with respect to the point at which the towcraft is pulled, or towed. This creates an unbalanced moment between the left and right sides of the towcraft causing the front of the towcraft to rotate to the right (power steering effect). Water diverted laterally by the fin (one of two laterally spaced-apart) experiencing the greater angle-of-attack, relative to the direction of travel, assists the ventral fin in directing the craft in the steered direction. Also, as the rider's weight is shifted slightly back toward the center of the craft, the laterally displaced water acting preferentially on the one side of the craft steers the towcraft back toward an approximately straight-ahead configuration on a track parallel with the boat's; even as the towcraft is offset to one side of the boat. It should be noted that the further the towcraft is offset to one side of the boat, a progressively greater steered angle is required in order to maintain a parallel track with the boat due to a progressively higher towline tension force acting laterally, when the towcraft is at high offset angles.

Towcraft rotation to the right also causes the ventral fin to rotate in the same direction which exposes its left side surface to the oncoming water. This, in turn, causes the water to be diverted laterally to the left while its reaction force on the fin causes the towcraft to be pushed to the right. Since the ventral fin's areal centrum [for geometrically symmetrical fins (front-to rear)] coincides with the origin of the intermediate towline loop's arc, a balanced force condition exists between the fin's effective forward area (ahead of the vertical centrum line) and rearward area (behind the vertical centrum line). In this way, the ventral fin is able to effortlessly maintain a track through the water, in the manner of a forward-placed keel.

The location of the ventral fin is not so forward placed as to require a forward inclined plane for anti-dive purposes when being towed a low speeds. However, if an inclined plane is desired in order to impart a smoother ride at planing speeds, one can be mounted on the front of the towcraft by a bracket (central to the inclined plane) which spaces it away from the front of the craft by a short distance.

The ventral fin does not need for its side area to be perfectly balanced about the intermediate towline's effective center of radius as represented by an imaginary vertical line. The ventral fin may have a slightly greater area, and hence moment, to the rear of this line than that forward of this line (assuming a constant-draft fin). While it requires slightly more steering effort and lean (weight shift) on the part of the rider, in order to maintain a heading other than straight-ahead, a ventral fin with a rearward biased moment has the advantage of an automatic self-centering tendency which causes the tow craft to fall to a position directly behind the boat when towed riderless, or, during those times when the rider simply wishes to relax and not steer. A disadvantage of a rearward biased ventral fin is that as its front-to-rear areal ratio is decreased, the SOA capability of the towcraft is, likewise, decreased.

While symmetrically-shaped ventral fin designs have been presented, non-symmetrical designs are useful as well, as long as there exists an equal moment condition about the fin's virtual rotational axis (sideways rotation of the hull and fin). The moment of the fin area ahead of the virtual rotational axis should be approximately equal to the moment of the fin area behind the virtual rotational axis. The moment in the context of this invention disclosure is defined as:

(Force)×(Moment Arm Effective)

where, the effective moment arm is that distance from the virtual rotational axis through which the force of the water acts on the respective fore or aft ventral fin area. An equal moment condition about the virtual rotational axis can still exist as long as the product of the ventral fin's fore side area (proportional to force) and its associated effective moment arm is equal to the respective product of the fin's aft portion. Therefore, for example, a ventral fin with a larger fore area and shorter effective moment arm can be equal in its moment to a smaller aft fin area which has a longer effective moment arm.

Figure 16B:
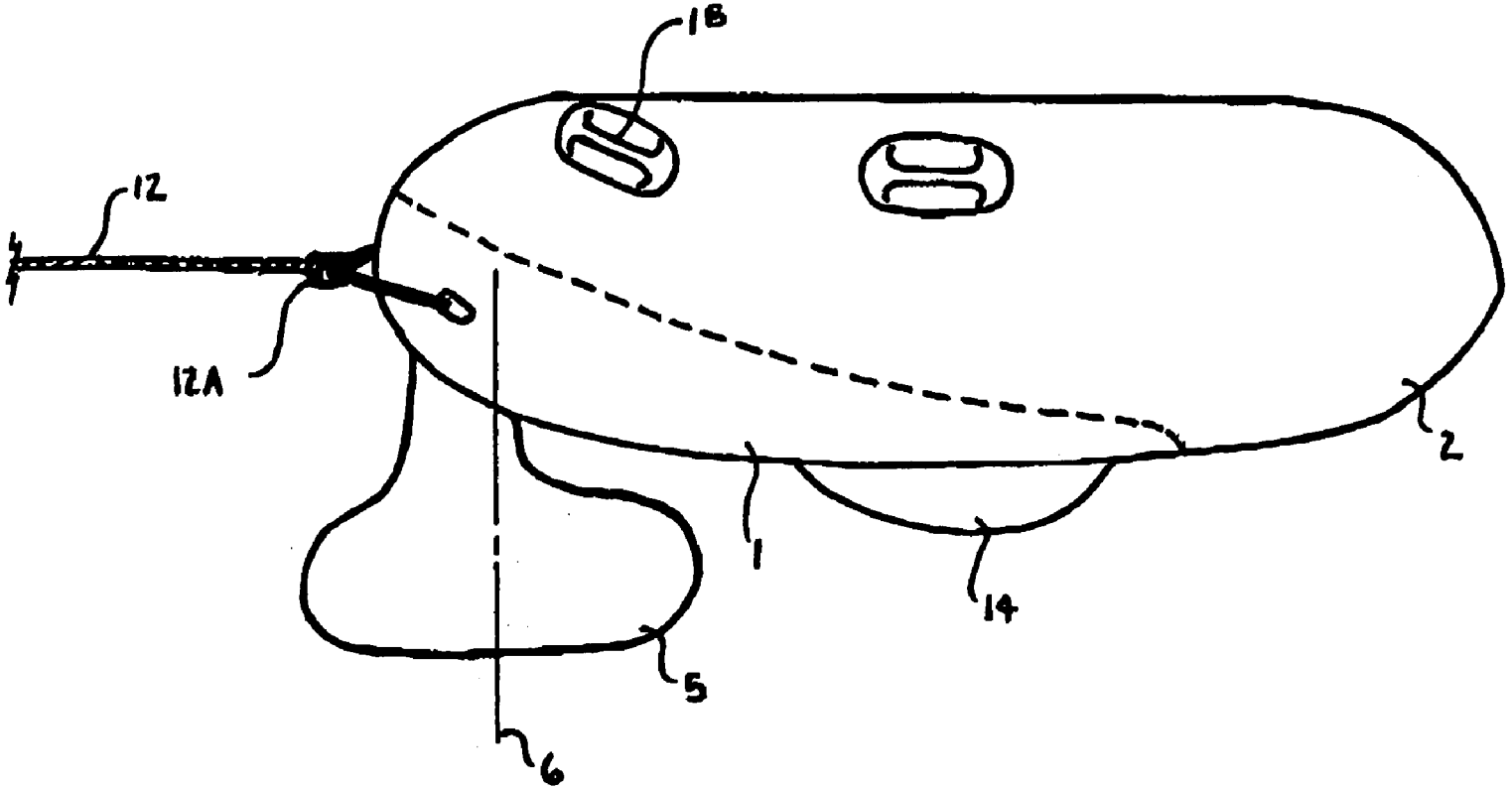
FIG. 16B is a schematic plan illustration of an embodiment of a high maneuverability towcraft according to the present invention.
Figure 17:
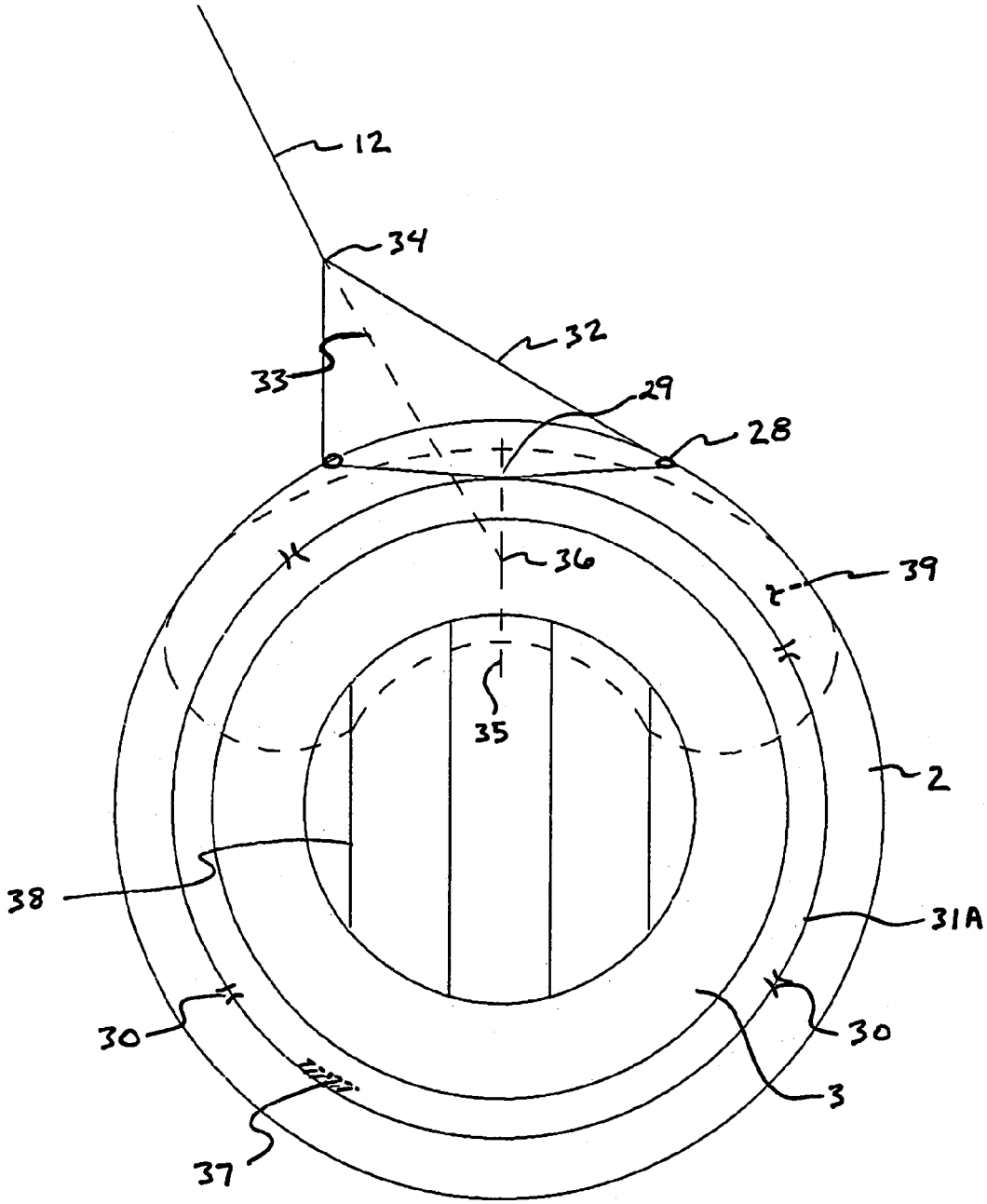
FIG. 17 is a schematic plan illustration of an embodiment of a high maneuverability towcraft according to the present invention.

A further embodiment, shown in FIG. 16B, comprises a steerable towcraft having an abbreviate hull 1, a fabric cover 2, a ventral fin 5, a ventral fin moment center 6, a towline 12, a pulley 12A, a spaced apart fin 14 (one shown) and handgrips 18. The pulley-to-loop connection permits a close-coupled following mode and lateral movement of the towline along the length of the short intermediate loop in response to towcraft hull rotation by its rider. FIG. 17 depicts another alternative embodiment. This steerable towcraft positively shifts the lateral position of the towline's aft termination point 34 by means of the 360 DEG grooved hoop-windlass method 31A in combination with an intermediate rope loop 32. The rope 32, guided by the hoop's groove, is made to cross itself once at point 29, pass over pulleys 28, and then be joined together in a non-sliding fashion with the towline aft termination point 34. Point 37 is where the rope 32 is attached to the hoop-windlass. This embodiment utilizes the smallest sub-frame 39. A ventral fin 35 is firmly attached to the underside of sub-frame 39. Location 36 represents the intersection of the towline's line-of-force 33 and the ventral fin's vertical balanced moment centerline. Loops 30 are provided to guide the 360 DEG hoop-windlass. An inflated, ribbed, floor 38 is provided for riders to sit upon. The ribs should be aligned parallel to the longitudinal axis of the ventral fin 35.

Figure 18:
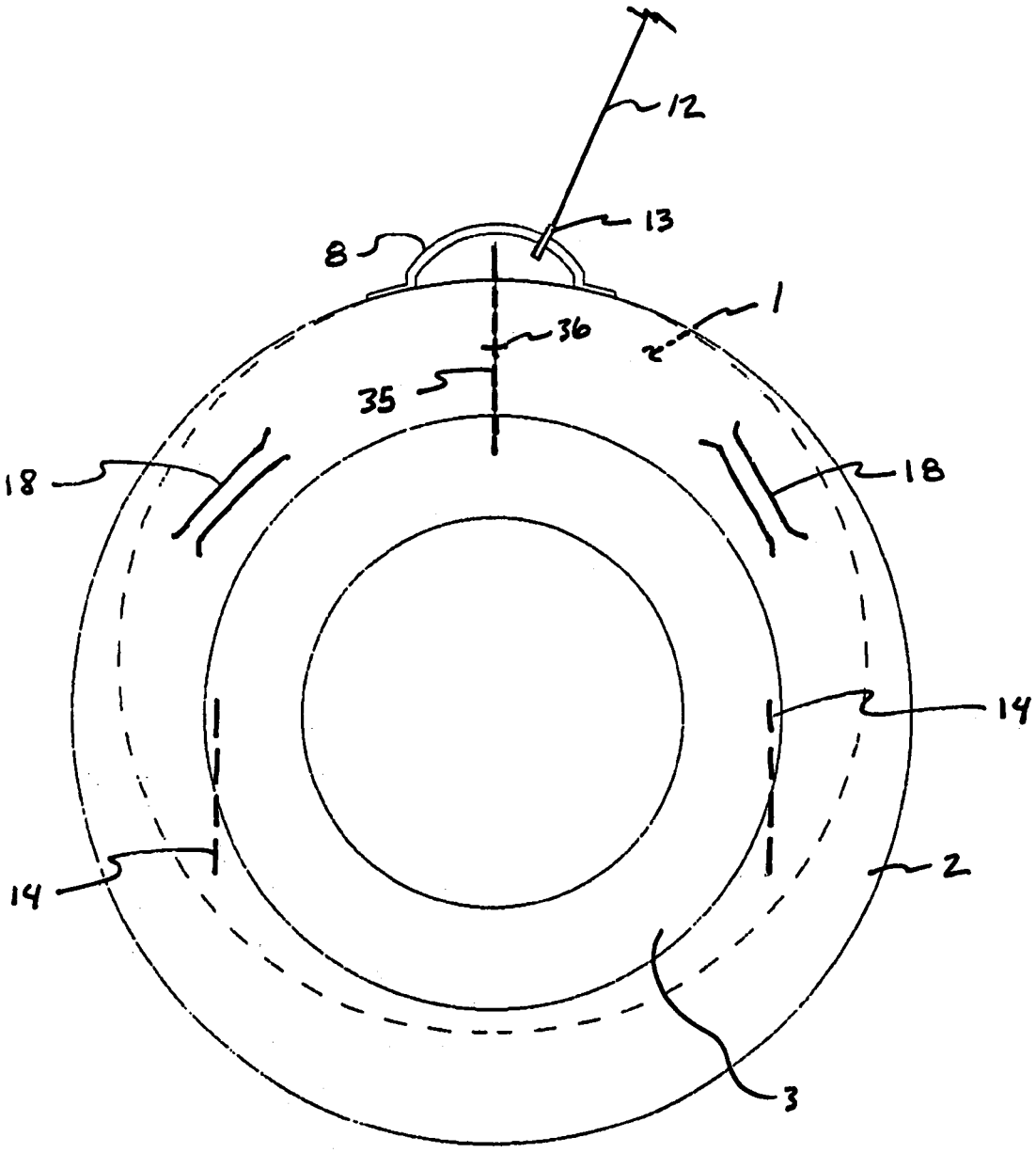
FIG. 18 is a schematic plan illustration of an embodiment of a high maneuverability towcraft according to the present invention.

Another embodiment of the present invention, FIG. 18, is steered wholly by rider leaning (weight shifting). It basically retains the latter embodiment's towline alignment with the ventral fin's areal centrum line (for symmetrically shaped fins) and spaced-apart fin concept but relies, instead, on a passive shifting of the towline's lateral position relative to the front of the towcraft. The deficiencies of the prior art's passive towline lateral shifting method and a separate prior art's steer-by-leaning technique have been overcome by the combination of: a nearly frictionless, and short, traverse of the towline; a balanced, forward-mounted, keel (ventral fin with balanced, or nearly balanced, moments relative to the fin's virtual rotational axis, which, intersects the towline's line-of-force); and, spaced-apart fins preferably mid-mounted and toed-out by no more than an included angle of 20 DEG. Greater fin toe-out angles produce an unacceptable amount of drag and directional instability.

In order to ensure a highly responsive passive-following mode in the lateral traverse or angular displacement of the towline's aft termination, it is particularly important and necessary that its connection means to the front of the towcraft be kept short (if a lateral traverse style) and nearly frictionless. Various types of connection means may be successfully employed. The towline aft termination attachment means may comprise a simple bushing or ring-on-a-pin design, a sliding grommet 13 (or ring) on a short horizontal bail 8, or, a pulley, slider, or ring riding on a short loop of intermediate towline. As in other embodiments of the present invention, the towline line-of-force preferably should be made to pass through the primary water-engaging device's effective center. For example, a ring-on-a-pin design would require that the ventral fin's effective center coincides with the rear portion of the pin on which the ring is made to pivot. Since the pin is located at or near the front of the towcraft's hull, a symmetrically shaped ventral fin must have half of its area ahead of the pin location. This, in turn, necessitates that the ventral fin is rigidly mounted to the hull along the fin's aft portion and that its front half projects forward in a cantilevered fashion beyond the of the hull.

The ventral fin may be located entirely beneath the boundary of the towcraft's hull such that there is no portion thereof which projects, in a cantilever fashion, beyond the front of the hull. One additional iteration of the instant embodiment entails a pivoting towline attachment means which is recessed within the hull by a small distance. A horizontal slot must be provided in the forward section of the hull which enables the towline to pass from side to side, and up and down, in an unrestricted manner as the towcraft turns and pitches while it is being towed. Consequently, a properly sized symmetrical ventral fin may be positioned with its center immediately below the recessed towline pivot point and its front edge even with the front of the craft. Ventral fins whose centers are set back from the towcraft's leading edge are preferably mounted to the front-underside of the hull by non-pivoting means; which, may comprise a screw-on plate, or more preferably, a non-pivoting shaft and screw-on flange arrangement.

Even though the instant embodiment of the present invention utilizes a simple connection means of the towline to, or near, the front of the towcraft, the front of the towcraft is not pulled around towards the boat as in prior art embodiments where simple attachments are used since a balanced moment exists about the towline's effective attachment point to the front of the towcraft through the use of a balanced, or nearly balanced, ventral fin at that towline attachment location.

The closer a ventral fin, rudder, keel or other primary water-engaging device or feature is moved toward the extreme front of a towcraft, the need for an inclined plane, preferably spaced-apart from the body of the towcraft, increases. An inclined plane spaced-apart from the front of the towcraft counteracts a low speed dive tendency caused by the drag associated with the requisite draft of forward-mounted primary water-engaging devices.

It should be noted that the bail approach, as a towline attachment means, is essentially identical to the bail described in the FIG. 1 embodiment. Since the bail is short, on the order of only a few inches, it overcomes the drawbacks associated with the poor responsiveness associated with the passive-following movement of a slider along a long curved track. However, instead of a pivot-able rudder at the origin of the curved bail's radius, the instant embodiment of the present invention shown in FIG. 18 utilizes a fixed ventral fin 35 with its effective center at the curved bail's origin. The towline slider ring 13 is made to passively follow, or to adjust to, the towcraft's changing orientation in the water. Craft rotation is able to proceed up to the slider ring's limit of travel on the bail 8. At that point, angular displacement of the towcraft to one side of the boat is restricted to approximately one half of the bail's total angle of curvature.

One or more riders (depending on the style of towcraft) can use with fixed handholds 18 (straps, fixed handlebar, etc.) that are conveniently placed for riders to securely grip, instead of a steering hoop, pivot-able handlebar, or tiller. Fixed handgrips provide a superior means for riders to be able to control their position on the craft. This is especially advantageous for the instant embodiment since weight shifting, or leaning, is the sole means whereby the towcraft is steered.

The craft is steered by means of rider leaning, or in the case of multiple riders, cooperative leaning or weight shifting. Whichever side of the craft is buried deeper in the water due to a leaning action, that side will experience a greater parasitic drag than the opposite side. A differential drag between the left side of the craft and the right side causes the side experiencing the greater drag to induce a small rotation of the craft such that the side experiencing the greater drag is in a more trailing relationship relative to the position of the towline's attachment point to the towcraft. By having the leading edges of the spaced-apart fins slightly further apart than their trailing edges (toe-out), the more angled fin, with respect to the direction of travel, "powers" a larger horizontal rotation of the craft about the ventral fin's zero moment line. As the front of the craft begins to rotate to the right due to a weight shift to the right, for example, the right fin presents greater side surface area to the oncoming flow of water. The left fin, however, is now situated such that it is directly aligned with the flow of water passing it. As a result, the right fin adds further resistance in the form of drag to the right side of the craft, while the left side of craft actually experiences a reduction in drag; which, provides the necessary torque, or moment, to "power" the rotation of the towcraft in the water, about a virtual vertical pivot axis. A continuing rotation of the craft to the right is limited by a gradually increasing drag of the left fin which affords directional stability. In practice, only small rotational displacements from any instantaneous orientation is required to effect a lateral shift of the towcraft in the water for maneuverability purposes. Expressed in another way, there is very little discernible rotation of the towcraft as it is steered from one side of the boat to other while at planing speeds. Though, at sub-planing speeds, considerably more hull rotation is required.

While the steering directional rate-of-change is controlled to a certain extent by the amount of rider lean, or weight shift, towcraft responsiveness is built-in, though, it may be tailored to suit rider preference. Towcraft responsiveness is determined by the degree of the spaced-apart fins' toe-out and the overall separation distance of the two fins. The steering responsiveness may be controlled by varying the included angle between the two fins. Parallel fins have a much lower steering response rate than fins whose included angle is as much as 15 DEG. However, excessive toe-out can impose a severe drag penalty and can introduce a directional instability. Fin-fin included angles greater than 20 DEG makes the towcraft unstable such that even small, unintentional, weight shifts of the rider(s) on the towcraft can make the craft dart back and forth uncontrollably. This may be remedied somewhat by ensuring that the spaced-apart fins are of the flexing type, previously described. Therefore, the preferable fin—fin toe-out of the instant embodiment should be within the range of included angles of 1 DEG and 20 DEG. More preferably, the included angle should fall between about 3 DEG and 15 DEG. The fin—fin included angle may be made adjustable in order to adapt towcraft handling to the rider's preference. Spaced-apart fin toe-out can be made controllable by the rider while underway on the water. Use of a non-pivot-able handlebar with a spring-return twist-grip cable connected to the trailing ends of the spaced-apart fin mounts can be used to pull those ends toward each other thereby providing a few degrees greater toe-out than when the twist-grip is released.

Craft rotation is also controlled to a certain degree by the average, or overall, separation distance between the two fins. Closely spaced-apart fins produce less torque, or moment, than that which is developed by widely spaced-apart fins. Torque about the craft's virtual vertical pivot axis is the driving force behind craft rotation of this embodiment. Torque, or moment, is the product of force and the moment arm, or distance, at which it acts. In this case, a fin's moment arm is its distance from the craft's virtual pivot axis. Therefore, by spacing the fins further from the craft's center-of-rotation, the reaction force of a fin diverting water acting through a longer moment arm, causes a greater torque to be developed than what would be possible for a narrower fin—fin spacing.

Advantages of this alternative embodiment of the present invention include: simple, low cost, lightweight construction (no steering rudder assembly); rider(s) are able to securely grip and remain on craft despite varying water conditions or craft maneuvering actions; good ability to achieve SOA of 45 DEG or greater; intuitive steer-by-leaning which is easy to master; and, a wide range of towcraft styles are possible.

While low manufactured cost, simplicity of design and operation, and a superior capability for a rider to remain on the craft under all conditions are hallmarks of this instant embodiment, one minor drawback is that when airborne, during a jump maneuver, the towcraft rotates horizontally in mid-air such that the ventral fin is no longer properly aligned with its quasi-trajectory flight (influenced by towline tension). When the craft once again re-enters the water at the conclusion of a jump maneuver, the ventral fin is often at a severe angle-of-attack relative to its direction of travel thus causing a sideways (rolling) spill to take place, unless, the rider has sufficiently shifted his or her weight in anticipation of this potential occurrence. To the rider's advantage, fixed handgrips helps the rider to remain on the craft despite such a lateral deceleration and a subsequent acceleration. The preferred embodiment of the present invention does not suffer from this degree of lateral deceleration due to the ability for the rider to be able to independently steer the rudder in the direction of travel. On the other hand, some "extreme" sports enthusiasts may elect to capitalize on the present invention's lateral braking ability in order to perform intentional rolling maneuvers as a stunt, or as an advanced skill level in competition events.

A variation of the steer-by-leaning method is for the rider to be able to independently vary the orientation of the spaced-apart, mid-mounted fins while the towcraft is underway. Instead of using rider weight shifting to create a differential drag between the left and right side of the towcraft for the purpose of inducing a "powered steering" rotation of the hull and attached ventral fin, one of two spaced-apart fins are rotated outward (toed-out) at a time as a means of creating a differential drag. One technique is to incorporate twist grips in a fixed (non-rotatable) handlebar. The interconnected twist grip cabling is made to run from each handlebar grip to the spaced-apart fins. The twist-grip fin control algorithm is as follows:

1. Rotation of one twist-grip causes the other twist-grip to rotate in the opposite direction.
2. When the twist-grips are at their spring-centered neutral (at-rest) position, the spaced-apart fins are aligned parallel with each other and the longitudinal axis of the towcraft.
3. Rotating the right twist-grip counter-clockwise (when viewing the end of the right twist-grip) from the neutral position causes the right fin to be rotated clockwise (when viewed from above). The left fin remains in a straight-ahead configuration.
4. Rotating the right twist-grip back to the neutral position causes the right fin to rotate counterclockwise back to the straight-ahead position.
5. Rotating the left twist-grip clockwise (when viewing the end of the left twist-grip) from the neutral position causes the left fin to be rotated counter-clockwise (when viewed from above). The right fin remains in a straight-ahead configuration.
6. Rotating the left twist-grip back to the neutral position causes the left fin to rotate clockwise back to the straight-ahead position.
7. The fins cannot be rotated simultaneously, only sequentially.

The above action may be accomplished by having each twist-grip control cable actuate its respective fin only when it is pulled from the neutral position. Cable "push" from the neutral position merely causes the cable to be extended without incurring any action on the part of the fin. A "stop" on the cable engages a matching recess on the fin control lever during a "pull" action. Whereas, there is no such engagement feature on cable extension past the neutral position. In this way, two separate twist-grip controls may be used to independently control fin toe-out in a sequential manner.

The spaced-apart fins, preferably, should be of a balanced design. This lessens the load for the cables controlling fin toe-out. Stops can be provided to prevent each fin from rotating inwardly to a toe-in attitude. Springs preferably should be used to assist in returning the fins to their straight-ahead position.

Since the instant embodiment of the present invention does not rely on rider leaning for a steering maneuver, this type of towcraft steering method may also be applied to a wide range of towcraft styles.

Figure 19:
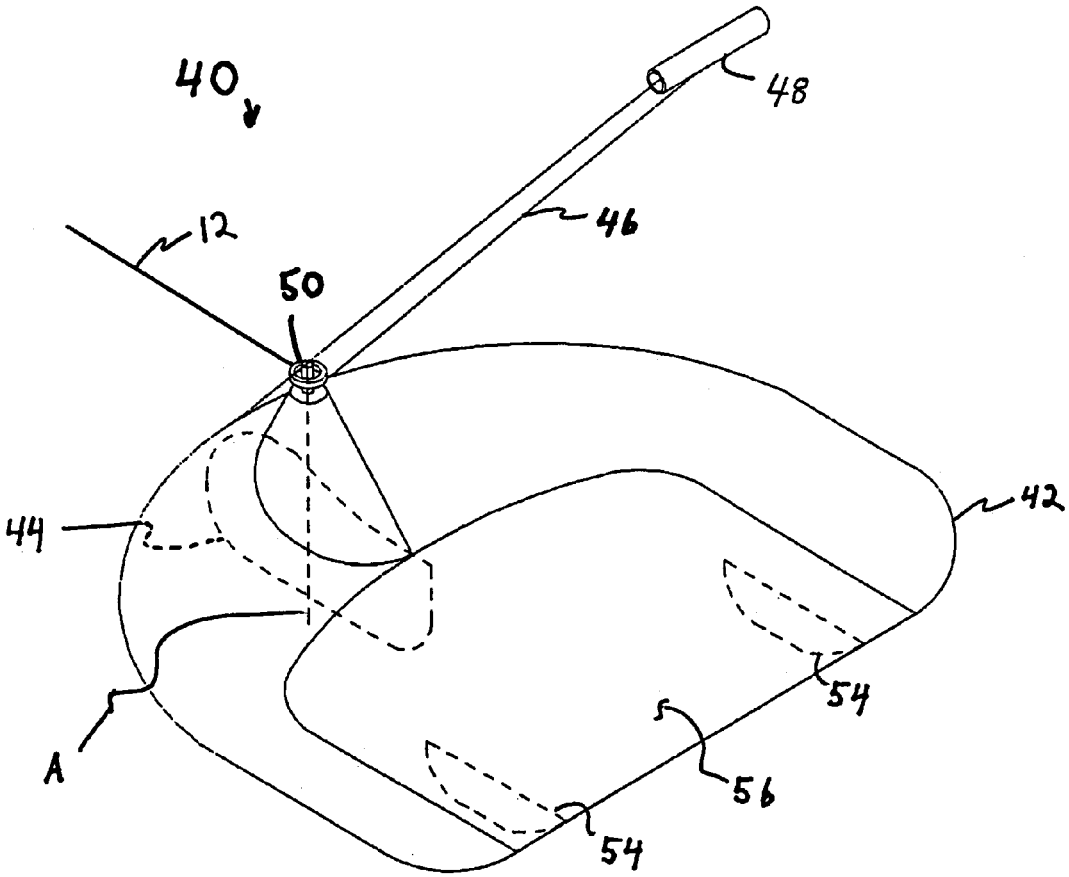
FIG. 19 is a schematic perspective illustration, partially in phantom, of an embodiment of a high maneuverability towcraft according to the present invention.
Figure 20:
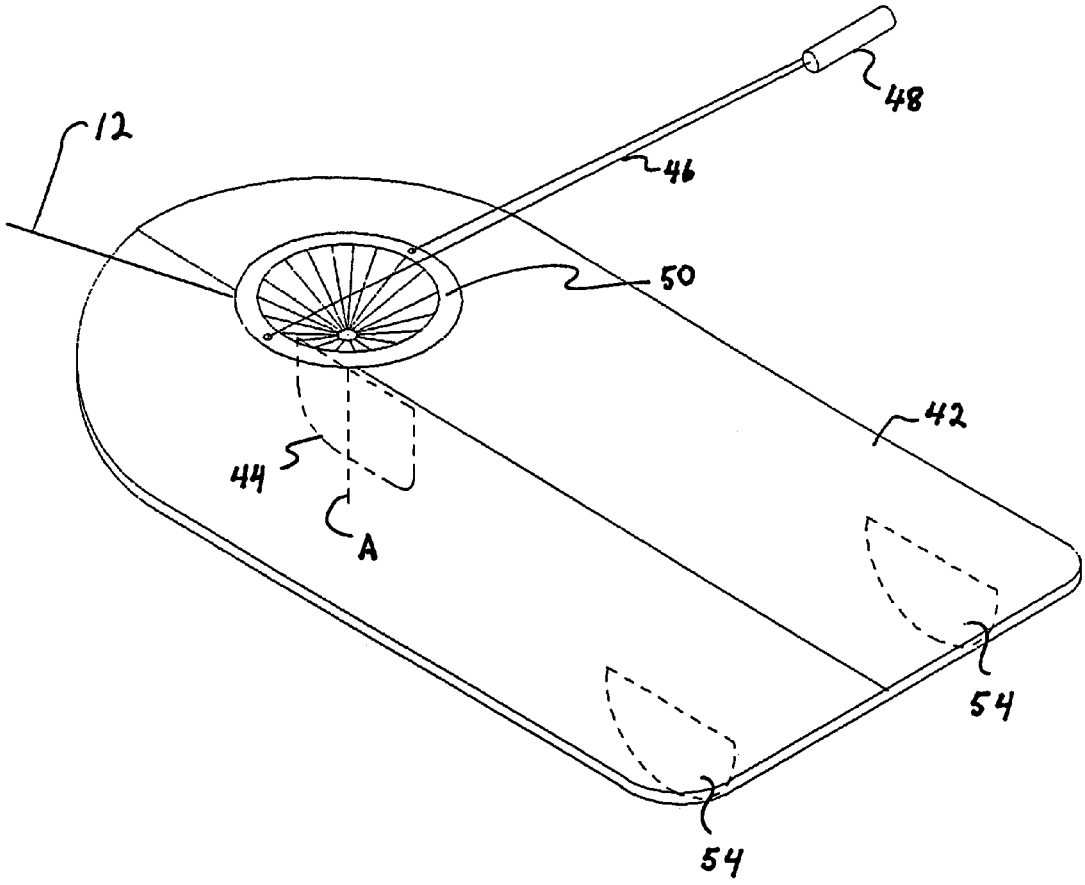
FIG. 20 is a schematic perspective illustration, partially in phantom, of an embodiment of a high maneuverability towcraft according to the present invention.

A still further embodiment of the present invention entails a tow board, or a knee board 40, FIGS. 19 and 20, on which a rider may stand or kneel. In operation, it may be configured to be steerable by either: pivoting a forward balanced, or nearly balanced, rudder in the manner of the FIG. 1 embodiment of the present invention, by leaning, or by differential control of spaced-apart fin toe-out just described. The advantages of a steerable towcraft are also applicable to a steerable tow board. Towline tension is transferred directly to the tow board instead of through the rider's arms, torso, and legs. A steerable tow board 40 designed for standing riders, in one embodiment, utilizes a forward mounted pivoting rudder, or ventral fin, 44 which is preferably controlled by means of a dual control line 46 connecting a cylindrical handgrip 48 to the opposed lateral sides of a rudder control wheel 50 (steering wheel). The towline 12 is preferably attached to the rudder shaft housing 52 in a pivoting manner. The towline attachment elevation is below that of the rudder control wheel. One ventral, or two spaced-apart fins 54 are located at or near the aft end of the tow board. A standing rider by leaning back and holding onto the handgrip 48 with one or both hands is able to maintain a tension in the dual control lines 46. Directional control of the tow board 40 is achieved by exerting a greater pull on one end of the handgrip while relaxing the tension on the other end. Rocking the handgrip in this manner causes the rudder control wheel, and its connected rudder, to rotate as well.

A standing style of steerable tow board may be easily converted for use by kneeling riders. All that is required is for the dual control lines to be removed from the opposed sides of the rudder control wheel. A kneeling rider would simply grasp the horizontally disposed steering wheel and steer and lean in the desired direction of travel. Steerable tow boards, preferably, should have at least a portion of upper surface covered with a cushioning material 56 which provides a cushioned support for rider's knees, and, to prevent standing rider's feet from slipping.

It should now be readily apparent to those practiced in the arts to be able to apply the designs and methods herein described involving: the application of a forward, balanced, pivoting rudder whose pivot axis is, or nearly, intersected by the towline's line-of-force at all normal towing angles; weight shifting; and differential fin control principles and other details of steerable towcraft to tow boards and other styles of towcraft not specifically detailed herein.

Figure 21A:
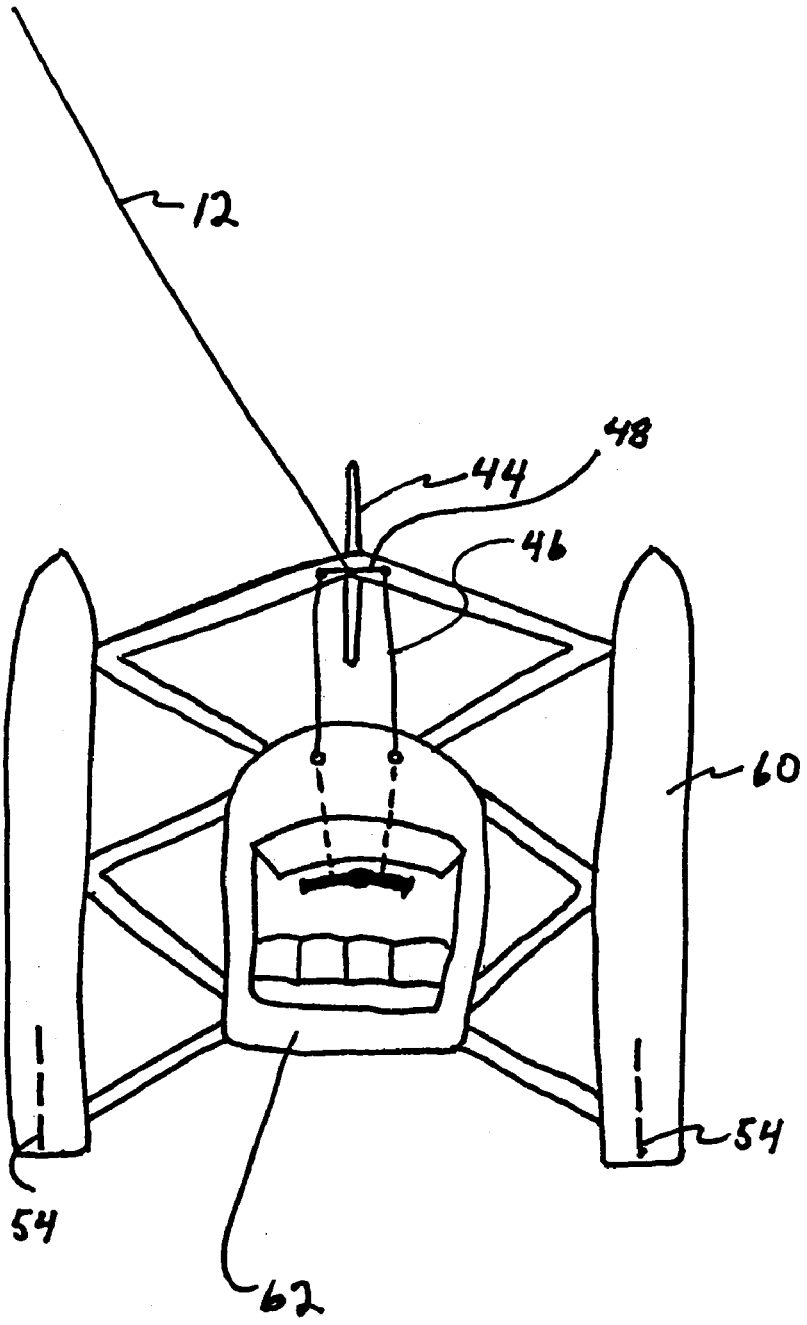
FIG. 21A is a schematic perspective illustration, partially in phantom, of an embodiment of a high maneuverability towcraft according to the present invention.

For example, FIG. 21A depicts a dual cylindrical-hulled catamaran configured as a steerable towcraft having a body, or pod, 62 by using the forward-pivoting-balanced-rudder 44 and a differential mid-fin control. A forward mounted pivoting rudder 44 is preferably controlled by means of a dual control line 46 connecting a cylindrical handgrip 48. The towline 12 is preferably attached to the catamaran in a pivoting manner. Two spaced-apart fins 54 are located at or near the aft end of rigidized inflated catamaran hulls 60, or pontoons, which are preferred, at least, for differential fin control steering due to the minimal draft of the tubes in the water. Differential fin control steering requires that the hull not interfere with the rotation of the towcraft in the water. Smoothly rounded cylindrical hulls, or pontoons, do not adversely affect steering or tracking of this style of towcraft. However, knife-edge hulls are suitable for towcraft utilizing the forward-pivoting-balanced-rudder style of steering control, provided, extreme maneuverability (directional rate-of-change) is not required. Long narrow hulls act as extended fins in slowing the towcraft's directional rate-of-change. A slight toe-out of the hulls can offset the inherent directional stability of this hull design thereby enabling somewhat higher steering rates. It should be noted that the boat driver and observer must be aware and take appropriate action if a steerable towcraft is known to have a slower turning rate (DEG/SEC) than that of the boat.

Figure 21B:
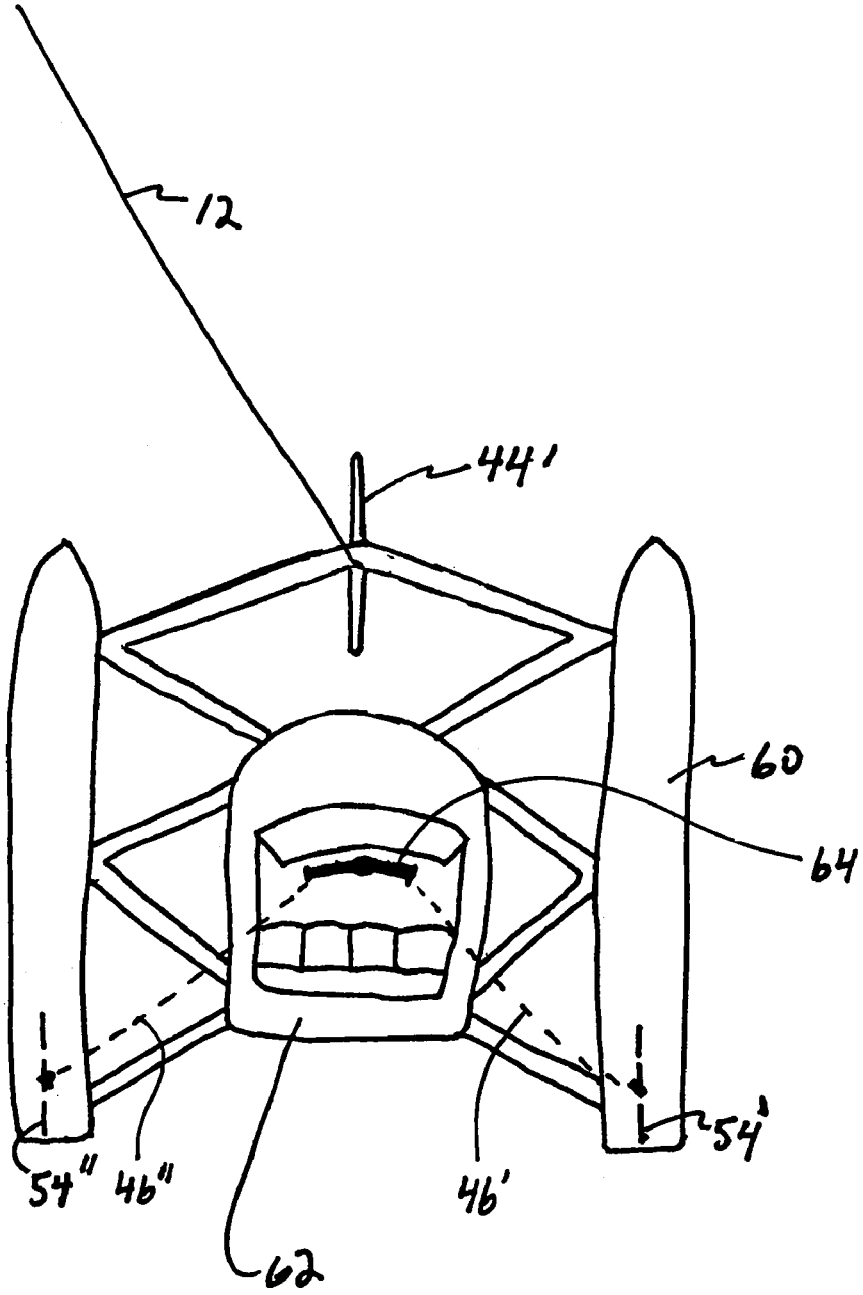
FIG. 21B is a schematic perspective illustration, partially in phantom, of an embodiment of a high maneuverability towcraft according to the present invention.

Another example, shown in FIG. 21B, depicts a dual cylindrical-hulled catamaran configured as a steerable towcraft by using a fixed forward ventral fin 44. The towline 12 is preferably attached to the catamaran in a pivoting manner. Two spaced-apart fins 54' and 54" are located at or near the aft end of rigidized inflated catamaran hulls, or pontoons 60. The fins 54' and 54" are preferably controlled by means of control lines 46' and 36", respectively, which are connected to a steering assembly 64.

In yet another aspect, the forward pivoting rudder style of FIG. 1 may be made convertible to a fixed forward ventral fin style which is steered by rider leaning. As shown in FIG. 1A, this is accomplished by locking the rudder in a straight-ahead configuration (using a thru-pin, clamping collar, or other means) and, optionally, by removing the rear-most fins for greater maneuverability, if they were previously installed. Handily, the towline line-of-force already is already made to intersect the balanced primary water-engaging device (pivoting rudder). In essence, a HMT enthusiast may now enjoy two distinctly different steering styles in one basic package.

FIG. 1A depicts a convertible embodiment between a pivoting forward rudder style and a stationary forward rudder style by a Lock-N-Lean™ technique. To revert back to a pivoting rudder type of operation, the handlebar is simply returned to its unlocked state.

Another improvement embodied in the present invention is the steer-by-leaning configuration in which a non-pivotable (stationary) handlebar is fitted to the towcraft such that it extends slightly beyond the front of the towcraft's hull. A favored position for most towcraft riders is a prone position since it affords a low center of gravity. Also, it lends a sense of high speed due to the rider being very close to the surface of the water. Prior art towcraft (claimed steerable or not) have handgrips which are incorporated into the body of the towcraft. However, when lying prone on dimensionally smaller towcraft, it is desirable for the rider's weight to be fully supported by the body of the towcraft, as opposed to having part of the torso or the legs continuously dragging in the water. Further, it is desirable for the rider to be able to shift his or her weight sideways and forward and backward easily without needing to release or change their grip. A forward fixed handlebar allows the rider's weight to be advantageously moved generally forward on the towcraft. Greater maneuverability is achieved when the rider's center of gravity at least nearly coincides with that of the towcraft. Also, the rider is able to remain with craft and accurately control weight shifting with the forward-placed handlebar. Normally, the rider would not need to shift one hand to an auxiliary grip in order to be able to remain on the craft, except perhaps, after a high speed jump maneuver.

Single-rider versions of the present invention's steer-by-leaning handleability may be augmented by the rider using one foot or the other to create a momentary transverse differential drag. When leaning is augmented in this fashion, the amount of lean required to negotiate a turn may be advantageously reduced. Further, leaning augmented by an external-to-the-towcraft source of transverse differential drag increases the towcraft's rate-of-turn capability. The forward-most handlebar position of this invention allows the rider's weight to be supported such that the rider's legs rest easily above the waterline without incurring any drag penalty. When making a turn, it is a simple matter for the rider to lower one foot to the water. For example, when maneuvering to the right, a rider would lean or shift to the right and drag the right foot in the water (to the right of the towcraft's longitudinal centerline). This differential drag between the left and right sides of the towcraft causes it to rotate and travel to the right due to the balanced forward primary water-engaging device (ventral fin/fixed rudder), spaced-apart mid-fins, and allowance for the towline line-of-force to always pass through the moment center of the primary water-engaging device. Once the towcraft is offset to one side of the boat and traveling in a straight line, parallel to that of the boat, the rider's foot may then once again be lifted from the water. A simple weight shift, or lean, by the rider is sufficient in order to maintain the towcraft at its offset angle with respect to the boat.

Another embodiment to the present invention has inwardly-curved, spaced-apart, mid-fins in which the rigid, fixed, forward portions thereof are made parallel to each other. The trailing portions of each fin are made flexible in the manner and techniques described above. Additionally, the rear, flexible, portion of the mid-fins are configured such that in the at-rest state, they appear to curve smoothly inward (toward each other). This configuration provides several benefits without incurring a serious drag penalty. At low towing speeds, a greater drag differential between the right and left sides is required in order to exert the necessary torque or moment on the hull in order to cause its rotation in the desired direction of travel. However, at higher towing (planing) speeds it is desirable that there generally exists a minimal drag condition between the towcraft hull, its attachments, and the water. Fins having parallel, rigid, forward portions and flexible, inwardly curved, aft portions, satisfies these two needs by flexing and straightening-out when subjected to higher speed water flow; thereby, decreasing drag over a toed-out straight fin orientation in which the leading portion thereof is permanently set in a toed-out configuration. Fins of the present invention may be fabricated from a fiber-reinforced laminate which is molded to the curved shape. Additionally, the flexible trailing portion of the subject fin may be molded with a slight "twist" set in the molded article. This twist helps the fin to maintain a positive-to-neutral camber during flexing, which in turn, helps the fin to maintain its "bite" with the water during rapid direction changes. On the other hand, the inwardly curved fins also aids reentry of the towcraft into the water after a jump maneuver, if for example, the towcraft happens to reenter the water in a sideways attitude. Water approaching the outside surface of the curved fin causes it to bend inward further, reducing a fin braking, or sideways rolling, tendency.

Figure 22:
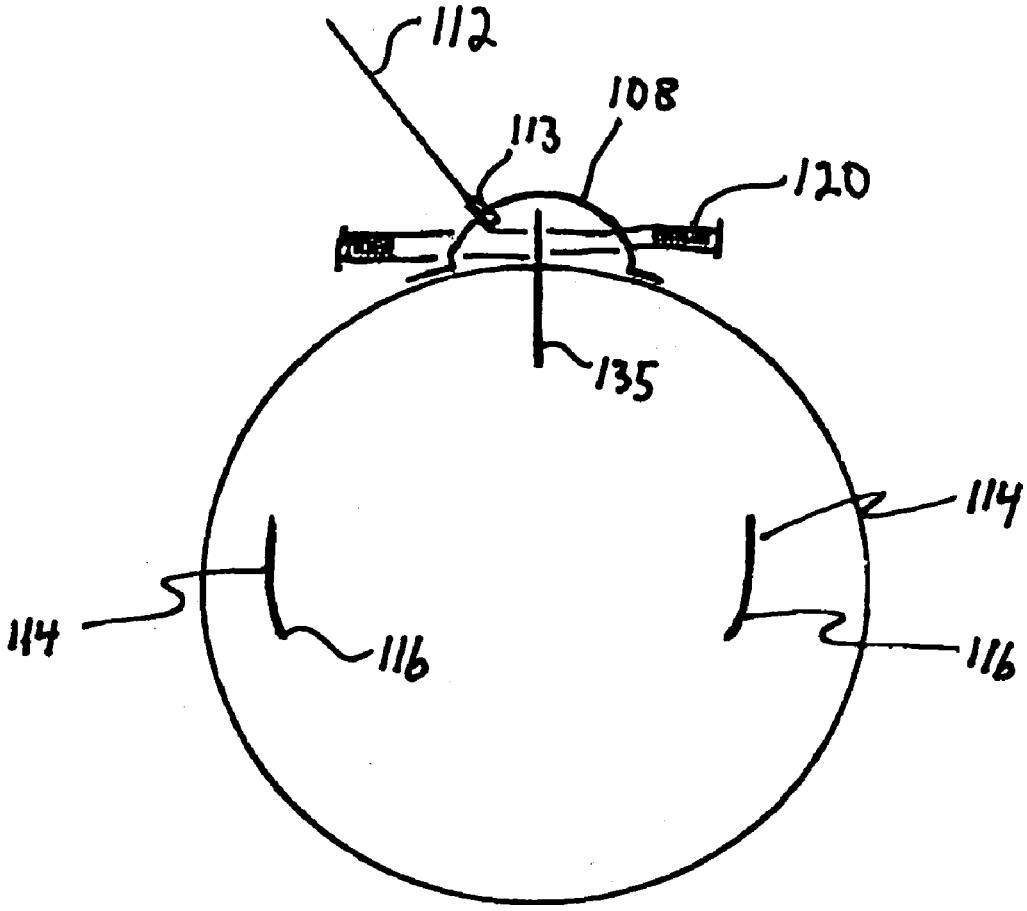
FIG. 22 is a schematic perspective illustration of an embodiment of a high maneuverability towcraft according to the present invention.

FIG. 22 depicts an embodiment of the present invention having a forward ventral fin 135 which comprises the primary water-engaging device; spaced-apart, parallel-aligned, mid-fins 114, each having a trailing portion 116. Each trailing portion 116 is at least sideways flexing and inwardly curved. A stationary forward-most handlebar 120 (non-pivoting) and a towline attachment means 113 and bail 108 are operatively connected to the towcraft. The towline attachment means 113 and bail 108 ensure that the towline line-of-force continuously intersects the primary water-engaging device's vertical moment center line.

The present steer-by-leaning embodiment may be made more maneuverable is for the rider to not only use a minimal leaning or weight-shifting as a means of increasing parasitic drag of one side of the towcraft's hull while decreasing parasitic drag of the hull's opposite side for the purpose of initiating hull rotation, but also increase the lean or weight shift nominally such that the opposite fin actually begins to disengage from the water by being gradually lifted out of the water. This differs from prior art attempts at fin steering in which a very steep, or severe, sideways tilt of the towcraft is required in order to fully engage the operative fin in the water. To have one spaced-apart, downward-projecting, fin only partially, or even fully out of the water does not incur what might be considered to be an excess leaning action. The prior art steering principle may be summarized accordingly: one spaced-apart fin or the other alternately engages water only when the craft is severely tilted, whereas, in the present invention, both spaced-apart fins are initially in full engagement with the water, and then upon a gradual, moderate-angle tilting of the hull, a gradual decoupling of one fin at-a-time from the water ensues. A gradual decoupling is possible due to the leading-trailing ends of the mid-fins having sloped edges which are either straight, curved, stepped, or any combination of the three.

Figure 23:
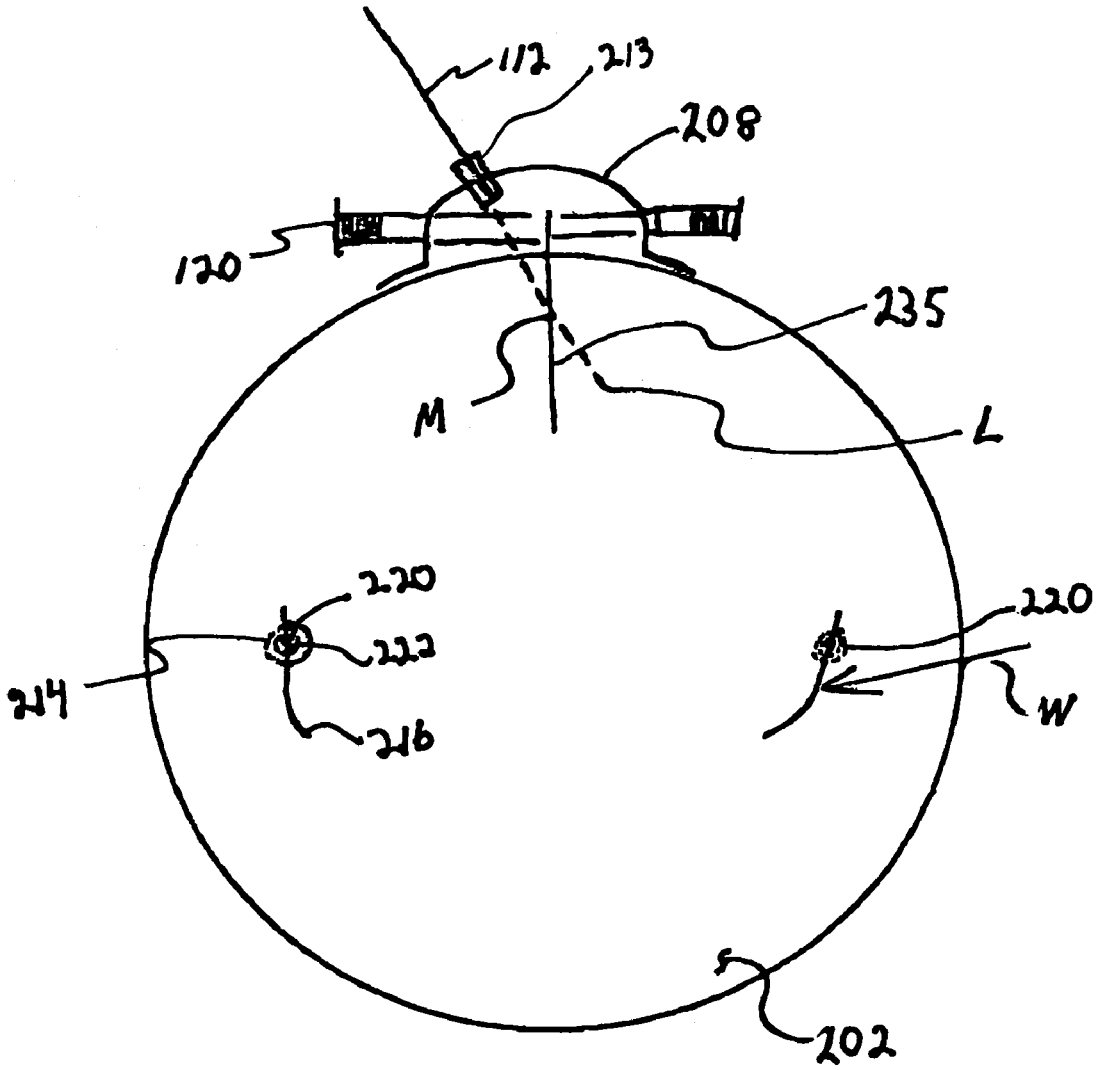
FIG. 23 is a schematic plan illustration of an embodiment of a high maneuverability towcraft according to the present invention.

FIG. 23 depicts another embodiment having a forward ventral fin 235 (which comprises the primary water-engaging device) having a moment center M through which extends a towline line-of-force L; spaced-apart, parallel-aligned, mid-fins 214, each having a trailing portion 216. Each trailing portion 216 is at least sideways flexing and inwardly curved. A stationary forward-most handlebar 120 (non-pivoting) and a towline attachment means 213 and bail 208 are operatively connected to the towcraft. The towline attachment means 213 and bail 208 ensure that the towline line-of-force continuously intersects the primary water-engaging device's vertical moment center line. The mid-fins 214 additionally feature a pivoting capability in which the aft portions 216 of each spaced-apart fin 220 may be made to pivot inward (from its at-rest position) when acted upon by the force of water striking their outside surfaces.

In this further embodiment the fins 214 are pivotable about a vertical axis. The leading edges of straight or curved, spaced-apart, fins are maintained parallel or slightly toed-out with respect to each other in the at-rest state by means of a spring 220 and stop 222 which are located in a small recess above the fin 214 and below the hull 202. The vertical pivot axis is located a short distance ahead of the fins' moment center, and behind its leading edge. The force of water W striking the outside surface of either fin causes that fin's trailing portion to rotate inward thereby relieving the force of the water acting on that outside surface. The spring strength may be set according to rider weight and maneuverability preference. The stop 222 prevents the fin 214 from rotating outward any further than the stop permits. Allowing the fins to respond by rotating when water strikes their outside surfaces, but not when water strikes their inside surfaces increases maneuverability by making more rapid direction changes possible and further reduces a rolling moment when the towcraft makes an off-angle reentry into the water.

Alternatively, each mid-fin may be made in two parts. The front part of each mid-fin may be rigidly mounted to the underside of the hull in a non-flexing and non-pivoting manner. The aft part of each fin may be made pivotable, with its trailing portion inwardly movable. The aft fin part is made pivotable about a vertical line at the joint between the two fin parts. However, the former, one-piece, pivotable fins are preferred due to a lower resistance or drag from water striking their 100% pivotable outside surfaces; which occurs, for example, after the conclusion of jump a maneuver.

A still further embodiment of the present invention is the discriminate use of spaced-apart water scoops when making direction changes. One style of towcraft that can benefit from differential braking in this manner is the type depicted in FIG. 21. While not a steer-by-leaning style, it does share the differential drag steering principle for causing a hull rotation. However, the water scoops of the present invention are very narrow hollow structures with an elongated opening along the leading edge. The hollow fin is internally radiused such that impinging water striking the internal radius feature is directed upward and out through an opening thus creating a vertical, or angled, spray of water. This feature is distinguished from the prior art in that the scoop is incorporated into a fin thereby reducing the amount of drag associated with larger scoops. If the opening in the fins' leading edge is narrow enough, the amount of drag associated with accelerating a small stream of water upward would be negligible. Therefore, fins of this type would still need to be rotated (leading edge of fin rotated away from the craft's centerline) alternately in order to create a differential drag condition between the left and right sides of the craft. Though, for fins which have a wider leading edge gap, or opening, they would need to use a sliding gate, an internal valve, or a pivoting leading edge which opens or closes the leading edge gap of the fin. These control methods may be easily and operatively connected by means of a cable and casing, preferably, to the steering device; whether it is a handlebar or steering wheel. Handlebar or steering wheel control methods are preferable in that the operator not need to remove his hands from the steering device. Cable actuation may be made by rotating the wheel or handlebar, or, by means of twist-grip controls on a non-rotating/pivoting steering wheel/handlebar. Alternatively, cable actuation of the fins may be accomplished by means of foot pedals in the manner of rudder pedals on an airplane since the towcraft operator is in a seated position.

Though, preferably, differential drag should in every case be predominantly modulated by the alternate pivoting of the respective fin, rather than by the partial application of water diversion through a fin scoop. If pluggage of a fin's narrow internal passageway were to occur, it should not in a way interfere with the maneuverability of the towcraft. Its only effect would be a cessation of the "roostertail", a condition of minor importance.

Figure 24:
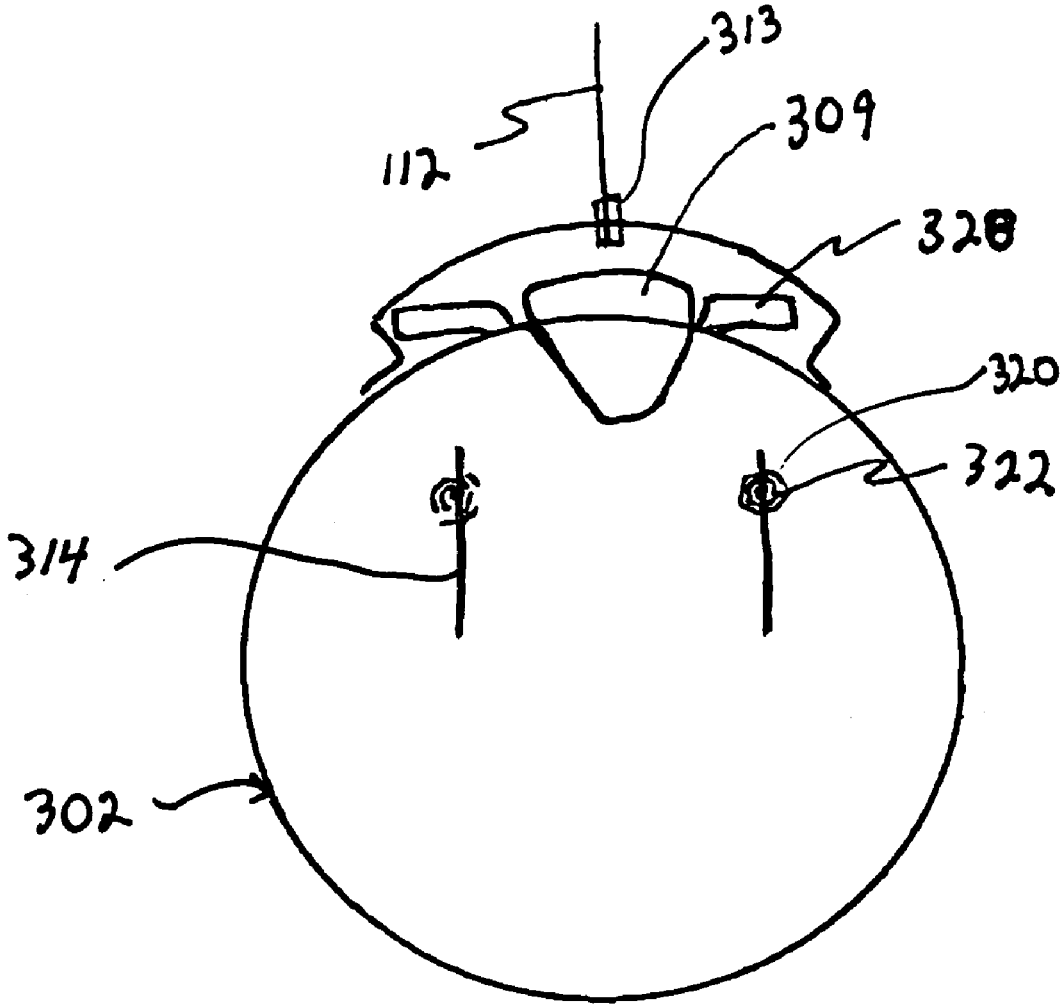
FIG. 24 is a schematic plan illustration of an embodiment of a high maneuverability towcraft according to the present invention.

A still further embodiment of the present invention, shown in FIG. 24, comprises a longer, curved, horizontal bail 308 (for example, up to 30" in circumferential length) and slider arrangement 313 in which the bail's center-of-curvature intersects the effective mid-point as represented by an imaginary vertical line between two spaced-apart, straight, parallel-aligned, pivoting, primary water-engaging fins 314 of sufficient draft in which the fins' side area "necks down" adjacent to or near its attachment means to the towcraft's hull for the purpose of making the towcraft less sensitive to changing water conditions; a forward inclined plane 309 spaced-apart from the hull 302; and, a stationary forward-most handlebar 328. It is also within the contemplated scope of this embodiment that the fins 314 are pivotable about a vertical axis. The leading edges of straight or curved, spaced-apart, fins are maintained parallel or slightly toed-out with respect to each other in the at-rest state by means of a spring 320 and stop 322 which are located in a small recess above the fin 314 and below the hull 202.

It is also not to be inferred that any one embodiment is necessarily better than another. Particular embodiments may be better suited to certain functional criteria than other embodiments. In some intended applications, extreme maneuverability might be paramount; which calls for the highest possible towcraft maneuvering capability. While in another application, being able to tow multiple riders on a single steerable towcraft is most important; which calls for yet a different steering method. Or, in another steerable towcraft application, importance might instead be placed on an economical construction. The first and preferred embodiment of the present invention is simply a matter of individual preference by the inventors of high maneuverability towcraft.

The present invention may be successfully configured according to a number of different designs and styles. It is not to be inferred that the present invention and its embodiments are limited to the methods and applications described herein, but rather, that they are shown as ways of how the invention might be practiced and are inclusive of any anticipated refinements as long as the spirit and scope of the present invention is preserved. For example, the connecting means can have a U shape which is attached to the front of the towcraft's hull. Thick foam or elastomeric washers can be placed above and below the towline's aft termination maintains its elevation relative to the U-bracket. The washers also eliminate the U-bracket extensions as hard point areas by acting as cushioning means since the washers are made to project beyond the front and side extent of the U bracket connecting means.

The principle and mode of operation of this invention have been described in its preferred embodiments. However, it should be noted that this invention may be practiced otherwise than as specifically illustrated and described without departing from its scope.

What is claimed is:

1. A high maneuverability towcraft capable of being towed by a boat on water, the towcraft having a waterline, the towcraft comprising:

a pivotable primary water-engaging device operatively attached to the towcraft, the primary water-engaging device being positioned beneath the towcraft and having a primary water-engaging surface, a neck that is positioned above the primary water-engaging surface and is narrower than the primary water-engaging surface, and a pivot shaft mounted above the neck for rotating the primary water-engaging device, a steering assembly operatively attached to the towcraft and connected to the primary water-engaging device to enable the towcraft to be steered;

a tapered inclined plane mounted to the primary water-engaging device; and a towline attachment member operatively attached to the towcraft.

2. The high maneuverability towcraft of claim 1, wherein the primary water-engaging means has at least a partially balanced front/rear areal moment ratio such that a product of a first area in front of the pivot axis and its effective moment arm from the pivot axis is either equal to or somewhat less than a product of a second area to the rear of the pivot axis and its effective moment arm from the pivot axis whereby the ratio of these two products is expressed by: ($\text{area}_{front}\times$ effective moment $\text{arm}_{front}$) divided by ($\text{area}_{rear}\times$effective moment $\text{arm}_{rear}$).

3. The high maneuverability towcraft of claim 2, wherein the front/rear areal moment ratio is at least about 30/70.

4. The high maneuverability towcraft of claim 1, wherein the primary water-engaging device comprises a pivoting rudder.

5. The high maneuverability towcraft of claim 4, wherein the rudder is adapted to allow controlled steering and tracking of the towcraft.

6. The high maneuverability towcraft of claim 1, further including spaced-apart fins operatively attached to the towcraft wherein the fins have at least one of: flexible trailing portions such that the fins are capable of flexing both sideways and in the camber direction, or flexible trailing upper edges such that the fins are capable of flexing the trailing upper edges away from oncoming water, thereby increasing the engagement of the fins with the water.

7. The high maneuverability towcraft of claim 1, further including a means having a forward inclined plane operatively connected to and in a companion pivoting relationship with the primary water-engaging device, the means having a forward inclined plane being positioned substantially above the primary water-engaging surface and below the towline attachment location.

8. The high maneuverability towcraft of claim 1, wherein the towcraft comprises a smooth bottom surface that is predominantly planar or slightly concave, the bottom surface having a sharp break along an aft edge of the towcraft for canceling a Coanda Effect and its associated drag on the towcraft.

9. A high maneuverability towcraft configured to be towed in water by a towline, the towcraft having a waterline, the towcraft comprising:

at least one primary water-engaging device positioned beneath a plane defined by the water line and mounted for pivoting about a pivot axis;

a tapered inclined plane mounted to the primary water-engaging device; and a tow line attachment member for attachment of a tow line to the towcraft, the tow line attachment member being configured so that a line of force along the towline substantially intersects the pivot axis at a point above the plane defined by the water line regardless of an angle between the tow line and a center line of the hull.

10. The high maneuverability towcraft of claim 9, including a steering assembly mounted on the towcraft.

11. The high maneuverability towcraft of claim 9, wherein the primary water-engaging device has a forward end and a rearward end relative to the pivot axis, and wherein a ratio of the effective moment of a side profile of the forward end to the effective moment of the side profile of the rearward end is within the range of from about 40 to about 100 percent.

12. The high maneuverability towcraft of claim 9, wherein the towline is attached to the towcraft with a forward-mounted, curved bail.

13. The high maneuverability towcraft of claim 9, wherein the towline is attached to the towcraft with an intermediate line.

14. A high maneuverability towcraft configured to be towed in water, the towcraft comprising:

a hull structure at a lower portion of the towcraft, the hull structure being one of the group consisting of a rigid structure or a semi-rigid structure, the hull structure being one of the group consisting of a complete hull, a structural frame, or a partial hull, the hull structure having a bow end and a waterline;

an upper cushioning and flotation means mounted above the hull structure;

a rudder mounted to the hull structure, and positioned below the waterline;

a tapered inclined plane mounted to the rudder: and a towline attachment to the bow end of the towcraft, the towline attachment being positioned above the waterline.

15. The high maneuverability towcraft of claim 14, wherein the rudder has at least a partially balanced front/rear areal moment ratio such that a product of a first area in front of the pivot axis and its effective moment arm from the pivot axis is either equal to or somewhat less than a product of a second area to the rear of the pivot axis and its effective moment arm from the pivot axis whereby the ratio of these two products equals: ($\text{area}_{front} \times \text{effective moment arm}_{front}$) divided by ($\text{area}_{rear} \times \text{effective moment arm}_{rear}$).

16. The high maneuverability towcraft of claim 15, wherein the front/rear areal moment ratio is at least about 30/70.

17. The high maneuverability towcraft of claim 14 including a pair of rear fins positioned rearward of the rudder.

18. The high maneuverability towcraft of claim 14, wherein the hull structure is a circularly-shaped, and the upper cushioning and flotation means is an inflated toroidal tube.

19. The high maneuverability towcraft of claim 14, further including spaced-apart fins operatively attached to the hull structure wherein the fins have at least one of: flexible trailing portions such that the fins are capable of flexing both sideways and in the camber direction, or flexible trailing upper edges such that the fins are capable of flexing the trailing upper edges away from oncoming water, thereby increasing the engagement of the fins with the water.

20. The high maneuverability towcraft of claim 14, further including a means having a forward inclined plane operatively connected to and in a companion pivoting relationship with the rudder, the means having a forward inclined plane being positioned substantially above the rudder and below the towline attachment location.

21. The high maneuverability towcraft of claim 14, wherein the towcraft comprises a smooth bottom surface that is one of predominantly planar or slightly concave, the bottom surface having a sharp break along an aft edge of the towcraft for canceling a Coanda Effect and its associated drag on the towcraft.

22. The high maneuverability towcraft of claim 14, wherein the hull structure is enclosed within a waterproof fabric cover.

* * * * *